US012196434B2

(12) United States Patent
Choi et al.

(10) Patent No.: US 12,196,434 B2
(45) Date of Patent: Jan. 14, 2025

(54) INDOOR UNIT OF AN AIR CONDITIONER

(71) Applicant: LG ELECTRONICS INC., Seoul (KR)

(72) Inventors: Sunggyu Choi, Seoul (KR); Younggu Lee, Seoul (KR); Seongkuk Mun, Seoul (KR); Junseok Bae, Seoul (KR); Jungwoo Lee, Seoul (KR); Hwanhak Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1105 days.

(21) Appl. No.: 16/981,249

(22) PCT Filed: Mar. 15, 2019

(86) PCT No.: PCT/KR2019/003058
§ 371 (c)(1),
(2) Date: Sep. 15, 2020

(87) PCT Pub. No.: WO2019/177425
PCT Pub. Date: Sep. 19, 2019

(65) Prior Publication Data

US 2021/0048201 A1 Feb. 18, 2021

(30) Foreign Application Priority Data

Mar. 16, 2018 (KR) ..... 10-2018-0030777
Mar. 4, 2019 (KR) ..... 10-2019-0024964

(51) Int. Cl.
*F24F 1/0014* (2019.01)
*F24F 1/0033* (2019.01)
(Continued)

(52) U.S. Cl.
CPC ..... *F24F 1/0087* (2019.02); *F24F 1/0014* (2013.01); *F24F 1/0033* (2013.01); *F24F 6/02* (2013.01); *F24F 13/082* (2013.01)

(58) Field of Classification Search
CPC ..... F24F 1/0087; F24F 1/0014; F24F 1/0033; F24F 6/02; F24F 13/082; F24F 6/00;
(Continued)

(56) References Cited

U.S. PATENT DOCUMENTS 5,277,849 A * 1/1994 Morton ..... F24F 6/18 261/118
2008/0073802 A1* 3/2008 Anderson ..... F24F 6/18 261/118
(Continued)

FOREIGN PATENT DOCUMENTS

CN 201159512 Y 12/2008
CN 201170645 Y 12/2008
(Continued)

OTHER PUBLICATIONS

Li, Yushi, CN107702263 Translation.pdf, "Humidifying air conditioner", Feb. 2018, pp. 1-15.*
(Continued)

*Primary Examiner* — Avinash A Savani
*Assistant Examiner* — Ryan L Faulkner
(74) *Attorney, Agent, or Firm* — Bryan Cave Leighton Paisner LLP

(57) ABSTRACT

An indoor unit of an air conditioner in which filtered air is blown inside a steam generator via a humidification fan, and humidified air inside the steam generator is discharged to the side of a steam guide, where a sufficient flow may be supplied to the inside of the steam generator, such that the steam and the filtered air may be effectively mixed, thereby enabling the generation of humidified air. Since the humidi-
(Continued)

fication fan blows intake air into the steam generator so as to enable humidified air to flow, the humidified air may flow up to a discharge port even when an independent flow channel of the steam guide is long.

15 Claims, 28 Drawing Sheets

(51) Int. Cl.
*F24F 1/0087* (2019.01)
*F24F 6/02* (2006.01)
*F24F 13/08* (2006.01)

(58) Field of Classification Search
CPC ..... F24F 2006/008; F24F 6/025; F24F 2006/065; F24F 6/14; F24F 6/16; F24F 6/18; F24F 13/00; F24F 13/06; F24F 13/065; F24F 11/0008; F24F 2203/00
USPC ..... 454/284
See application file for complete search history.

(56) References Cited

U.S. PATENT DOCUMENTS

| | | | | |
|---|---|---|---|---|
| 2011/0174022 | A1 | 7/2011 | Ryu et al. | |
| 2016/0186761 | A1* | 6/2016 | Mun | F24F 1/0014 415/203 |

FOREIGN PATENT DOCUMENTS

| | | | | | |
|---|---|---|---|---|---|
| CN | 201225731 | Y | | 4/2009 | |
| CN | 101666523 | A | | 3/2010 | |
| CN | 203704152 | U | | 7/2014 | |
| CN | 104713169 | A | | 6/2015 | |
| CN | 105402842 | A | | 3/2016 | |
| CN | 107029517 | A | | 8/2017 | |
| CN | 206449809 | U | | 8/2017 | |
| CN | 107631399 | A | | 1/2018 | |
| CN | 107702263 | A | * | 2/2018 | F24F 13/00 |
| CN | 207486962 | U | | 6/2018 | |
| CN | 108361897 | A | | 8/2018 | |
| CN | 109716039 | A | | 5/2019 | |
| JP | 2002081718 | A | | 3/2002 | |
| KR | 10-2005-0047161 | A | | 1/2006 | |
| KR | 100552498 | B1 | | 2/2006 | |
| KR | 10-2007-0047102 | A | | 5/2007 | |
| KR | 10-0768168 | B1 | | 10/2007 | |
| KR | 10-2007-0112330 | A | | 11/2007 | |
| KR | 20-2009-0000506 | U | | 1/2009 | |
| KR | 10-2009-0084474 | A | | 8/2009 | |
| KR | 10-1542375 | B1 | | 1/2010 | |
| KR | 10-2010-0013525 | A | | 2/2010 | |
| KR | 10-2014-0067310 | A | | 6/2010 | |
| KR | 20150050717 | A | * | 5/2015 | F24F 13/28 |
| KR | 10-2015-0142703 | A | | 12/2015 | |
| KR | 10-2016-0006562 | A | | 1/2016 | |

OTHER PUBLICATIONS

Yoo, Bo Sun, KR20140067310 Translation.pdf, "Precise temperature control unit with removing condensed water", Jun. 2015, pp. 1-6.*

Lim, Tae Guy, KR20150050717 Translation.pdf, "A humidifying device including lift device", May 2015, pp. 1-14.*

* cited by examiner

【FIG. 1】
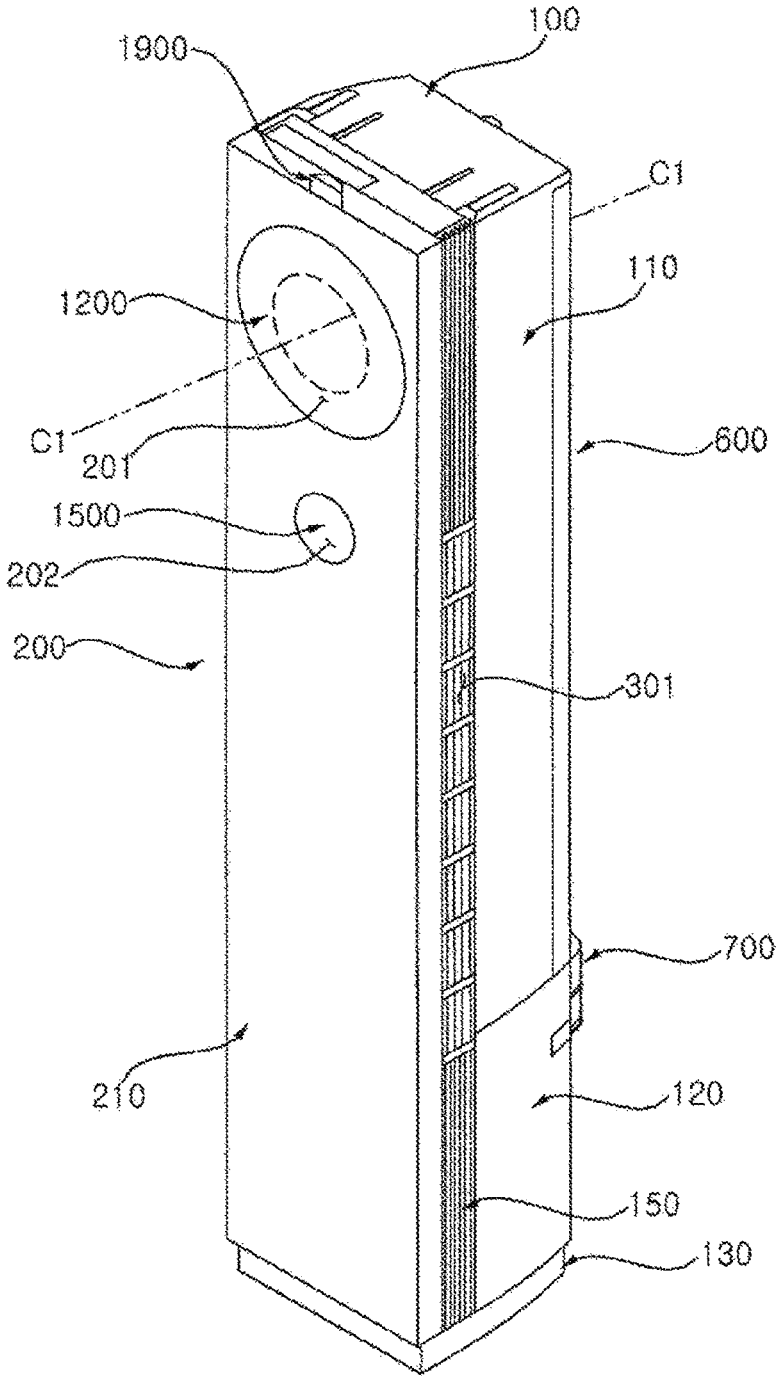

【FIG. 2】
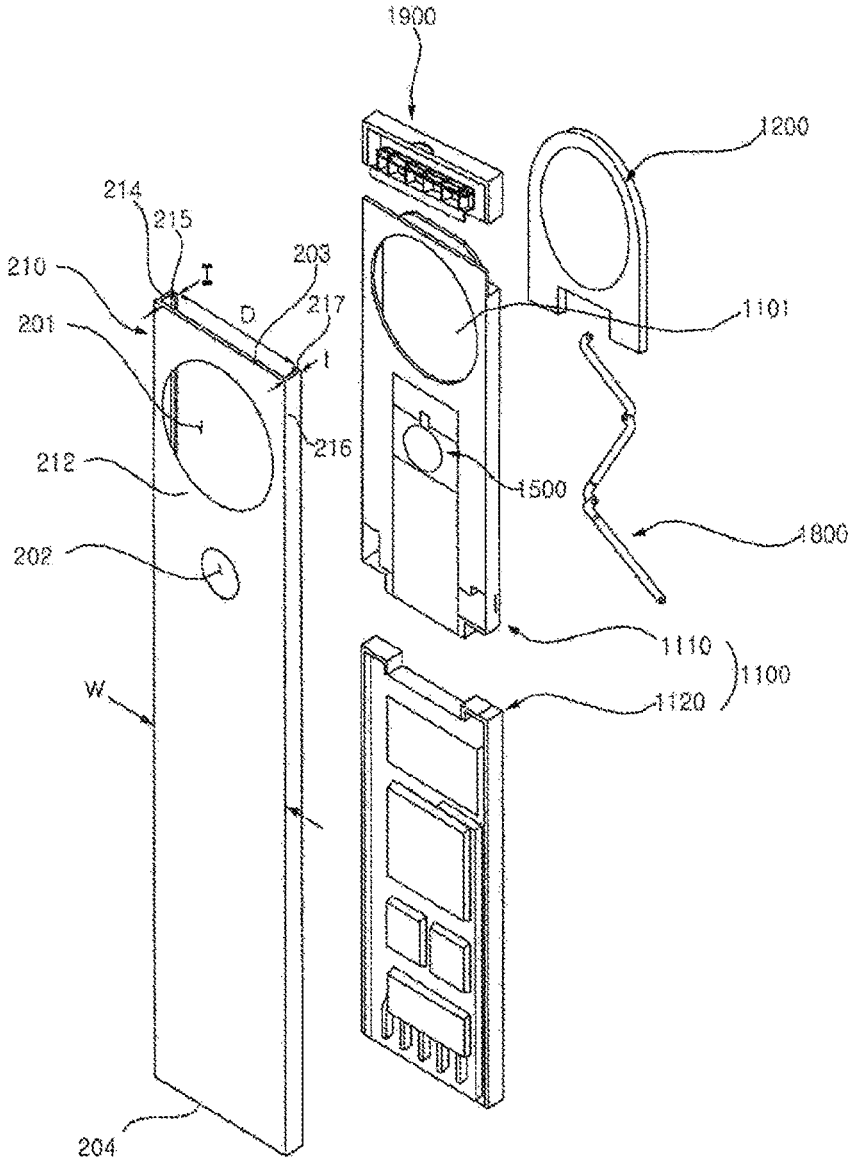

【FIG. 3】
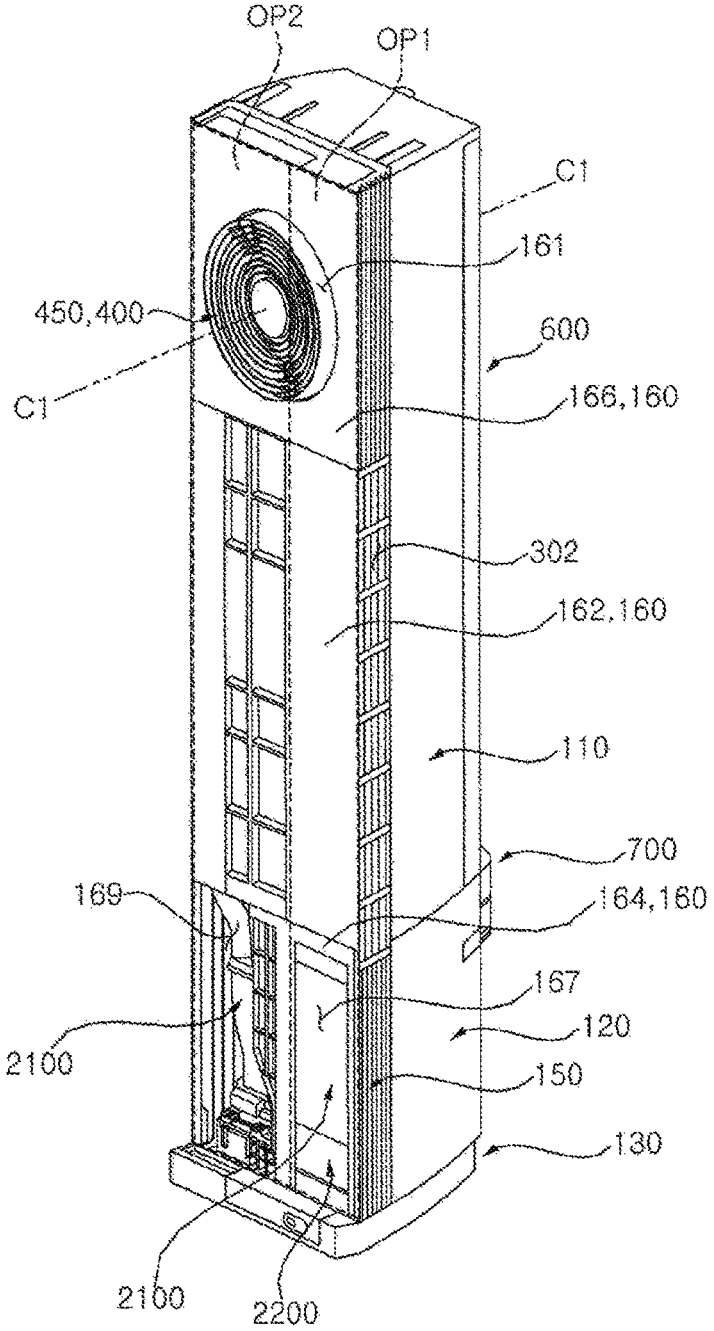

【FIG. 4】
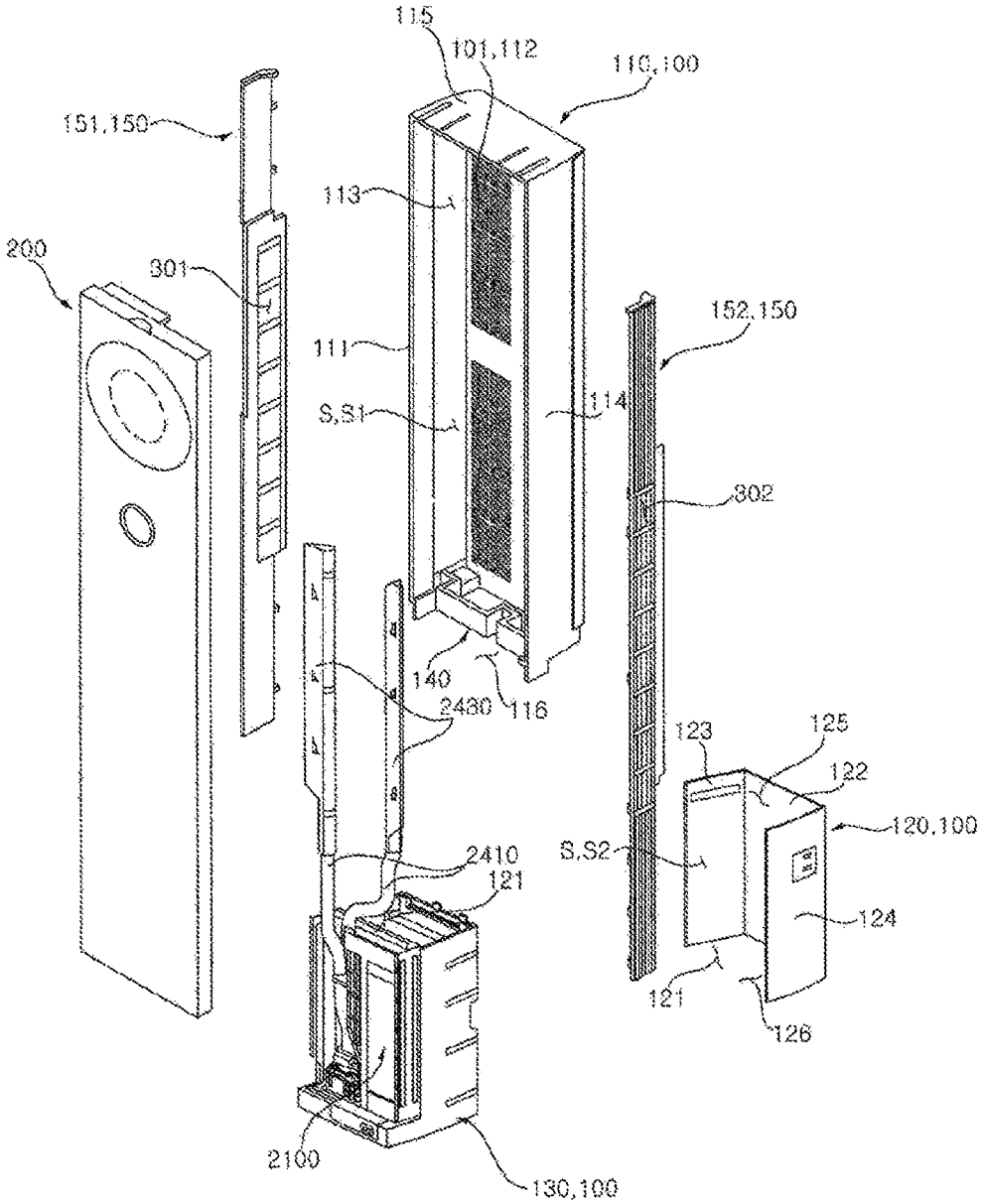

【FIG. 5】
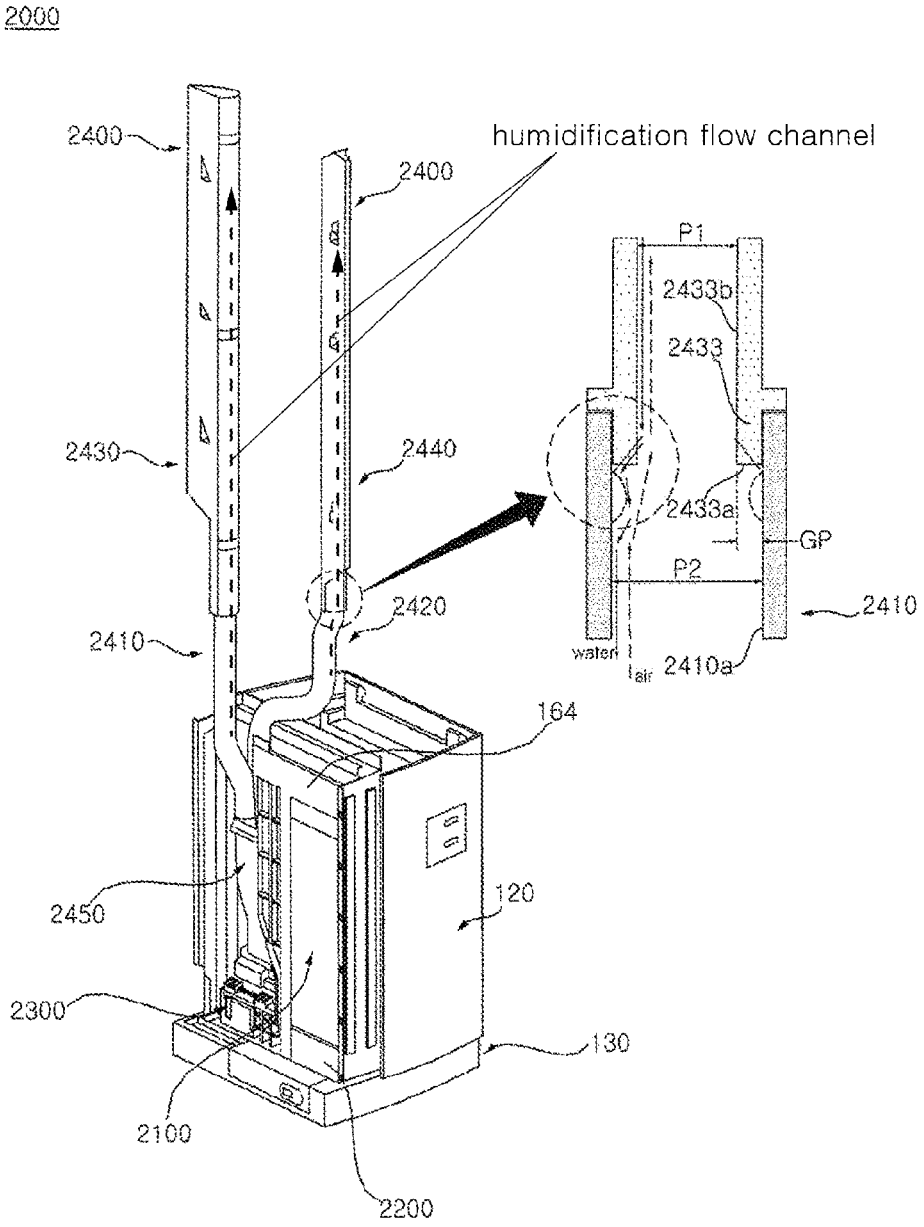

【FIG. 6】
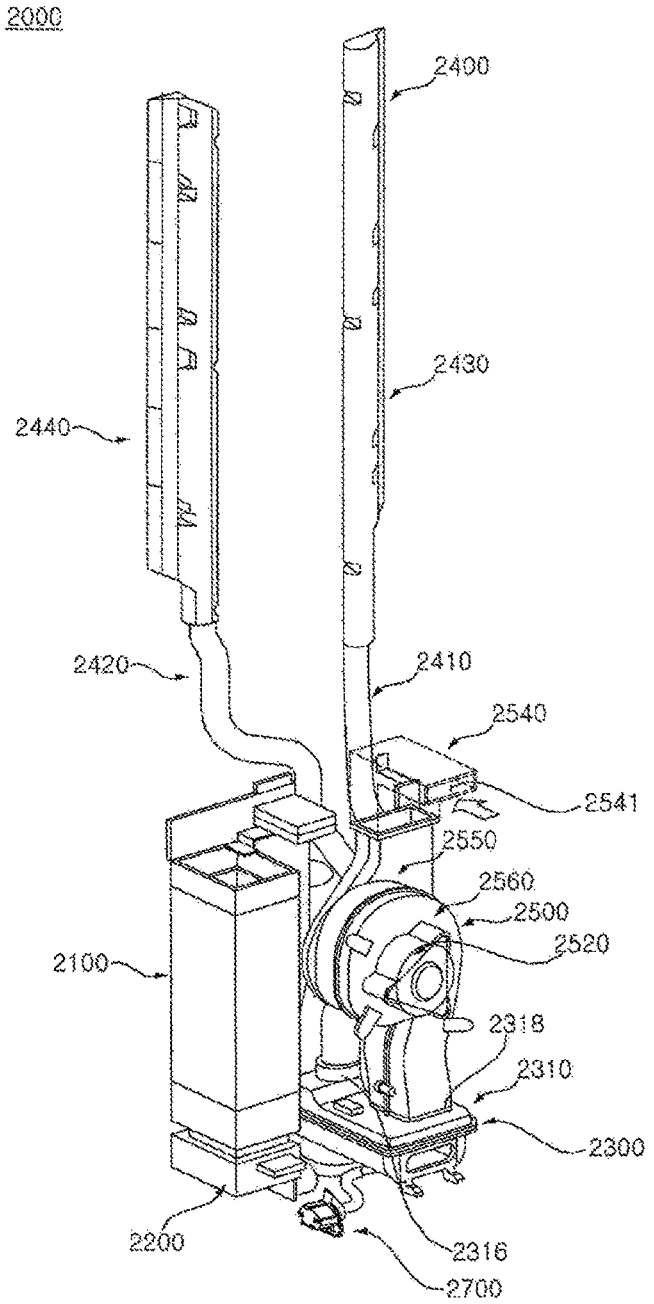

【FIG. 7】
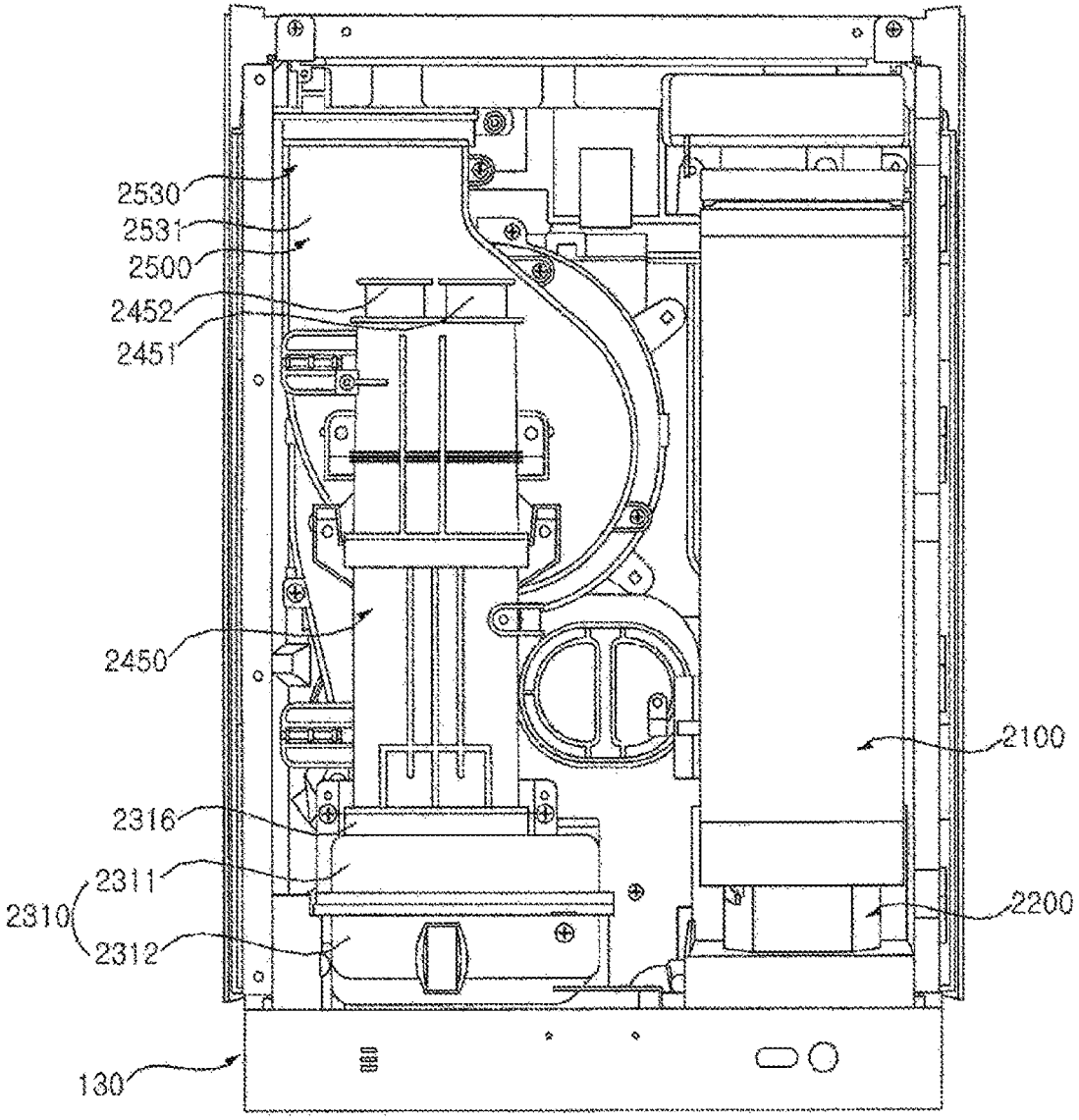

【FIG. 8】
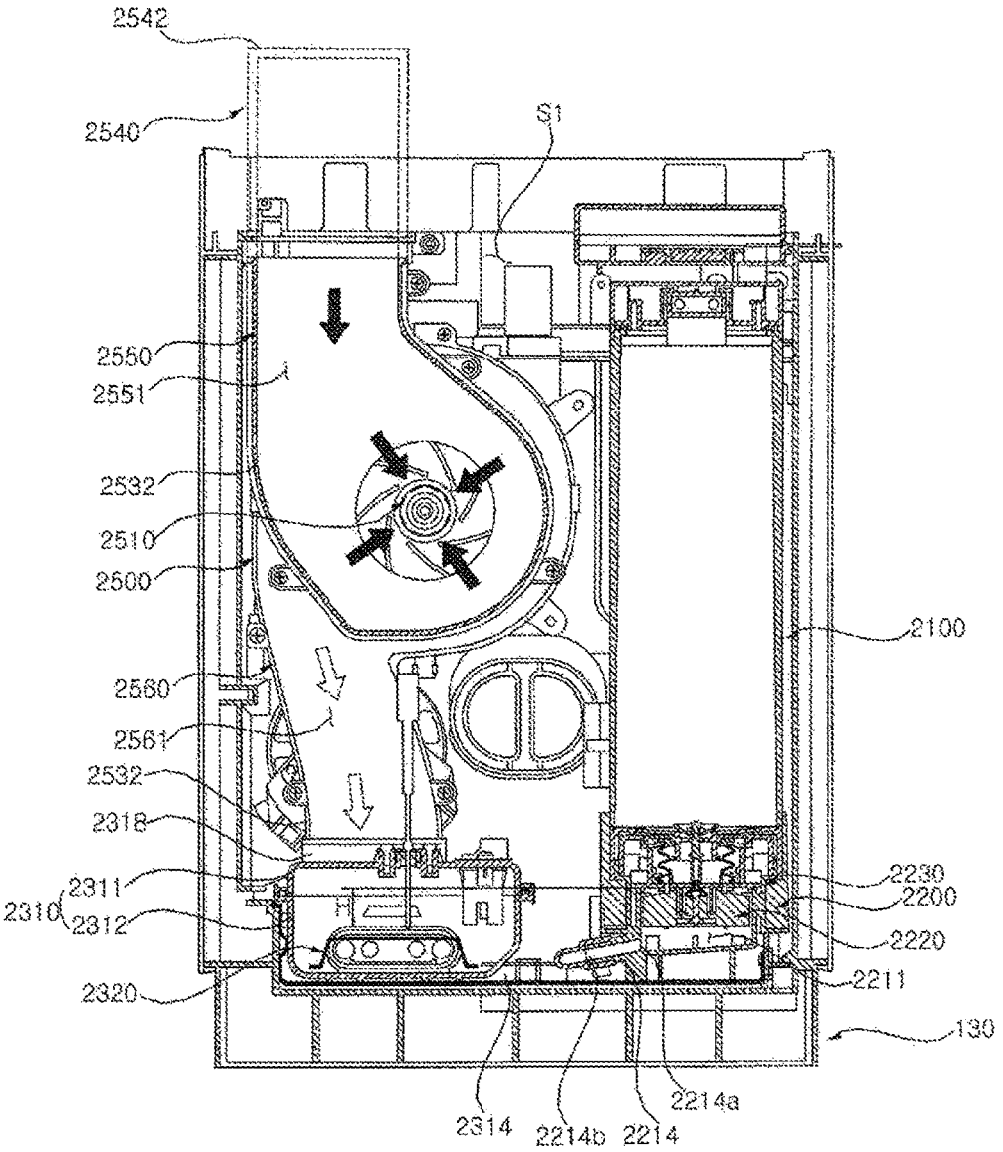

【FIG. 9】
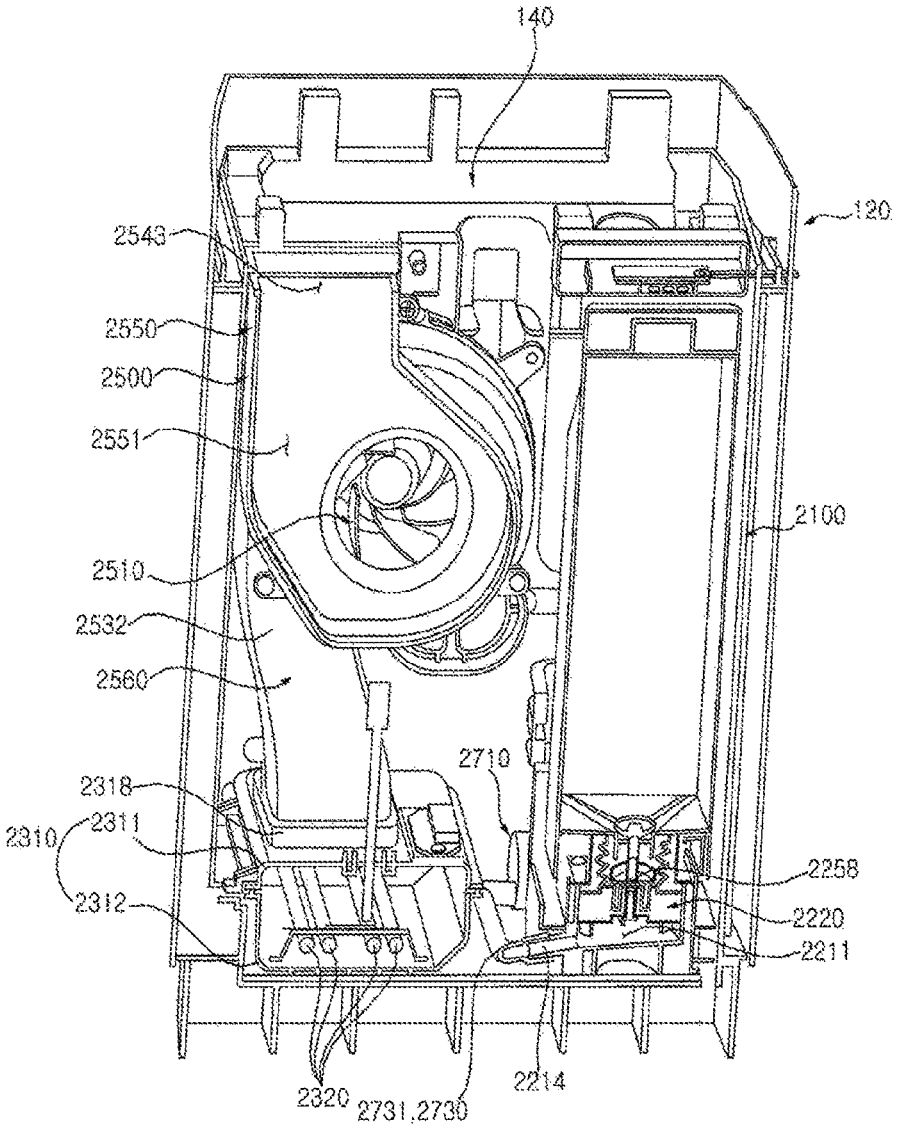

【FIG. 10】
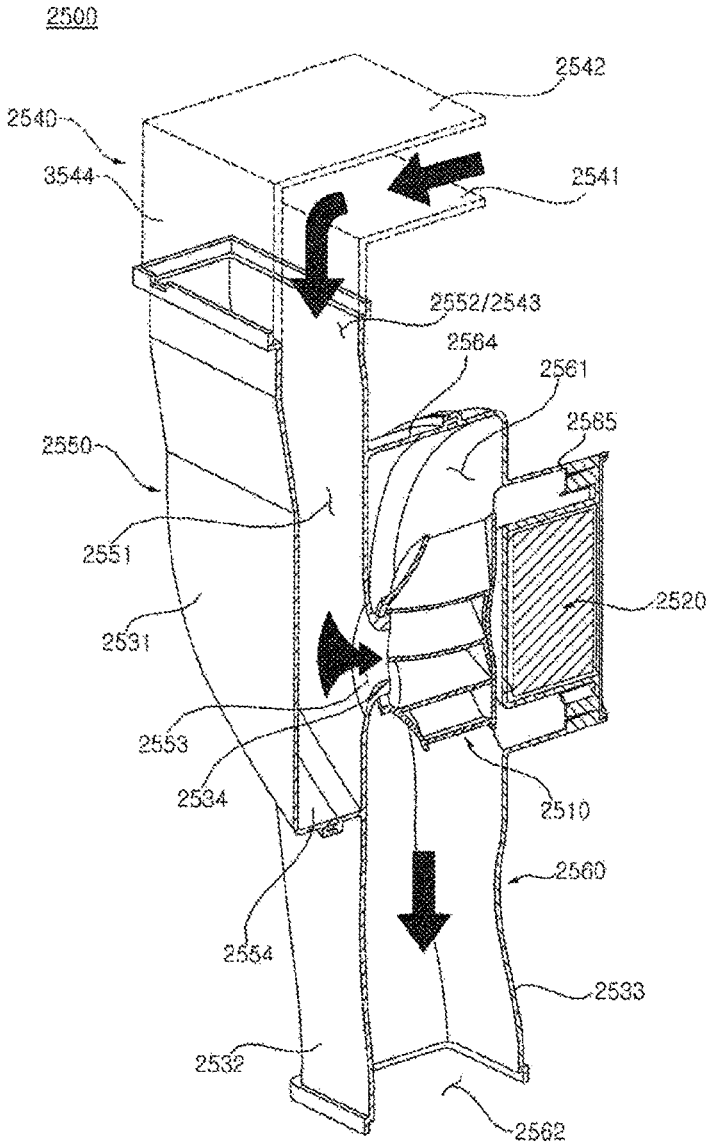

【FIG. 11】
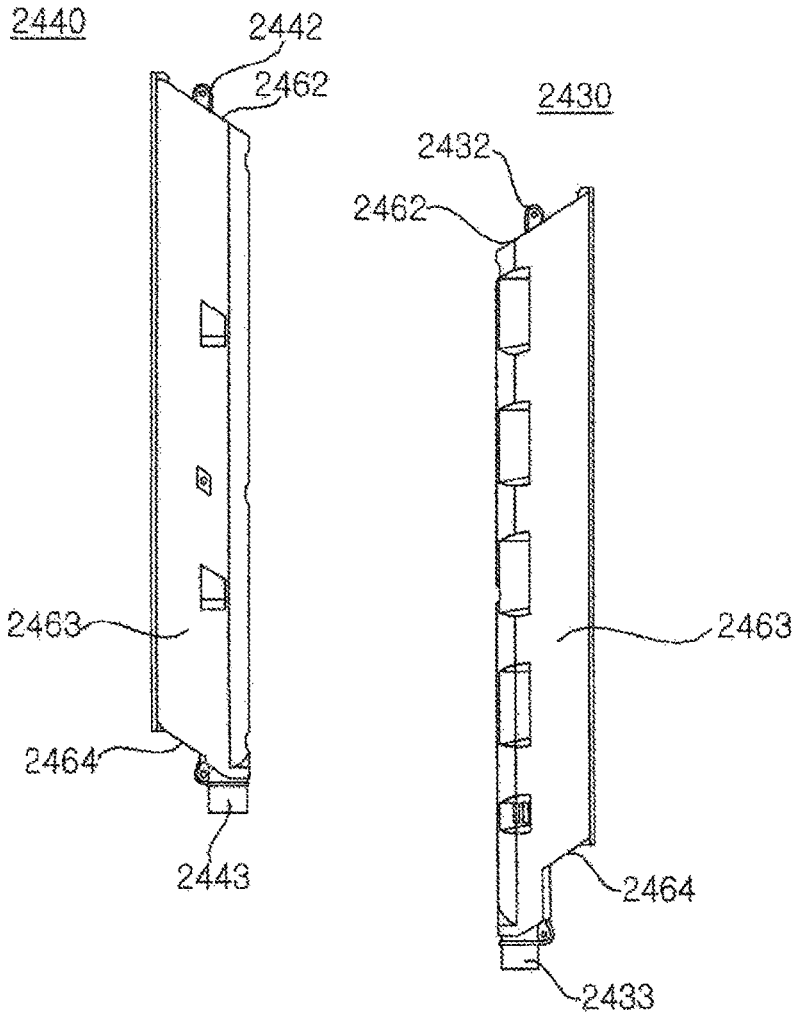

【FIG. 12】
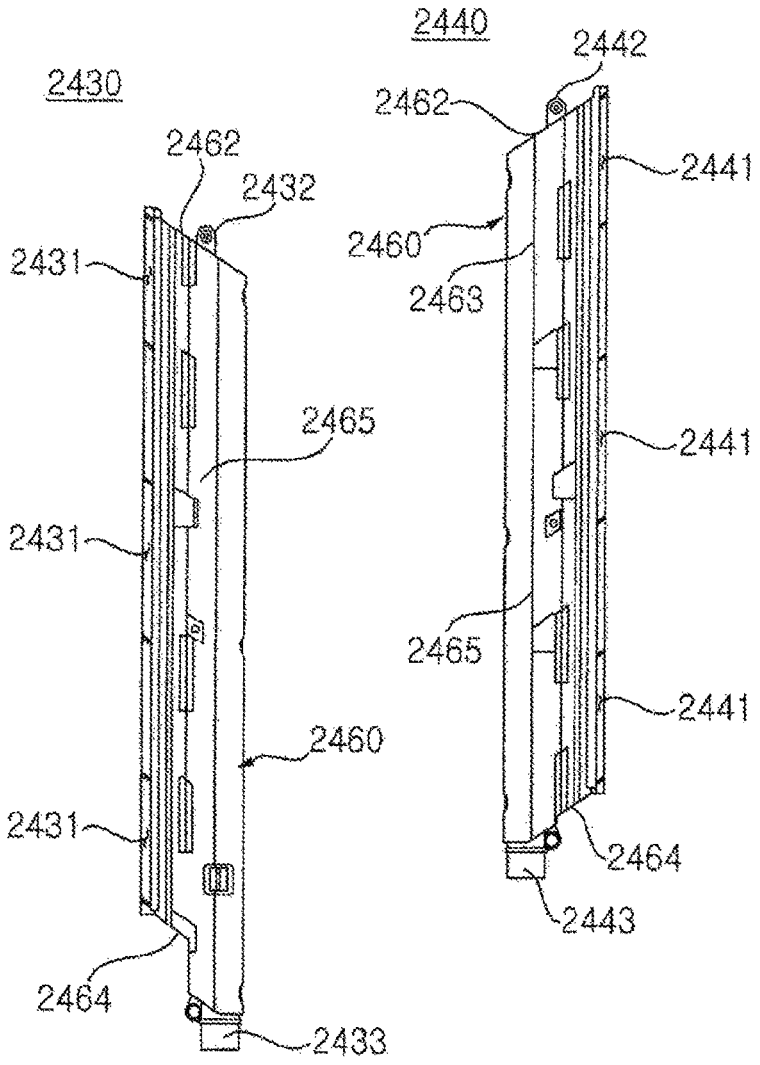

【FIG. 13】
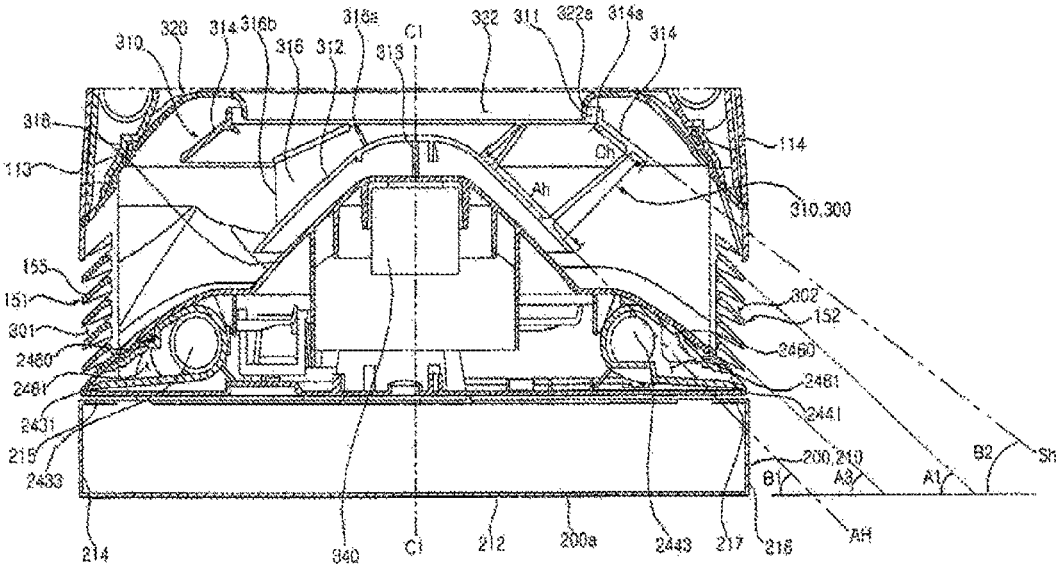

【FIG. 14】
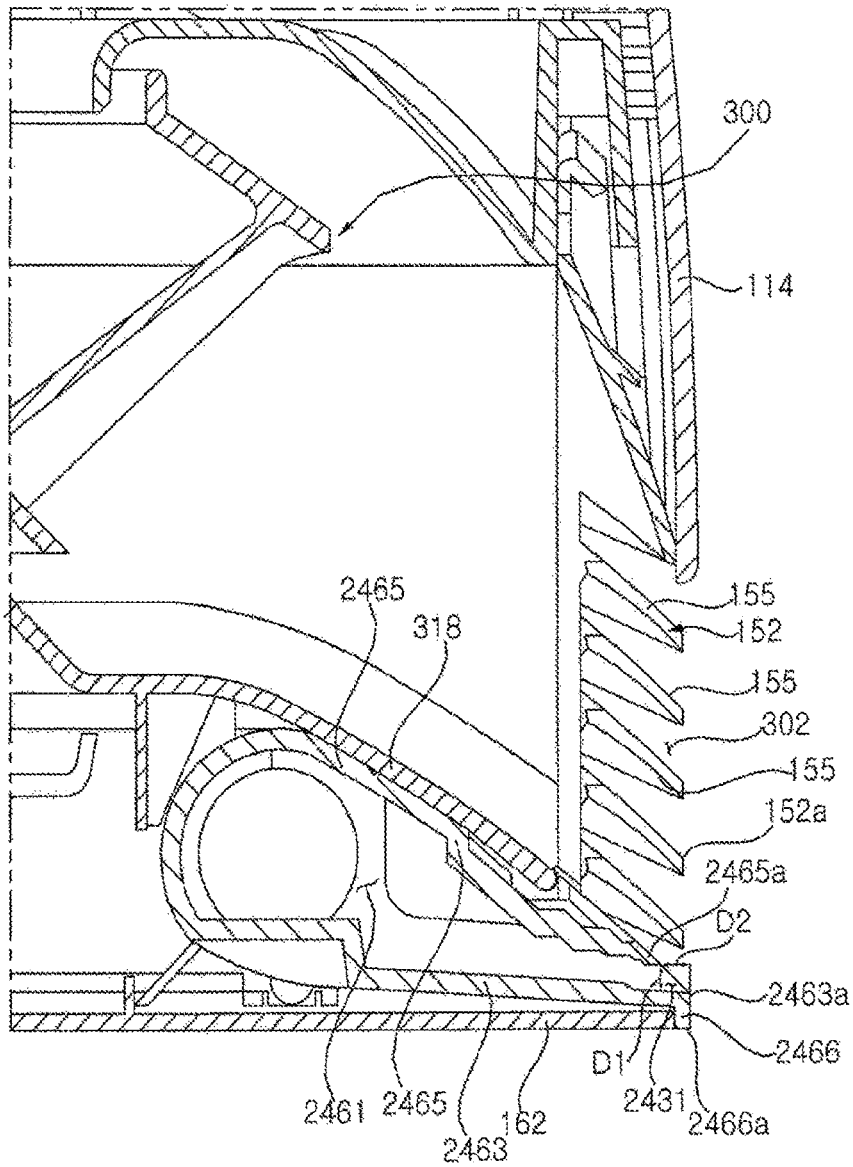

【FIG. 15】
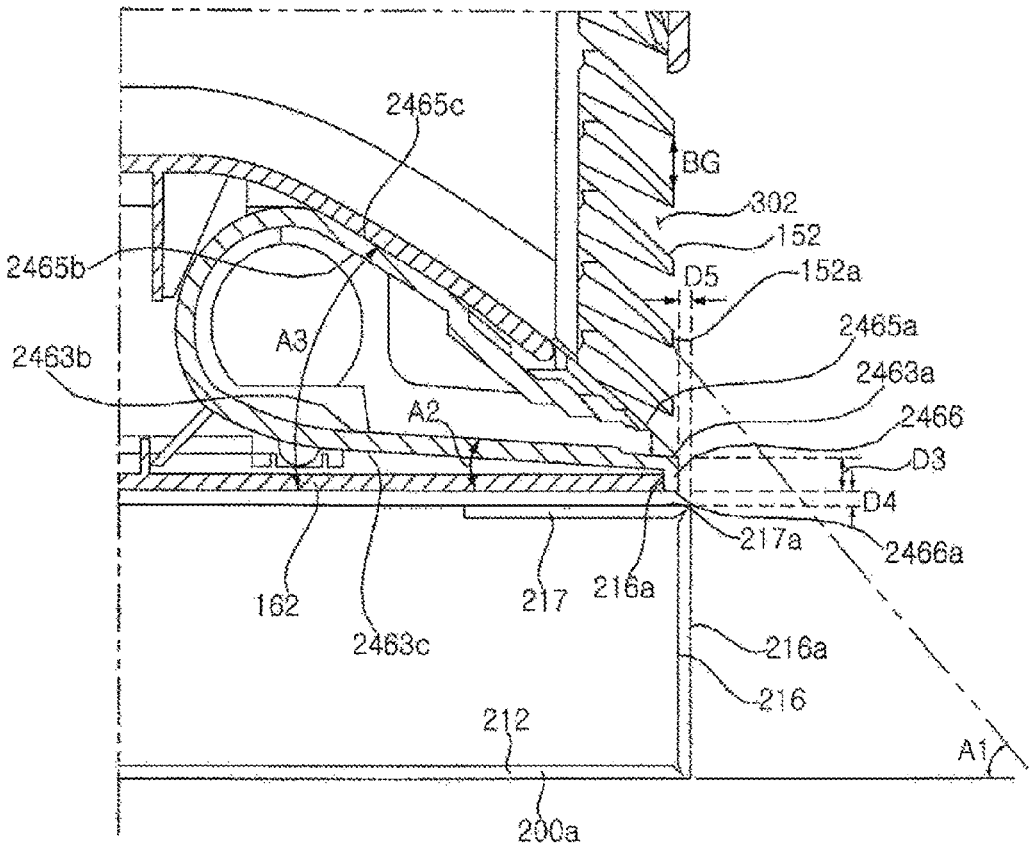

【FIG. 16】
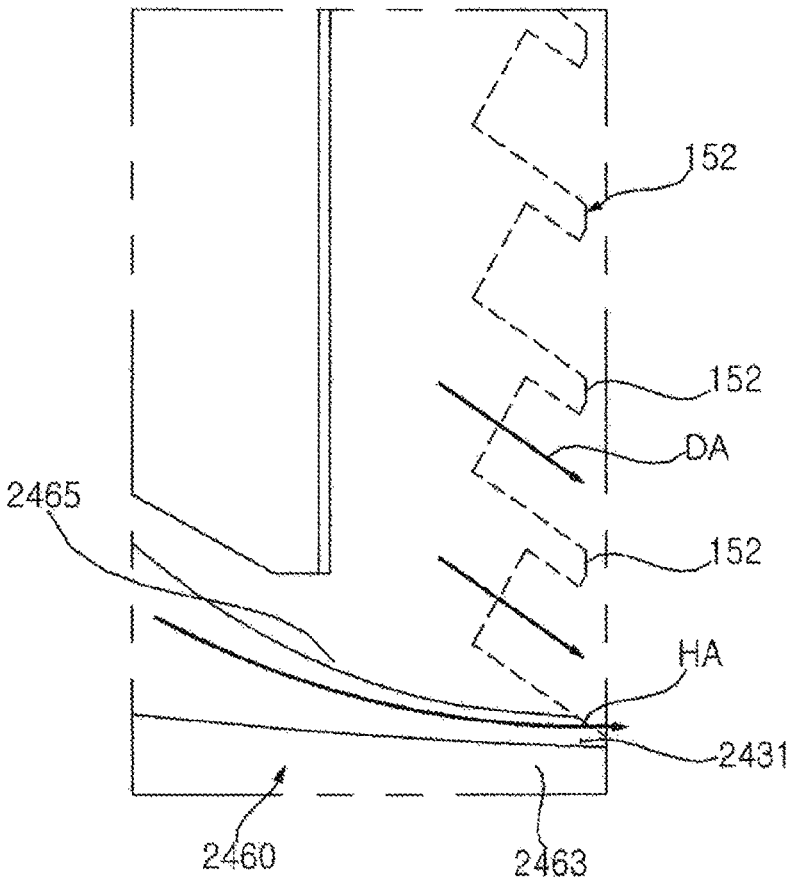

【FIG. 17】
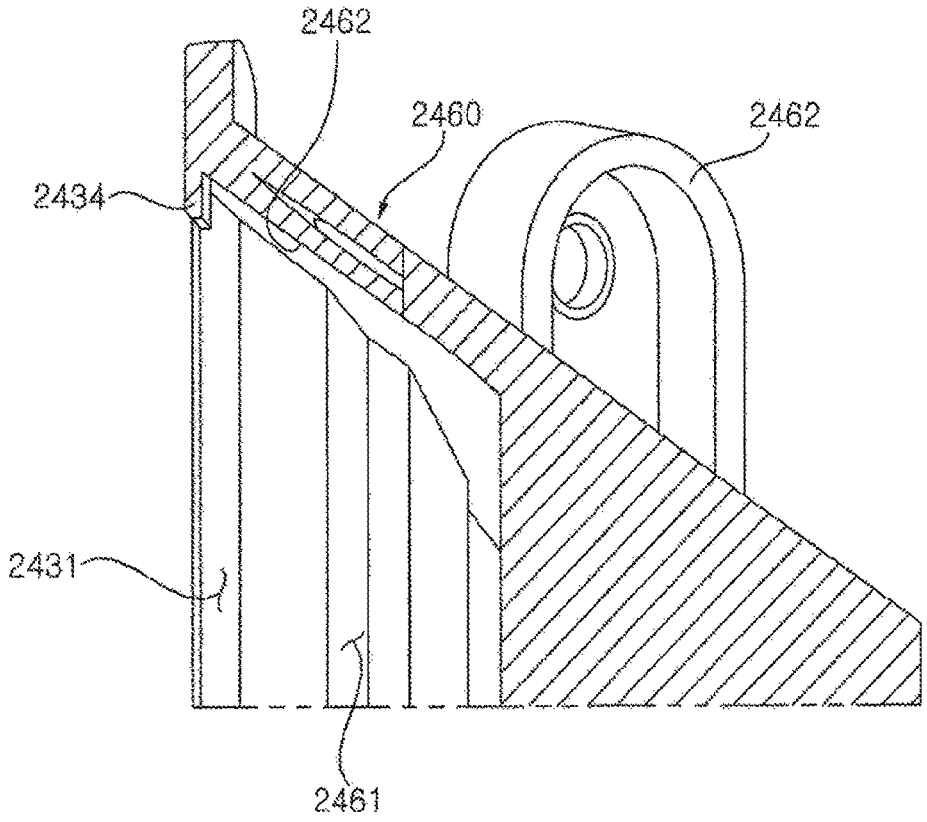

【FIG. 18】
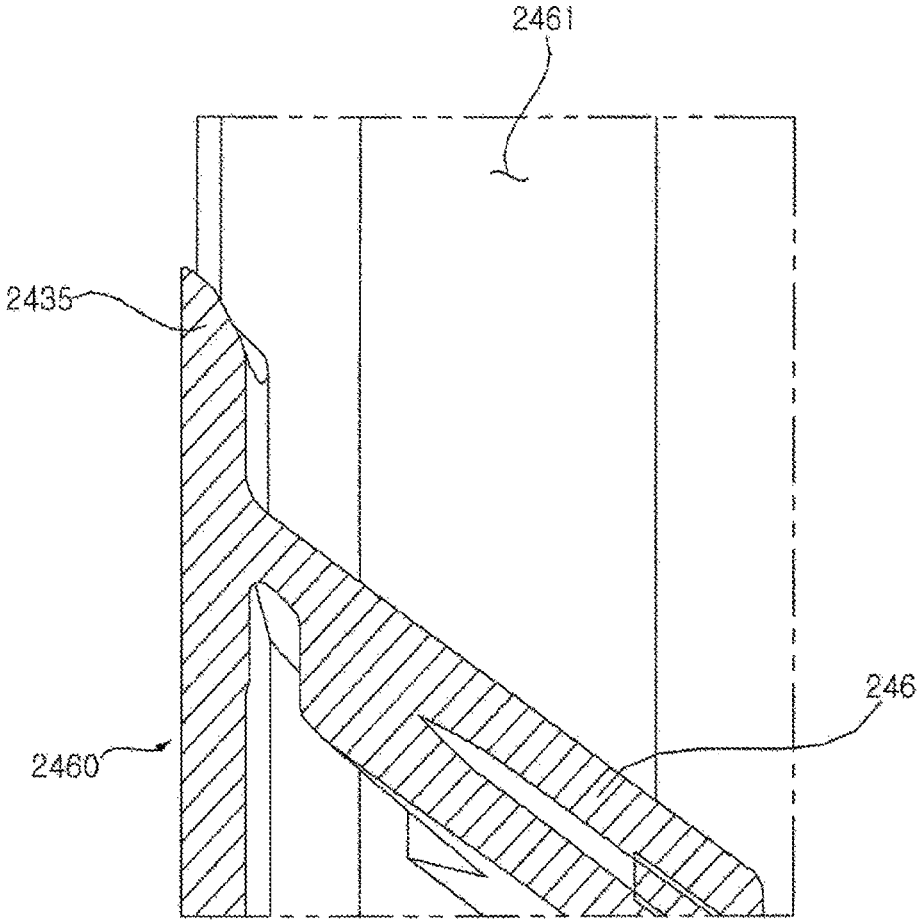

【FIG. 19】
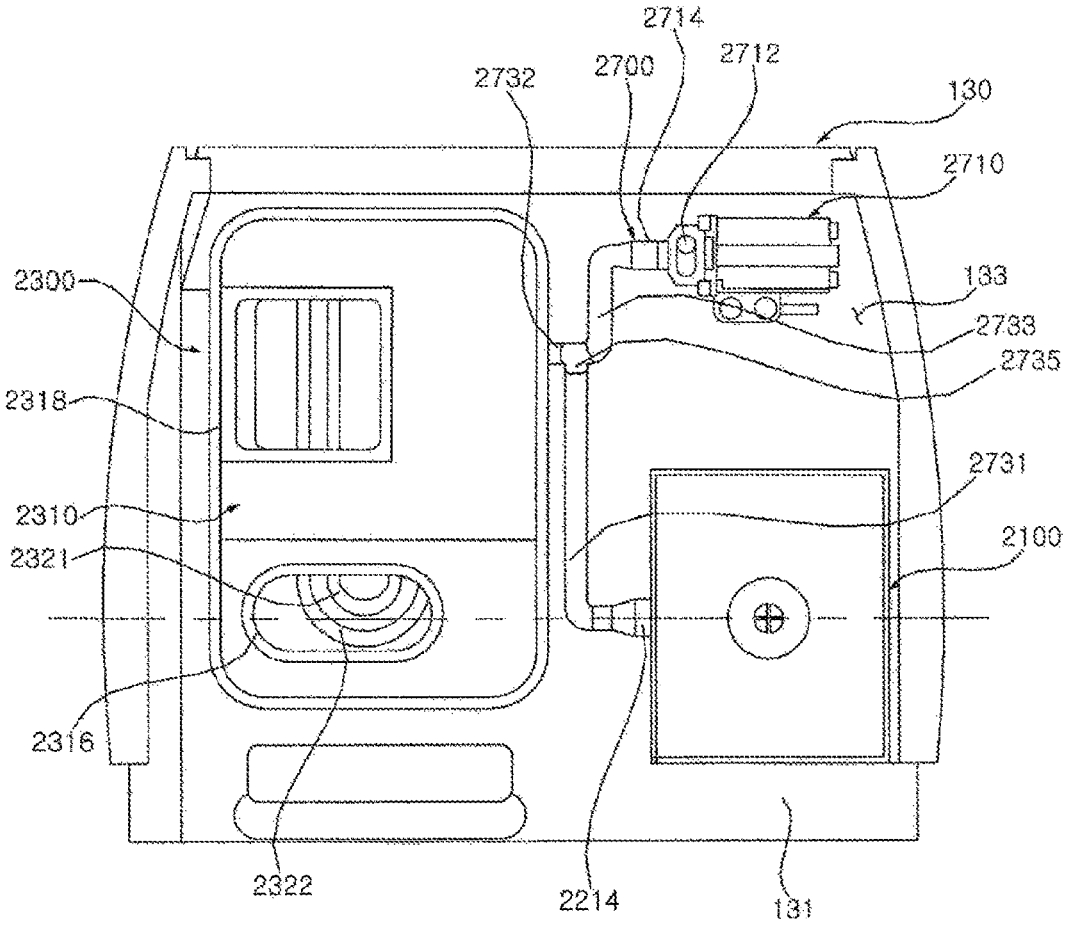

【FIG. 20】
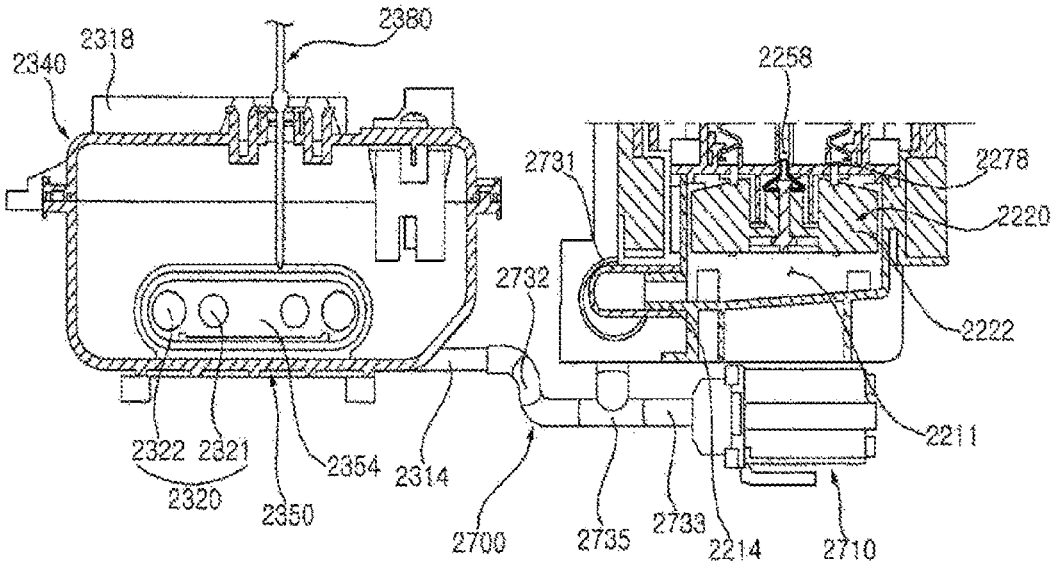

【FIG. 21】
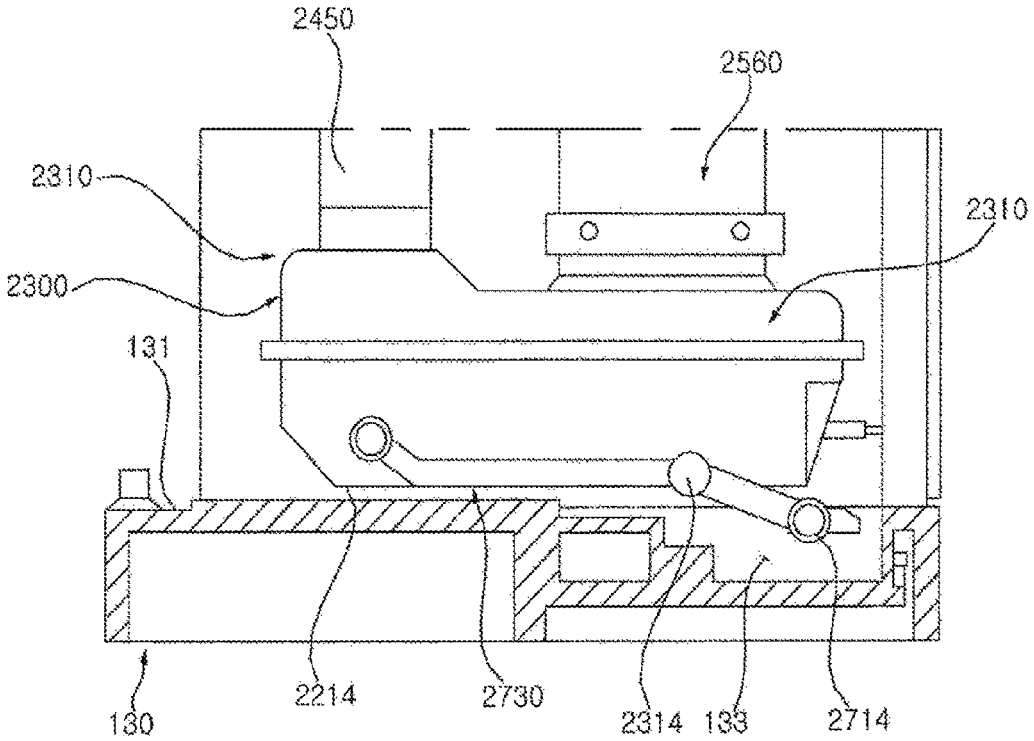

【FIG. 22】
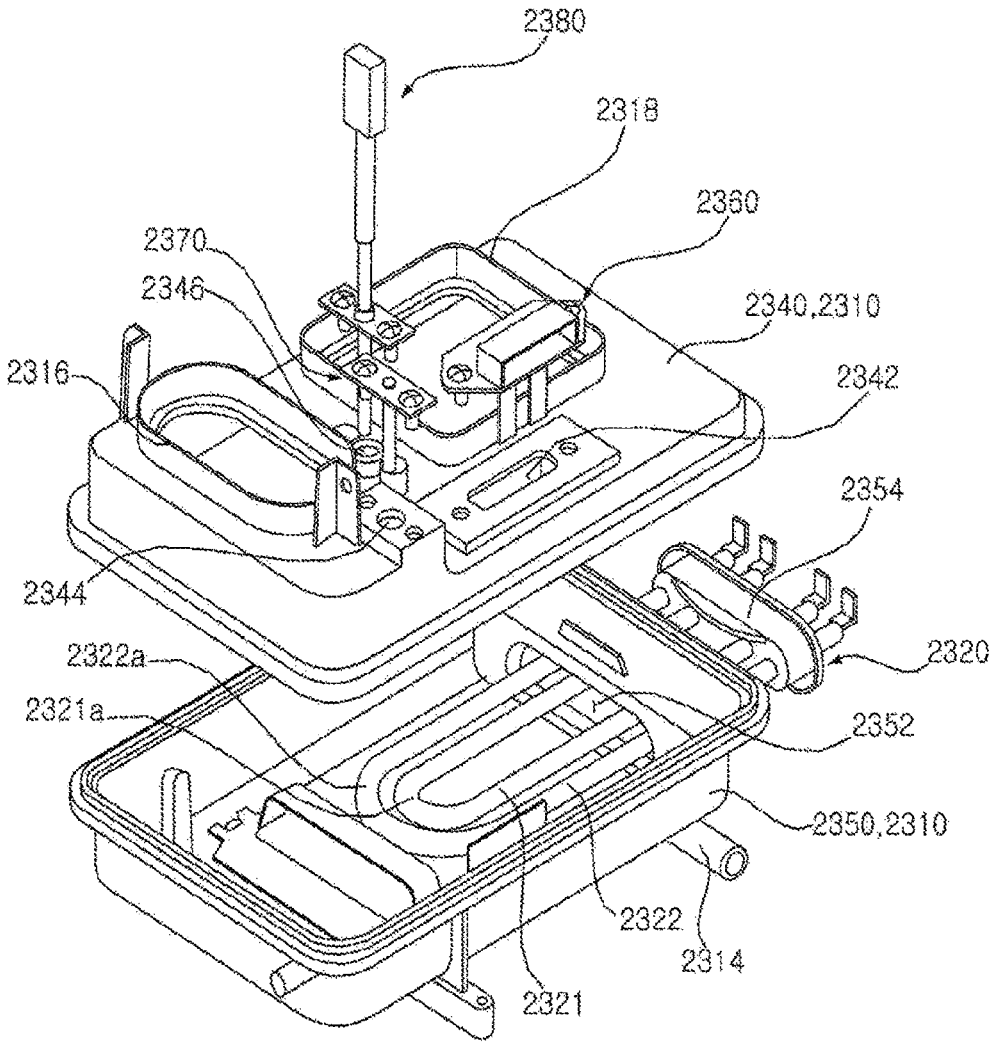

【FIG. 23】
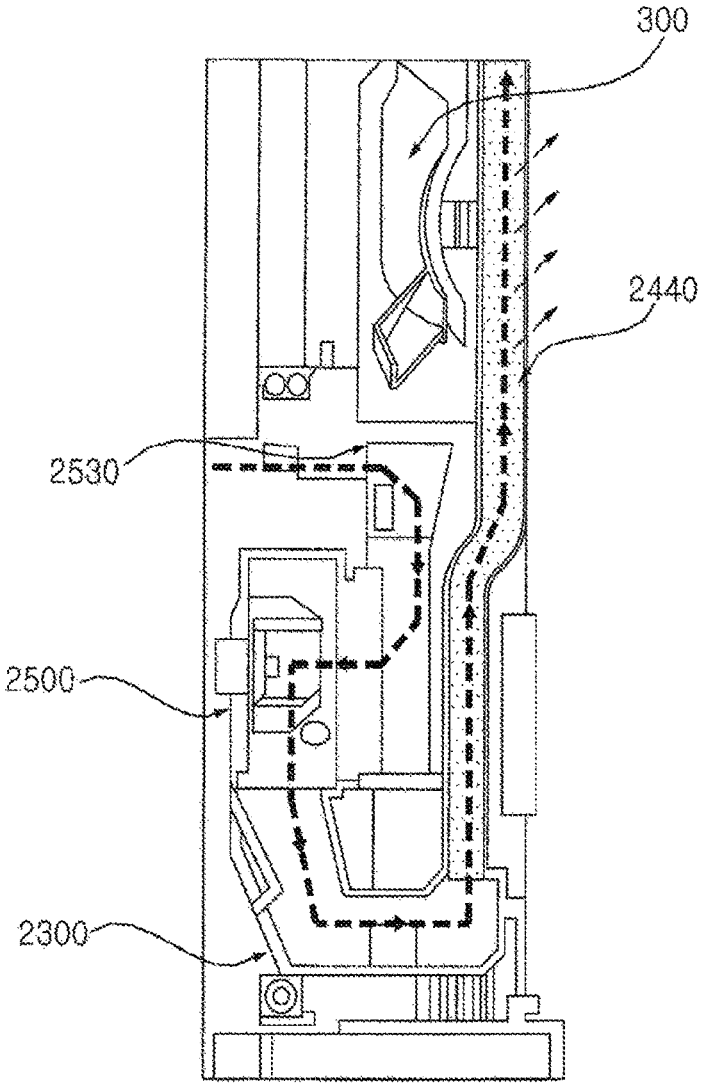

【FIG. 24】
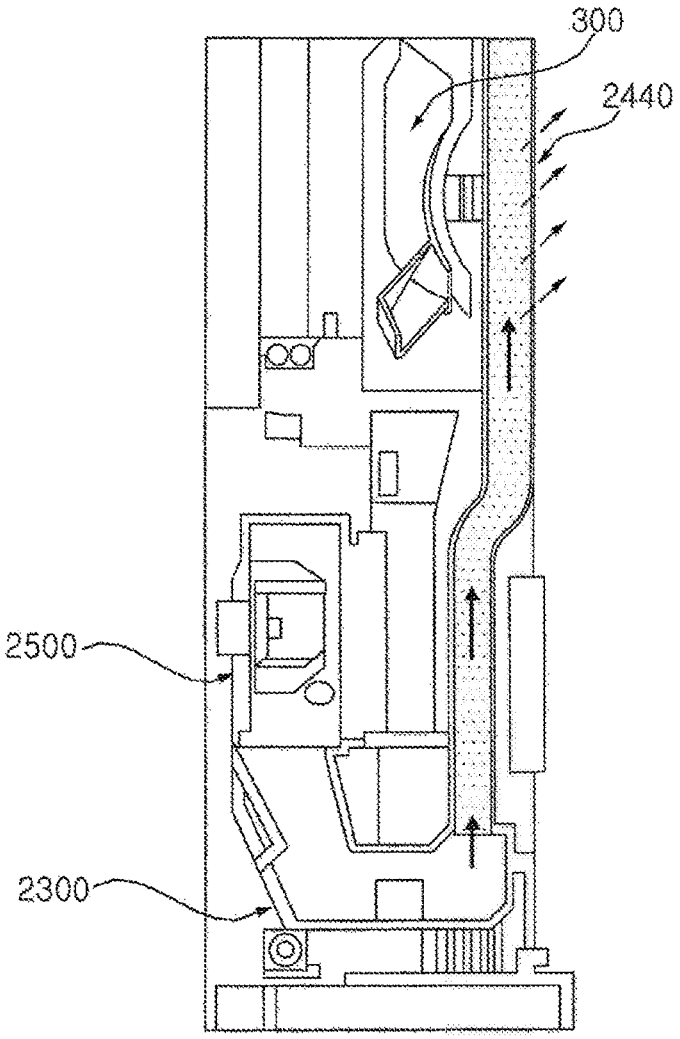

【FIG. 25】
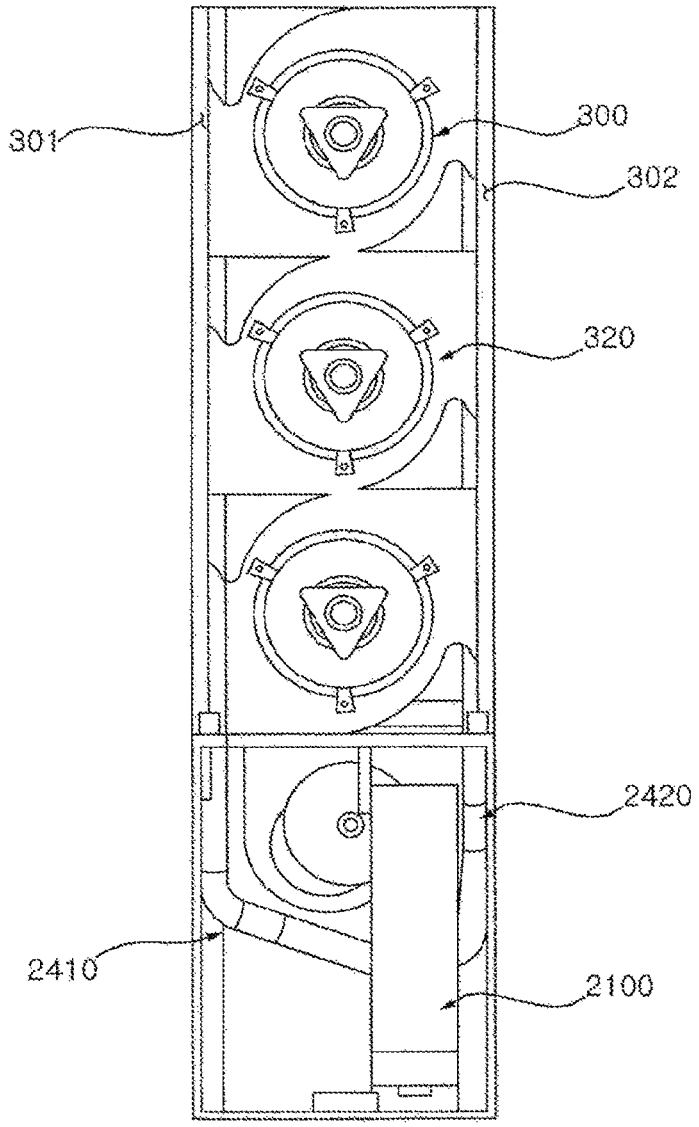

【FIG. 26】
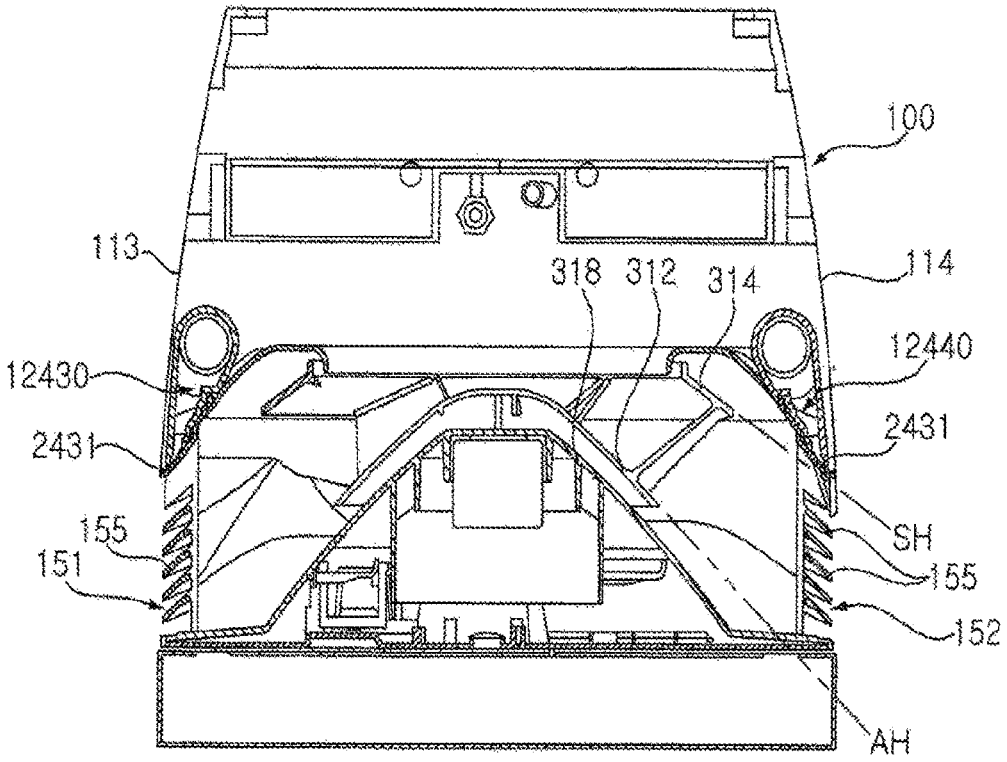

【FIG. 27】
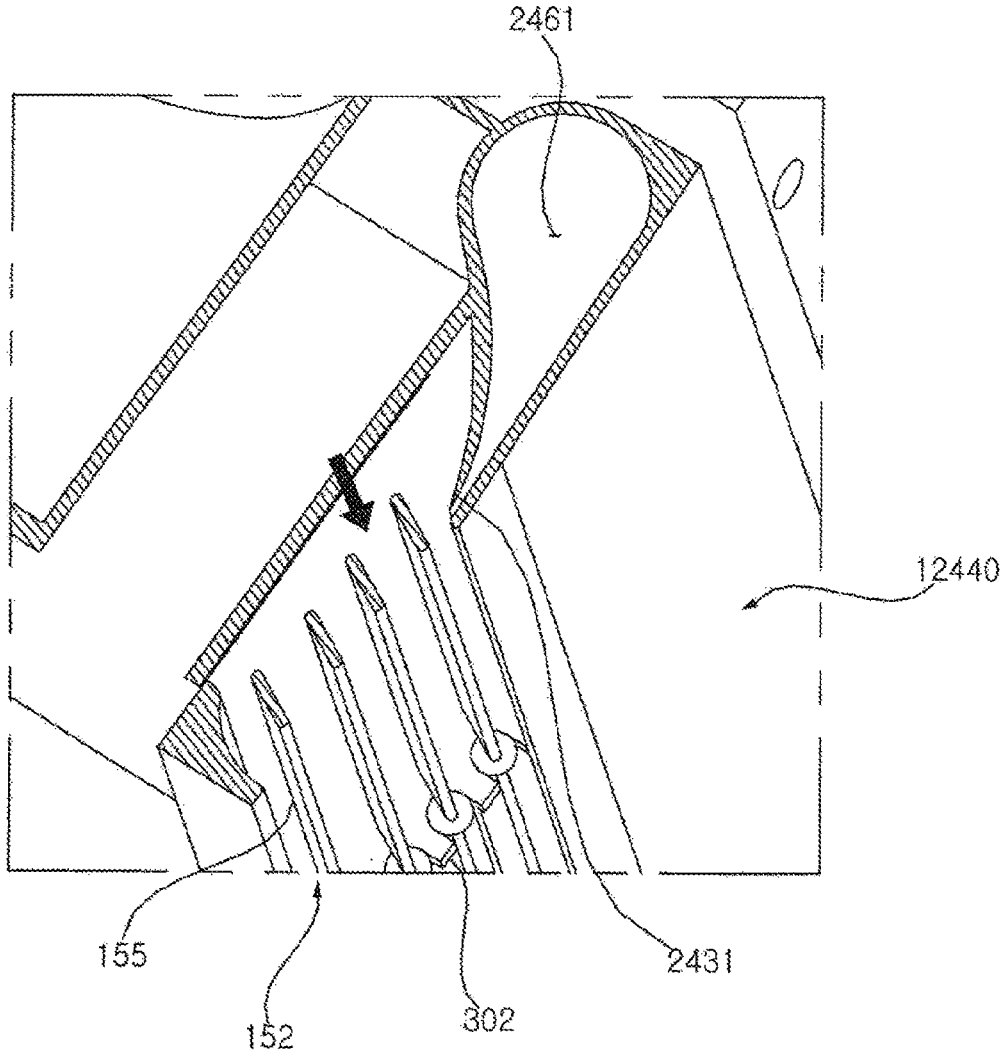

【FIG. 28】
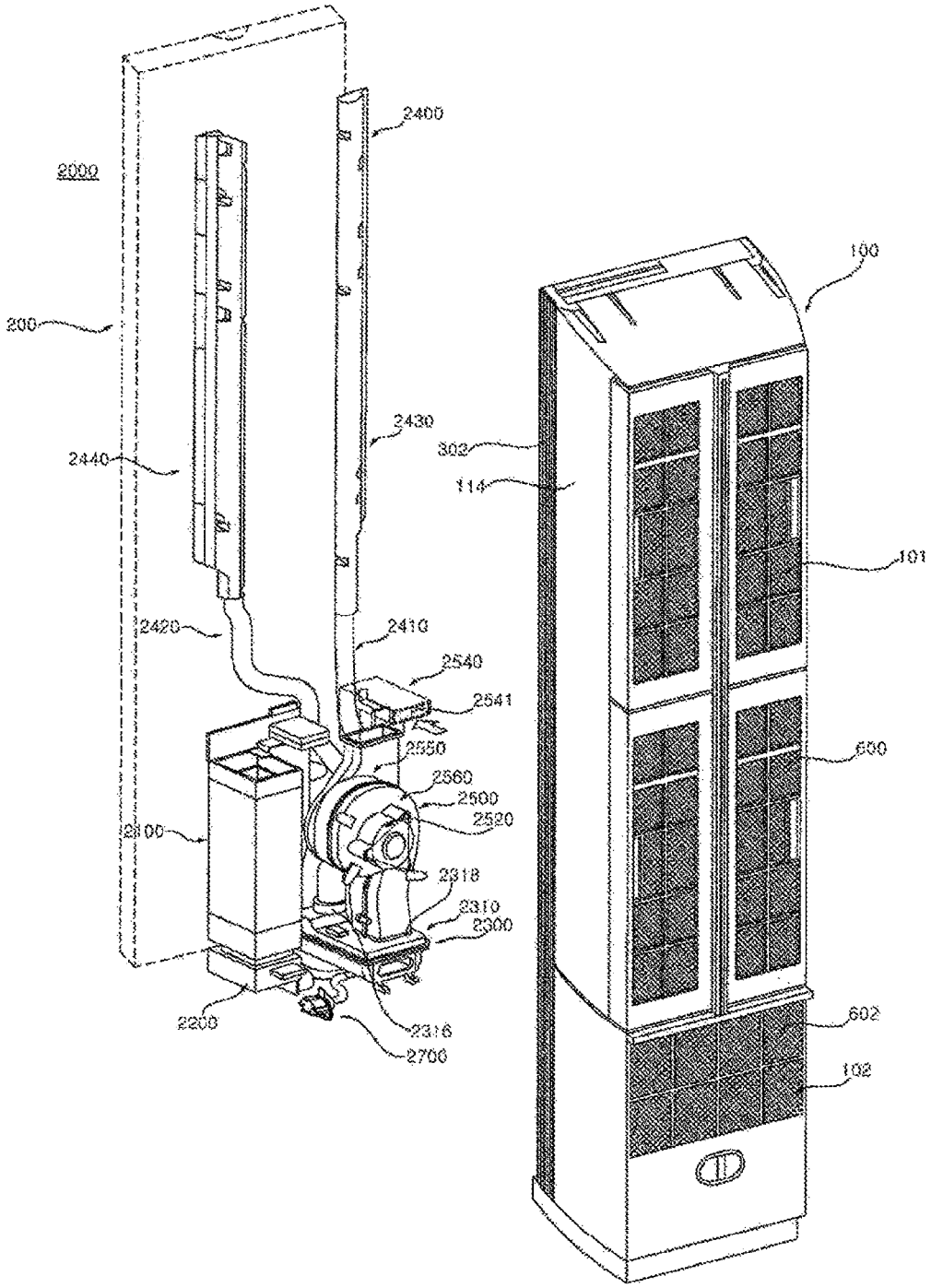

INDOOR UNIT OF AN AIR CONDITIONER

CROSS-REFERENCE TO RELATED APPLICATION

This application is a National Stage Application of International Application No. PCT/KR2019/003058, filed on Mar. 15, 2019, which claims benefit of and priority to Korean Patent Application Nos.: KR10-2018-0030777, filed on Mar. 16, 2018, and KR10-2019-0024964, filed on Mar. 4, 2019, all of which are hereby incorporated by reference in their entirety for all purposes as if fully set forth herein.

TECHNICAL FIELD

The present disclosure relates to an indoor unit of an air conditioner, and more particularly, to an indoor unit of an air conditioner which enables humidified air, generated in a steam generator, to flow to a discharge port of a cabinet assembly through a steam guide.

BACKGROUND

For split air conditioners, an indoor unit is disposed in an indoor space, and an outdoor unit is disposed in an outdoor space. Air in the indoor space can be cooled, heated or dehumidified, using refrigerants circulating in the indoor unit and the outdoor unit.

The indoor unit of the split air conditioner can be classified as a standing indoor unit that stands on the floor, a wall-mounted indoor unit that is mounted on the wall in an indoor space, a ceiling-mounted indoor unit that is installed on the ceiling of an indoor space and the like, based on methods for installation.

A standing indoor unit of the related art can dehumidify air in an indoor space in a cooling mode, but cannot humidify air in an indoor space in a heating mode.

A standing air conditioner provided with a humidification apparatus capable of performing humidification functions is disclosed in Korean Patent Publication No. 10-2013-0109738.

The standing indoor unit according to Korean Patent Publication No. 10-2013-0109738 is provided with a humidification apparatus in a main body forming an exterior of the indoor unit. The humidification apparatus according to Korean Patent Publication No. 10-2013-0109738 has a structure in which water of a drain pan is stored in a water tank, the stored water is used to wet an absorption member, and the absorption member evaporates absorbed water naturally.

The humidification apparatus according to Korean Patent Publication No. 10-2013-0109738 uses condensate flowing from a heat exchanger, instead of clean water. Accordingly, water in the water tank can contain a large amount of foreign substances separated from a surface of the heat exchanger, and the foreign substances can be a breeding ground for fungi or germs.

Additionally, in the humidification apparatus according to Korean Patent Publication No. 10-2013-0109738, water is evaporated in the main body. Accordingly, the evaporated water can be attached to a component or a wall in the main body, and can help fungi or germs to spread.

As the humidification apparatus according to Korean Patent Publication No. 10-2013-0109738 provides a humidification function using condensate of the indoor heat exchanger, the humidification apparatus can perform the humidification function only in a cooling mode. In other words, the humidification apparatus cannot perform the humidification function because the condensate is not generated in a heating mode.

SUMMARY

The present disclosure is directed to an indoor unit of an air conditioner, which may blow filtered air into a steam generator to discharge humidified air.

The present disclosure is directed to an indoor unit of an air conditioner, where an independent flow channel capable of supplying filtered air to a steam generator is disposed.

The present disclosure is directed to an indoor unit of an air conditioner, which may supply humidified air, generated in a steam generator, to a discharge port through an independent flow channel.

The present disclosure is directed to an indoor unit of an air conditioner, where humidified air, generated in a steam generator, may flow through an independent flow channel before being discharged to an indoor space.

The present disclosure is directed to an indoor unit of an air conditioner, which may prevent humidified air generated in a steam generator from spreading into a cabinet assembly.

The present disclosure is directed to an indoor unit of an air conditioner, which may branch humidified air, generated in a steam generator, from the steam generator to a plurality of independent flow channels, and then may spray the humidified air from each lateral discharge port of a cabinet assembly.

The present disclosure is directed to an indoor unit of an air conditioner, wherein humidified air discharged to a discharge port may be effectively diffused by discharged air of the discharge port.

The present disclosure is directed to an indoor unit of an air conditioner, which may allow condensate, generated during a flow of humidified air, to return to a steam generator.

The present disclosure is directed to an indoor unit of an air conditioner, which may reduce noise when condensate, generated during a flow of humidified air, returns to a steam generator.

The present disclosure is directed to an indoor unit of an air conditioner, which may supply humidified air to an indoor space regardless of a cooling mode or a heating mode.

Objectives are not limited to the above-described ones, and other objectives that have not been mentioned can be clearly understood by one having ordinary skill in the art to which the present disclosure pertains from the following descriptions.

According to the present disclosure, filtered air may be blown into a steam generator through a humidification fan, humidified air in the steam generator may be discharged to a steam guide, and a sufficient flow may be supplied into the steam generator, thereby making it possible to effectively mix steam with filtered air to generate humidified air.

According to the present disclosure, the humidification fan may blow intake air into the steam generator to allow humidified air to flow, thereby enabling the humidified air to flow to a discharge port although an independent flow channel of the steam guide is long.

According to the present disclosure, generated humidified air may flow to the discharge port through the independent flow channel of the steam guide and then may be discharged from the discharge port, thereby making it possible to prevent the humidified air from spreading in a cabinet assembly and to prevent condensate, caused by the humidified air, from being formed in the cabinet assembly.

According to the present disclosure, an independent flow channel structure capable of supplying filtered air to the steam generator may be disposed, thereby making it possible to minimize contamination in the steam generator.

According to the present disclosure, humidified air generated in the steam generator may flow to the discharge port through the steam guide of the independent flow channel separated from an inner space of the cabinet assembly before being discharged to an indoor space, thereby making it possible to prevent the humidified air from spreading into the inner space.

According to the present disclosure, the humidification fan may be disposed at an upper side of the steam generator, and an air suction port may be disposed at an upper portion of the steam generator, thereby making it possible to minimize a length of a flow channel supplied with filtered air.

According to the present disclosure, the steam guide may be disposed at the upper side of the steam generator, and a steam discharge port may be disposed at the upper portion of the steam generator, thereby making it possible to readily discharge heated steam and humidified air to the steam discharge port on the basis of a density difference of the air.

According to the present disclosure, as the steam discharge port is disposed to face upwards, condensate may return to the steam discharge port on the basis of its self-weight when the condensate is generated during a flow of humidified air.

According to the present disclosure, the indoor unit may include: a cabinet assembly provided with an inner space therein; a discharge port disposed at the cabinet and communicating with the inner space; a suction port disposed at the cabinet and communicating with the inner space; a fan assembly disposed in the inner space and configured to discharge intake air suctioned through the suction port through the discharge port; a steam generator disposed in the inner space and configured to convert water stored therein into steam to generate humidified air; a humidification fan coupled to the steam generator and configured to supply the intake air to the steam generator; and a steam guide connected to the steam generator and supplied with the humidified air, configured to supply a humidification flow channel independent from the inner space and configured to guide steam discharged from the steam generator to the discharge port. As the humidification fan blows the intake air into the steam generator to discharge the humidified air to the steam guide, a sufficient flow may be supplied into the steam generator, and even when the independent flow channel of the steam guide is long, the humidified air may flow to the discharge port.

The humidification fan may include: a humidification fan housing coupled to the steam generator and configured to guide the intake air to the steam generator; a humidification impeller disposed in the humidification fan housing and allowing air in the humidification fan housing to flow to the steam generator; and a humidification motor configured to rotate the humidification impeller, the steam guide, including: a main steam guide coupled to the steam generator and supplied with humidified air of the steam generator. The humidification fan housing and main steam guide may be coupled to an upper side of the steam generator, the intake air may flow from an upper side to a lower side through the humidification fan housing and may flow into the steam generator, and the humidified air may flow from the lower side to the upper side through the main steam guide and may be discharged out of the steam generator, thereby making it possible to minimize pneumatic resistance of the intake air and steam, which is caused by a density difference of air.

The humidification fan housing may be disposed at the suction port side, and the main steam guide is disposed at the discharge port side, thereby making it possible to minimize a length of a flow channel of the intake air and humidified air.

The discharge port may include: a first discharge port formed at the cabinet assembly; and a second discharge port formed at the cabinet assembly, the steam guide, including: a main steam guide disposed in the cabinet assembly, coupled to the steam generator and supplied with the humidified air of the steam generator; a first branch guide coupled to the main steam guide and configured to guide a part of the humidified air, flowing through the main steam guide, to the first discharge port; a second branch guide coupled to the main steam guide and configured to guide the rest of the humidified air, supplied through main steam guide, to the second discharge port; a first diffuser disposed at the first discharge port, assembled to the first branch guide and configured to discharge the humidified air, supplied through the first branch guide, to the first discharge port; and a second diffuser disposed at the second discharge port, assembled to the second branch guide and configured to discharge the humidified air, supplied through the second branch guide, to the second discharge port, thereby making it possible to discharge the humidified air from each discharge port through two flow channels.

The first discharge port may be disposed on a left surface of the cabinet assembly, the second discharge port may be disposed on a right surface of the cabinet assembly, and the suction port may be disposed on a back surface of the cabinet assembly.

The main steam guide may be disposed at an upper side of the steam generator, the first branch guide and the second branch guide may be disposed at an upper side of the main steam guide, the first diffuser may be disposed at an upper side of the first branch guide, and the second diffuser may be disposed at an upper side of the second branch guide, thereby making it possible to minimize energy for allowing humidified air to flow, using ascending air current.

The indoor unit may further include: a first side grille disposed at the first discharge port and configured to guide discharged air discharged by the fan assembly; and a second side grille disposed at the second discharge port and configured to guide discharged air discharged by the fan assembly, and the first diffuser may be disposed at a rear of the first side grille and the second diffuser may be disposed at a rear of the second side grille.

The first diffuser may include a first diffuser outlet through which the humidified air is discharged, the second diffuser may include a second diffuser outlet through which the humidified air is discharged, a direction of discharge of the humidified air discharged from the first diffuser outlet is across a direction of an inclination of a vane disposed at the first side grille, and a direction of discharge of the humidified air discharged from the second diffuser outlet is across a direction of an inclination of a vane disposed at the second side grille, thereby making it possible to effectively mix the humidified air and the discharged air while the humidified air is discharged to an indoor space.

The first diffuser outlet may be disposed towards the first side grille disposed at a front, and the second diffuser outlet may be disposed towards the second side grille disposed at the front.

The indoor unit may further include: a first side grille disposed at the first discharge port and configured to guide air discharged by the fan assembly; and a second side grille disposed at the second discharge port and configured to guide air discharged by the fan assembly, and the first diffuser may be disposed at a front of the first side grille, and the second diffuser may be disposed at a front of the second side grille.

The first diffuser may include a first diffuser outlet through which the humidified air is discharge, the second diffuser may include a second diffuser outlet through which the humidified air is discharged, a direction of discharge of the humidified air discharged from the first diffuser outlet may be across a direction of an inclination of a vane disposed at the first side grille, and a direction of discharge of the humidified air discharged from the second diffuser outlet may be across a direction of an inclination of a vane disposed at the second side grille, thereby making it possible to effectively mix the humidified air and discharged air while the humidified air is discharged to an indoor space.

The first diffuser outlet may be disposed towards a left of the cabinet assembly, a vane disposed at the first side grille may be disposed towards a left of a front of the cabinet assembly, the second diffuser outlet may be disposed towards a right of the cabinet assembly, and a vane disposed at the second side grille may be disposed towards a right of a front of the cabinet assembly.

The first diffuser outlet may be extended and disposed in the up-down direction along a lengthwise direction of the first discharge port, and the second diffuser outlet may be extended and disposed in the up-down direction along a lengthwise direction of the second discharge port, thereby making it possible to discharge humidified air from an entire area of the discharge port that is long in the up-down direction.

The first diffuser may include a first diffuser inlet coupled to the first branch guide, and an inner diameter (P1) of the first diffuser inlet may be smaller than an inner diameter (P2) of the branch guide, thereby making it possible to minimize friction with humidified air using surface tension of condensate and to minimize noise caused by the condensate.

A lower end of the first diffuser inlet may be inserted into the first branch guide, and a step (GP) may be formed between the lower end of the first diffuser inlet and an inner surface of the first branch guide, thereby enabling droplets of condensate to become larger at the step (GP) and making it possible to move the condensate rapidly using self-weight of the larger droplets of condensate.

Advantageous Effects

An indoor unit of an air conditioner according to the present disclosure has one or more advantages that are described hereunder.

First, filtered air may be blown into a steam generator through a humidification fan, humidified air in the steam generator may be discharged to a steam guide, and a sufficient flow may be supplied into the steam generator, thereby making it possible to effectively mix steam and filtered air to generate humidified air.

Second, the humidification fan may blow intake air into the steam generator to allow humidified air to flow, thereby enabling the humidified air to flow to a discharge port although an independent flow channel of the steam guide is long.

Third, generated humidified air may flow to the discharge port through the independent flow channel of the steam guide and then may be discharged from the discharge port, thereby making it possible to prevent the humidified air from spreading in a cabinet assembly and to prevent condensate, caused by the humidified air, from being formed in the cabinet assembly.

Fourth, an independent flow channel structure capable of supplying filtered air to the steam generator may be disposed, thereby making it possible to minimize contamination in the steam generator.

Fifth, humidified air generated in the steam generator may flow to the discharge port through the steam guide of the independent flow channel separated from an inner space of the cabinet assembly before being discharged to an indoor space, thereby making it possible to prevent the humidified air from spreading into the inner space.

Sixth, the humidification fan may be disposed at an upper side of the steam generator, and an air suction port may be disposed at an upper portion of the steam generator, thereby making it possible to minimize a length of a flow channel supplied with filtered air.

Seventh, the steam guide may be disposed at the upper side of the steam generator, and a steam discharge port may be disposed at the upper portion of the steam generator, thereby making it possible to readily discharge heated steam and humidified air to the steam discharge port on the basis of a density difference of the air.

Eighth, as the steam discharge port is disposed to face upwards, condensate may return to the steam discharge port on the basis of its self-weight even when the condensate is generated during a flow of humidified air.

Ninth, a humidification fan housing and a main steam guide may be disposed perpendicularly, thereby making it possible to minimize flow resistance of intake air and steam on the basis of a density difference of the air.

Tenth, the humidification housing may be disposed at the suction port side and the main steam guide may be disposed at the discharge port side, thereby making it possible to minimize a length of a flow channel for intake air and humidified air.

Eleventh, the main steam guide, a branch guide, and a diffuser may be disposed in an up-down direction, thereby making it possible to minimize energy for a flow of humidified air using ascending air current of the humidified air that moves upwards due to its high temperature.

Twelfth, a direction of discharge of humidified air discharged from a first diffuser outlet may be across a direction of an inclination of a vane disposed at a first side grille, and a direction of discharge of humidified air discharged from a second diffuser outlet may be across a direction of an inclination of a vane disposed at a second side grille, thereby making it possible to effectively mix the humidified air and discharged air while the humidified air is discharged to an indoor space.

Thirteenth, an inner diameter (P1) of a first diffuser inlet may be smaller than an inner diameter (P2) of a branch guide, thereby making it possible to minimize friction between condensate and humidified air and to reduce noise caused by the condensate, using surface tension of the condensate.

Fourteenth, a lower end of the first diffuser inlet may be inserted into a first branch guide, and a step (GP) may be formed between the lower end of the first diffuser inlet and an inner surface of the first branch guide, thereby enabling droplets of condensate to become larger at the step (GP) and making it possible to move the condensate rapidly using self-weight of the larger droplets of condensate.

BRIEF DESCRIPTION OF DRAWINGS

FIG. 1 is a perspective view illustrating a first exemplary indoor unit of an air conditioner.

FIG. 2 is an exploded perspective view illustrating the door assembly in FIG. 1.

FIG. 3 is a perspective view illustrating a state where a door assembly is removed from FIG. 1.

FIG. 4 is an exploded perspective view of FIG. 1.

FIG. 5 is a perspective view illustrating the humidification assembly and the water tank in FIG. 5 assembled to a lower cabinet.

FIG. 6 is a rear perspective view illustrating a first exemplary humidification assembly.

FIG. 7 is a front view illustrating an inside of the lower cabinet in FIG. 3.

FIG. 8 is a cross-sectional view illustrating the humidification assembly and the water tank in FIG. 7.

FIG. 9 is a perspective view of FIG. 8.

FIG. 10 is a cross-sectional view illustrating a partially cut humidification fan in FIG. 6.

FIG. 11 is a front view illustrating a pair of diffusers in FIG. 6.

FIG. 12 is a rear view illustrating a pair of diffusers in FIG. 6.

FIG. 13 is a view illustrating an example where the diffuser in FIG. 6 is installed.

FIG. 14 is an enlarged view illustrating the diffuser in FIG. 13.

FIG. 15 is an enlarged view illustrating a structure around the diffuser outlet in FIG. 14.

FIG. 16 is a view illustrating an example of an air stream in a first exemplary diffuser.

FIG. 17 is a cross-sectional view illustrating an upper side of a diffuser outlet of the diffuser housing in FIG. 11.

FIG. 18 is a cross-sectional view illustrating a lower side of a diffuser outlet of the diffuser housing in FIG. 11.

FIG. 19 is a plan view illustrating an exemplary drain assembly.

FIG. 20 is a front cross-sectional view illustrating the drain assembly in FIG. 19.

FIG. 21 is a right-side view illustrating the drain assembly in FIG. 19.

FIG. 22 is an exploded perspective view illustrating the steam generator in FIG. 6.

FIG. 23 is a view illustrating an example of a flow as the time of a first exemplary humidification operation.

FIG. 24 is a view illustrating an example of a flow at the time of a first exemplary steam-sterilization operation.

FIG. 25 is a front view illustrating an indoor unit including with a second exemplary humidification assembly.

FIG. 26 is a flat cross-sectional view of FIG. 25.

FIG. 27 is a cross-sectional perspective view of the diffuser and the side grille in FIG. 26.

FIG. 28 is an exploded perspective view illustrating a third exemplary indoor unit.

DETAILED DESCRIPTION

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, various singular forms "a," "an" and "the" are intended to include various plural forms as well, unless context clearly indicates otherwise. For example, a term "a" or "an" shall mean "one or more," even though a phrase "one or more" is also used herein. Use of the optional plural "(s)," "(es)," or "(ies)" means that one or more of the indicated feature is present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner. Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

FIG. 1 is a perspective view illustrating a first exemplary indoor unit of an air conditioner. FIG. 2 is an exploded perspective view illustrating the door assembly in FIG. 1. FIG. 3 is a perspective view illustrating a state where a door assembly is removed from FIG. 1. FIG. 4 is an exploded perspective view of FIG. 1.

The exemplary air conditioner may include an indoor unit, and an outdoor unit (not illustrated) connected to the indoor unit through a refrigerant pipe and configured to allow refrigerants to circulate.

The outdoor unit may include a compressor (not illustrated) configured to compress refrigerants, an outdoor heat exchanger (not illustrated) configured to receive refrigerants from the compressor and to compress the refrigerants, an outdoor fan (not illustrated) configured to supply air to the outdoor heat exchanger, and an accumulator (not illustrated) configured to receive refrigerants discharged from the indoor unit and then to supply only gaseous refrigerants to the compressor.

The outdoor unit may further include a four-way valve (not illustrated) to operate the indoor unit in a cooling mode or in a heating mode. In the cooling mode, refrigerants are evaporated in the indoor unit to cool air in an indoor space. In the heating mode, refrigerants are condensed in the indoor unit to heat air in an indoor space.

<<Configuration of Indoor Unit>>

The indoor unit may include a cabinet assembly 100, a front surface of which is open and which may be provided with a suction port 101 on a rear surface thereof, a door assembly 200 assembled to the cabinet assembly 100, the door assembly 200 configured to cover the front surface of the cabinet assembly 100 and configured to open and close the front surface of the cabinet assembly 100, a fan assembly 300, 400 disposed in an inner space (S) of the cabinet assembly 100 and configured to discharge air in the inner space (S) to an indoor space, a heat exchange assembly 500 disposed between the fan assembly 300, 400 and the cabinet assembly 100 and allowing heat exchange between suctioned indoor air and refrigerants, a humidification assembly 2000 disposed at the cabinet assembly 100 and configured to supply moisture to the indoor space, a filter assembly 600 disposed at a back surface of the cabinet assembly 100 and configured to filter air flowing to the suction port 101, and a moving cleaner 700 moving in an up-down direction along the filter assembly 600 and configured to separate and collect foreign substances of the filter assembly 600.

The indoor unit may include a suction port 101 disposed on a back surface with respect to the cabinet assembly 100, a first discharge port 301 and a second discharge port 302 disposed on lateral surfaces with respect to the cabinet assembly 100, and a front discharge port 201 disposed on a front surface with respect to the cabinet assembly 100.

The suction port 101 may be disposed on the back surface of the cabinet assembly 100.

The first discharge port 301 and the second discharge port 302 may be disposed respectively on the left and on the right with respect to the cabinet assembly 100. In one embodiment, when seen from the front surface of the cabinet assembly 100, the first discharge port 301 on the left is referred to as a first lateral discharge port 301, and the second discharge port 302 on the right is referred to as a second lateral discharge port 302.

The front discharge port 201 may be disposed at the door assembly 200, and the door assembly 200 may further include a door cover assembly 1200 configured to automatically open and close the front discharge port 201.

The door cover assembly 1200 may open the front discharge port 201 and then may move downwards along the door assembly 200. The door cover assembly 1200 may move in the up-down direction with respect to the door assembly 200.

After the door cover assembly 1200 moves downwards, a long-distance fan assembly 400 may pass through the door assembly 200 to move forwards.

The fan assembly 300, 400 may include a short-distance fan assembly 300 and a long-distance fan assembly 400. The heat exchanger assembly 500 may be disposed at a rear of the short-distance fan assembly 300 and the long-distance fan assembly 400.

The heat exchange assembly 500 may be disposed inside the cabinet assembly 100 and may be disposed in the suction port 101. The heat exchange assembly 500 may cover the suction port 101 and may be disposed perpendicularly.

The short-distance fan assembly 300 and the long-distance fan assembly 400 may be disposed at a front of the heat exchange assembly 500. Air suctioned into the suction port 101 may pass through the heat exchange assembly 500 and then may flow to the short-distance fan assembly 300 and the long-distance fan assembly 400.

The heat exchange assembly 500 may be manufactured to have a length corresponding to a height of the short-distance fan assembly 300 and the long-distance fan assembly 400.

The short-distance fan assembly 300 and the long-distance fan assembly 400 may be stacked in the up-down direction. In one embodiment, the long-distance fan assembly 400 may be disposed at an upper side of the short-distance fan assembly 300. When the long-distance fan assembly 400 is disposed at the upper side of the short-distance fan assembly 300, discharged air may be sent to a far corner of the indoor space.

The short-distance fan assembly 300 may discharge air in a lateral direction with respect to the cabinet assembly 100. The short-distance fan assembly 300 may supply indirect air movement to a user. The short-distance fan assembly 300 may discharge air in leftward and rightward directions of the cabinet assembly 100 at the same time.

The long-distance fan assembly 400 may be disposed at the upper side of the short-distance fan assembly 300, and may be disposed at an upper side in the cabinet assembly 100.

The long-distance fan assembly 400 may discharge air in a forward direction with respect to the cabinet assembly 100. The long-distance fan assembly 400 may supply direct air movement to the user. Additionally, the long-distance fan assembly 400 may discharge air to a far corner of the indoor space to improve air circulation of the indoor space.

In one embodiment, the long-distance fan assembly 400 may be exposed to the user only when operating. When the long-distance fan assembly 400 operates, the long-distance fan assembly 400 may be exposed to the user by passing through the door assembly 200. When the long-distance fan assembly 400 does not operate, the long-distance fan assembly 400 may be hidden in the cabinet assembly 100.

The long-distance fan assembly 400 may control a direction in which air is discharged. The long-distance fan assembly 400 may discharge air upwards, downwards, leftwards, rightwards, or diagonally with respect to the front surface of the cabinet assembly 100.

The door assembly 200 may be disposed at a front of the cabinet assembly 100 and may be assembled to the cabinet assembly 100.

The door assembly 200 may slide in a left-right direction with respect to the cabinet assembly 100, and may expose a part of the front surface of the cabinet assembly 100 outwards.

The door assembly 200 may move in any one of the leftward or rightward direction to open the inner space (S). Additionally, the door assembly 200 may move in any one of the leftward or rightward direction to open only a part of the inner space (S).

In one embodiment, the door assembly 200 may be opened and closed in two stages.

In the first stage opening and closing, the door assembly 200 may be partially opened to supply water to the humidification assembly 2000, and a surface area may be exposed to the extent that a water tank 2100 of the humidification assembly 2000 is exposed.

In the second stage opening and closing, the door assembly 200 may be opened to a maximum level for installation and repairs. To this end, the door assembly 200 may include a door stopper structure to control the second stage opening.

The filter assembly 600 may be disposed on a rear surface of the cabinet assembly 100. The filter assembly 600 may swivel to a lateral portion of the cabinet assembly 100 in a state where the filter assembly 600 is disposed on the rear surface of the cabinet assembly 100. A user may separate only a filter from the filter assembly 600 moved to the lateral portion of the cabinet assembly 100.

In one embodiment, the filter assembly 600 includes two parts, and each part may swivel to the left side or the right side.

The moving cleaner 700 is a device for cleaning the filter assembly 600. The moving cleaner 700 may clean the filter assembly 600 while moving in the up-down direction. The moving cleaner 700 may suction air and may separate foreign substances attached to the filter assembly 600 while moving, and the separated foreign substances may be stored in the moving cleaner 700.

The moving cleaner 700 may be installed as a structure that does not interfere with the filter assembly 600 when the filter assembly 600 swivels.

The humidification assembly 2000 may supply moisture to the inner space (S) of the cabinet assembly 100, and the supplied moisture may be discharged to the indoor space through the short-distance fan assembly. The humidification assembly 2000 may include a detachable water tank 2100.

In one embodiment, the humidification assembly 2000 may be disposed at a lower side in the cabinet assembly 100. A space in which the humidification assembly 2000 is disposed, and a space in which the heat exchange assembly 500 is disposed may be divided.

The humidification assembly 2000 may perform humidification using air filtered and steam sterilized through the filter assembly 600, and by doing so, may prevent harmful substances such as germs or fungi from contacting the water tank.

<<Configuration of Cabinet Assembly>>

The cabinet assembly 100 may include a base 130 mounted onto the ground, a lower cabinet 120 disposed at an upper side of the base 130, having a front surface 121, an upper surface 125, and a lower surface 126 that are open, and having a left surface 123, a right surface 124, and a back surface 122 that are closed, and an upper cabinet 110 disposed at an upper side of the lower cabinet 120, having a back surface 112, provided with a suction port 101, a front surface 111, and a lower surface 116 that are open, and having a left surface 113, a right surface 114, and an upper surface 115 that are closed.

An inside of the upper cabinet 110 is referred to as a first inner space (S1), and an inside the lower cabinet 120 is referred to as a second inner space (S2). The first inner space (S1) and the second inner space (S2) may constitute an inner space (S) of the cabinet assembly 100.

A short-distance fan assembly 300, a long-distance fan assembly 400, and a heat exchange assembly 500 may be disposed inside the upper cabinet 110.

A humidification assembly 2000 may be disposed inside the lower cabinet 120.

A drain pan 140 configured to support the heat exchange assembly 500 may be disposed between the upper cabinet 110 and the lower cabinet 120. In one embodiment, the drain pan 140 may close a part of the lower surface 116 of the upper cabinet 110.

When the cabinet assembly 100 is assembled, the bottom surface 116 of the upper cabinet 110 may be shielded by the humidification assembly 2000 and the drain pan 140, and air in the upper cabinet 110 may be blocked from flowing to the lower cabinet side 120.

The door assembly 200 may be disposed at a front of the cabinet assembly 100, and may slide in a left-right direction with respect to the cabinet assembly 100.

When the door assembly 200 moves, a part of the left or the right of the cabinet assembly 100 may be exposed outwards.

A side grille 150 may be disposed at an edge of a front of the upper cabinet 110. The side grille 150 may be disposed at a rear of the door assembly 200.

The side grille 150 and the upper cabinet 110 may be integrally formed. In one embodiment, the side grille 150 may be separately manufactured through an injection molding process and then may be assembled to the upper cabinet 110.

A discharge grille disposed at a front of the left surface 113 is referred to as a left side grille 151, and a discharge grille disposed at a front of the right surface 114 is referred to as a right side grille 152.

From a top view perspective, the left side grille 151 and the right side grille 152 may be symmetrical in the left-right direction with respect to a central axis (C1).

The left side grille 151 and the right side grille 152 may be respectively provided with lateral discharge ports 301, 302. The lateral discharge ports 301, 302 may be formed by penetrating the left side grille 151 and the right side grille 152 respectively.

For each of the side grilles 151, 152, a plurality of vanes 155 may be disposed in an up-down direction. Each of the vanes 155 may be long and extended in the up-down direction.

The plurality of vanes 155 may be disposed in a front-rear direction at regular intervals. A vane gap (BG) may be respectively formed between the vanes 155.

In one embodiment, a cover 160 may be disposed at a front of the upper cabinet 110 and the lower cabinet 120, and may prevent air in the cabinet 100 from contacting the door assembly 200 directly.

When cold air directly contacts the door assembly 200, condensation may be formed, and may adversely affect an electric circuit within the door assembly 200.

Accordingly, the cover 160 may be disposed at the front of the upper cabinet 110 and at a front of the lower cabinet 120, and may allow air in the cabinet 100 to flow only to a front discharge port 201 or the lateral discharge ports 301, 302.

The cover 160 may include an upper cover 162 configured to cover the front surface of the upper cabinet 110, a lower cover 164 configured to cover the front surface of the lower cabinet 120, and a long-distance fan cover 166 configured to cover a front surface of the long-distance fan assembly 400.

The long-distance fan cover 166 and the upper cover 162 may be integrally formed. In one embodiment, the long-distance fan cover 166 and the upper cover 166 may be separately manufactured and then may be assembled to each other.

The long-distance fan cover 166 may be disposed at a front of the long-distance fan assembly 400, and may be disposed at an upper side of the upper cover 162. Front surfaces of the long-distance fan cover 166 and the upper cover 162 may form a continuous flat surface.

The long-distance fan cover 166 may be provided with a fan cover discharge port 161 that is open in a front-rear direction. The fan cover discharge port 161 may communicate with the front discharge port 201 and may be disposed at a rear of the front discharge port 201. A discharge grille 450 of the long-distance fan assembly 400 may pass through the fan cover discharge port 161 and the front discharge port 201 to move to a front of the door assembly 200.

The door assembly 200 may be disposed at the front of the fan cover discharge port 161, and the fan cover discharge port 161 may be disposed at a rear of a below-described panel discharge port 1101. When the long-distance fan assembly moves forwards, the discharge grille 450 may consecutively pass through the fan cover discharge port 161, the panel discharge port 1101 and the front discharge port 201.

That is, the panel discharge port 1101 may be disposed at the rear of the front discharge port 201, and the fan cover discharge port 161 may be disposed at the rear of panel discharge port 1101.

The long-distance fan cover 166 may be coupled to an upper side of the front of the upper cabinet 110, and the upper cover 162 may be coupled to a lower side of the front of the upper cabinet 110.

The lower cover 164 may be disposed at a lower side of the upper cover 162 and may be assembled to the lower cabinet 120 or the humidification assembly 2000. After the lower cover 164 is assembled, front surfaces of the lower cover 164 and the upper cover 162 may form a continuous surface.

The lower cover 164 may be provided with a water tank opening 167 that is open in the front-rear direction. A water tank 2100 may be separated or installed through the water tank opening 167.

The lower cover 164 may be disposed at a lower side of a front of the drain pan 140. Although a front surface of the lower cabinet 120 is not entirely covered, air in the upper cabinet 110 may not leak. Accordingly, the front surface of the lower cabinet 120 may not be entirely covered.

For repairs, services and replacements of the humidification assembly 2000, a part of the front surface of the lower cabinet 120 may be opened. In one embodiment, a part of the front surface of the lower cabinet 120 may be provided with an open surface 169 that is not shielded by the lower cover 164.

When the door assembly 200 is opened to a first stage, the lower cover 164, where the water tank opening 167 is formed, is only exposed to a user, and when the door assembly 200 is opened to a second stage, the open surface 169 may also be exposed to the user.

The door assembly 200 may slide in the left-right direction as a door slide module 1300 operates. A state in which the water tank opening 167 is entirely exposed as the door assembly 200 slides is referred to as a first stage opening, and a state in which the open surface 169 is exposed is referred to as a second stage opening.

A front surface of the cabinet assembly 100, which is exposed at the time of the first stage opening, is referred to as a first open surface (OP1), and a front surface of the cabinet assembly, which is exposed at the time of the second stage opening, is referred to as a second open surface (OP2).

<<Configuration of Short-Distance Fan Assembly>>

The short-distance fan assembly 300 is a component for discharging air laterally with respect to a cabinet assembly 100. The short-distance fan assembly 300 may supply indirect air movement to a user.

The short-distance fan assembly 300 may be disposed at a front of the heat exchange assembly 500.

For the short-distance fan assembly 300, a plurality of fans 310 may be stacked in an up-down direction. In one embodiment, three fans 310 may be provided and stacked in the up-down direction.

In one embodiment, a mixed-flow centrifugal fan may be used as the fan 310. The fan 310 may suction air in an axial direction and may discharge air in a circumferential direction.

The fan 310 may suction air from a rear thereof and then may discharge the air circumferentially and forwards. The fan 310 may discharge air currents having directionality towards a front, while discharging air circumferentially.

The short-distance fan assembly 300 may have an open front and an open rear, and may include a fan casing 320 coupled to the cabinet assembly 100, a plurality of fans 310 coupled to the fan casing 320 and disposed in the fan casing 320, and a fan guide 330 coupled to the fan casing 320 and configured to guide air, discharged from the fan 310, laterally with respect to the cabinet assembly 100.

The fan casing 320 may be formed into a box shape with an open front surface and an open rear surface. The fan casing 320 may be coupled to the cabinet assembly 100.

The front surface of the fan casing 320 may be disposed to face a door assembly 200, and the rear surface of the fan casing 320 may be disposed to face a heat exchanger assembly 500.

The front surface of the fan casing 320 may be closed by closely contacting the door assembly 200.

In one embodiment, a part of a lateral surface of the fan casing 320 may be exposed outwards. Lateral discharge ports 301, 302 may be formed at the part of the fan casing 320, which is exposed outwards. Side grilles 151, 152, capable of controlling a direction of discharge of air, may be disposed at the lateral discharge ports 301, 302. The lateral discharge ports 301, 302 may be disposed respectively on a left and right of the fan casing 320.

The fan 310 may be disposed in the fan casing 320. The plurality of fans 310 may be disposed on the same flat surface, and may be stacked in line with respect to the up-down direction.

As a centrifugal fan is used as the fan 310, the fan 310 may suction air from the rear surface of the fan casing 320 and then may discharge the air circumferentially.

The fan guide 330 may guide the air, discharged from the fan 310, to the lateral discharge ports 301, 302. As a centrifugal fan is used as the fan 310, air discharged to an upper side and a lower side may be guided to the lateral discharge ports 301, 302 by the fan guide 330.

<Configuration of Fan>

The fan 310 may include a hub 312, a center of which is coupled to a rotational shaft 133, a shroud 314 spaced apart from the hub 312 and provided with a suction port 311, through which air is suctioned, at a central portion thereof, and a plurality of blades 316 disposed between the hub 312 and the shroud 314.

The plurality of blades 316 may be provided between the hub 312 and the shroud 314. A front end of the blade 316 may be coupled to a rear surface of the hub 312, and a rear end of the blade 316 may be coupled to a front surface of the shroud 314. The plurality of blades 316 may be spaced apart from each other circumferentially. A cross section of the blade 316 may be formed into an airfoil shape, for example.

In terms of the blade 316, a lateral end into which air is suctioned is referred to as a leading edge 316*a*, and a lateral end from which air is discharged is referred to as a trailing edge 316*b*.

The trailing edge 316*b* of the blade 316 may be formed to incline with respect to a front-rear direction such that discharged air faces a front at a slant in a radial direction. The leading edge 316*a* of the blade 316 may be shorter than the trailing edge 316*b*-2 of the blade 316 such that the discharged air faces the front at a slant in the radial direction.

The hub 312 may be formed into a circular cone which protrudes downwards further towards the center thereof. A rear of a motor cover 318 may be inserted into a front of the hub 312, and at least part of a fan motor 340 may be disposed in the hub 312. With the structure, thicknesses of the fan motor 340 and the fan 310 in the front-rear direction may be minimized.

The rotational shaft 313 of the fan motor 340 disposed at an upper side of the hub 312 may be coupled to the center of the hub 312. The hub 312 may be disposed at a front of the shroud 314, and the hub 312 and the shroud 314 may be spaced apart from each other. The plurality of blades 316 may be coupled to a back surface of the hub 312.

From a top view perspective, the rotational shaft 313 may be disposed at a center between a left and right of a cabinet assembly 100, for example. From a top view perspective, the rotational shaft 313 may be disposed on a central axis (C1) line that passes through a center of a front discharge port in the front-rear direction.

An outer circumferential end of the hub 312 may be formed to face and incline in a direction opposite to a direction of the suction port 311. The outer circumferential end of the hub 312 may denote a circumference of a front end of the hub 312. The direction (A) faced by the outer circumferential end of the hub 312 may be at about 45 degrees from a left-right direction, for example. The outer circumferential end of the hub 312 may be formed to incline forwards such that air is discharged forwards at a slant.

For the hub 312, a flat cross section may be formed into a straight line (Ah) that inclines in a direction opposite to the direction of the suction port 311 from a central portion to the outer circumferential end of the hub 312. For example, for the hub 312, a longitudinal cross section may be formed into a straight line (Ah) which inclines from a portion, where the leading edges 316*a* of the plurality of blades 316 are connected, to the outer circumferential end. For the hub 312, a diameter may be formed to increase on a regular basis from the central portion to the outer circumferential end. For example, for the hub 312, the diameter may increase on a regular basis from the portion, where the leading edges 316*a* of the plurality of blades 316 are connected, to the outer circumferential end.

The shroud 314 may be formed into a bowl provided with a circular suction port 311 through which air is suctioned, at a central portion thereof. The suction port 311 of the shroud 314 may be disposed towards the suction port 101 of the cabinet assembly 100.

That is, an inlet 322 of a fan casing 320 may be formed at a position corresponding to a position of the suction port 311 of the shroud 314. For example, a diameter of the suction port 311 may be larger than a diameter of the inlet 322 of the fan casing 320. The suction port 311 of the shroud 314 may be provided with a suction guide 314*a* protruding rearwards perpendicularly and may be formed around thereof.

The shroud 314 may be spaced apart from the hub 312 at a rear of the hub 312. A plurality of blades 316 may be coupled to a front surface of the shroud 314.

An outer circumferential end of the shroud 314 may be formed to face and incline in a direction opposite to the direction of the suction port 311. The outer circumferential end of the shroud 314 may denote a circumference of a front end of the shroud 314. The direction (Sh) faced by the outer circumferential end of the shroud 314 may be at about 45 degrees from a horizontal direction. The outer circumferential end of the shroud 314 may be formed to incline forwards such that air is discharged forwards at a slant. The direction faced by the outer circumferential end of the shroud 314 may be substantially in parallel with the direction faced by the outer circumferential end of the hub 312, for example.

For the shroud 314, a longitudinal cross section may be formed into a straight line (Ch) that inclines in a direction opposite to the direction of the suction port 311 from an upper end of the suction guide 314*a* to the outer circumferential end of the shroud 314. For example, for the shroud 314, a longitudinal cross section may be formed into a straight line (Ch) which inclines from a portion, where leading edges 24*b*-1 of the plurality of blades 316 are connected to the outer circumferential end. For the shroud 314, a diameter from the upper end of the suction guide 314*a* to the outer circumferential end may be formed to increase on a regular basis. For example, for the shroud 314, the diameter may increase on a regular basis from the portion where the leading edges 24*b*-1 of the plurality of blades 316 are connected, to the outer circumferential end.

For example, the direction (Sh) faced by the outer circumferential end of the shroud 314 may be substantially in parallel with the direction (A) faced by the outer circumferential end of the hub 312. The inclined straight line (Ch) portion of the longitudinal cross section of the shroud 314 may be substantially in parallel with the inclined straight line (Ah) portion of the longitudinal cross section of the hub 312, for example.

In one embodiment, a gap between the shroud 314 and the hub 312 may be gradually widened towards the outer circumferential ends thereof.

<<Configuration of Long-Distance Fan Assembly>>

The long-distance fan assembly 400 is a component for discharging air forwards with respect to the cabinet assembly 100. The long-distance fan assembly 400 may supply direct air movement to a user.

The long-distance fan assembly 400 may be disposed at a front of the heat exchange assembly 500. The long-distance fan assembly 400 may be stacked at an upper side of the short-distance fan assembly 300.

The long-distance fan assembly 400 may discharge air through a front discharge port 201 formed at the door assembly 200. The long-distance fan assembly 400 may provide a structure that may rotate upwards, downwards, leftwards, rightwards, or diagonally. The long-distance fan assembly 400 may discharge air to a far corner of an indoor space to improve air circulation in the indoor space.

The long-distance fan assembly 400 may further include a tilt assembly that allows a discharge grille 450 to make relative movements freely in all directions including an upper side, a lower side, a leftward side, a rightward side, an orthogonal direction and the like with respect to a fan housing assembly.

<<<Configuration of Door Assembly>>>

The door assembly 200 may include a front panel 210 where a front discharge port 201 is formed, a panel module 1100 coupled to a back surface of the front panel 210 and provided with a panel discharge port 1101 communicating with the front discharge port 201, a door cover assembly 1200 disposed at the panel module 1100 and configured to open and close the panel discharge port 1101 and the front discharge port 201, a door slide module 1300 disposed at the panel module 1100 and configured to move the panel module 1100 in a left-right direction with respect to a cabinet assembly 100, a camera module 1900 disposed at an upper side of the panel module 1100 and configured to capture an image of an indoor space, and a cable guide 1800, an upper end of which is assembled to the door cover assembly 1200 to move relative to the door cover assembly 1200, a lower end of which is assembled to the panel module assembly 1100 to move relative to the panel module assembly 1100, and in which a cable connected to the door cover assembly 1200 is stored.

The door assembly 200 may move in the left-right direction with respect to the cabinet assembly.

The front discharge port 201 may be disposed on the front panel 210, and may be open in a front-rear direction. The panel discharge port 1101 may be disposed at the panel module 1100 and may be open in the front-rear direction.

Surface areas and shapes of the front discharge port 201 and the panel discharge port 1101 may be the same, and the front discharge port 201 may be disposed further forwards than the panel discharge port 1101.

The door assembly 200 may further include a display module 1500 installed at the panel module 1100 and configured to provide information of an indoor unit to the front panel 210 visually.

The display module 1500 may be disposed on a back surface of the front panel 1100 and may provide visual information to a user through the front panel 1100.

The display module 1500 may be partially exposed by passing through the front panel 1100 and may provide the visual information to the user through an exposed display.

In one embodiment, information of the display module 1550 may be delivered to a user through a display opening 202 formed on the front panel 210.

<<Configuration of Front Panel>>

The front panel 210 may be disposed on a front surface of an indoor unit. The front panel 210 may include a front panel body 212, a front discharge port 201 which is open in a front-rear direction of the front panel body 212, a display opening 202 which is open in the front-rear direction of the front panel body 212, a first front panel side 214 disposed on a left of the front panel body 212 and configured to cover a left surface of a panel module 1100, and a second front panel side 216 disposed on a right of the front panel body 212 and configured to cover a right surface of the panel module 1100.

For the front panel 210, a length in an up-down direction may be larger than a width in a left-right direction. In one embodiment, the length of the front panel 210 in the up-down direction may be three or more times larger than the width in a left-right direction of the front panel 210. For the front panel 210, a thickness in the front-rear direction may be much smaller than the width in the left-right direction. In one embodiment, the thickness of the front panel 210 in the front-rear direction may be smaller than the width of the front panel 210 in the left-right direction by one fourth or less.

In one embodiment, the display opening 202 may be disposed at a lower side of the front discharge port 201. In another embodiment, the display opening 202 may be disposed at an upper side of the front discharge port 201.

The front discharge port 201 and the display opening 202 may be arranged in the up-down direction. A virtual central axis (C1) connecting a center of the front discharge port 201 and a center of the display opening 202 may be perpendicularly disposed. A left and right of the front panel 210 may be symmetrical with respect to the central axis (C1).

A camera 1950 of the camera module 1900 may be disposed on the central axis (C1).

The front discharge port 201 may be formed into a circular shape. The shape of the front discharge port 201 may correspond to a shape of a front surface of a steering grille 3450. The steering grille 3450, hidden in a cabinet assembly 100, may be exposed outwards through the front discharge port 201.

In one embodiment, the steering grille 3450 may be exposed outwards as the front discharge port 201 is optionally opened, and may pass through the front discharge port 201 to protrude further forwards than the front panel 210.

When the steering grille 3450 protrudes further forwards than the front panel 210, interference between air passing through the steering grille 3450 and the front panel 210 may be minimized, and discharged air may flow farther away.

The first front panel side 214 may protrude from a left edge of the front panel body 212 to a rear, and may cover the left surface of the panel module 1100 fixed onto a back surface of the front panel body 212.

The second front panel side 216 may protrude from a right edge of the front panel body 212 to the rear, and may cover a right surface of the panel module 1100 fixed onto the back surface of the front panel body 212.

The first front panel side 214 and the second front panel side 216 may prevent lateral surfaces of the panel module 1100 from being exposed outwards.

Additionally, a first front panel end 215 protruding from an end of a rear of the first front panel side 214 towards the second front panel side 216 may be further disposed. A second front panel end 217 protruding from an end of a rear of the second front panel side 216 towards the first front panel side 214 may be further disposed.

The first front panel end 215 and the second front panel end 217 may be disposed on a back surface of the panel module 1100. That is, the panel module 1100 may be disposed between the front panel body 212 and the front panel end 215, 217.

In one embodiment, a gap between the front panel body 212 and the front panel end 215, 217 is defined as an inner gap (I) of the front panel. The inner gap (I) may be smaller than the thickness of the front panel 210 in the front-rear direction.

The first front panel end 215 and the second front panel end 217 may be disposed to face each other and may be spaced apart from each other. In one embodiment, a gap between the first front panel end 215 and the second front panel end 217 is defined as an open gap (D) of the front panel. The open gap (D) of the front panel 210 may be smaller than the width (W) of the front panel 210 in the left-right direction.

In one embodiment, the front panel body 212 and the front panel end 215, 217 may be disposed in parallel. The front panel body 212 and the front panel side 214, 216 may be crossed, and in one embodiment, may be orthogonally disposed. The front panel side 214, 216 may be disposed in the front-rear direction.

In one embodiment, the front panel body 212, the front panel side 214, 216 and the front panel end 215, 217 constituting the front panel 210 may be integrally manufactured.

In one embodiment, the entire front panel 210 may be made of a metallic material. Specifically, the entire front panel 210 may be made of aluminum.

Accordingly, the front panel side 214, 216 may be bent from the front panel body 212 to a rear, and the front panel end 215, 217 may be bent from the front panel side 214, 216 to an opposite side.

In order for the front panel 210, entirely made of a metallic material, to be easily bent, a first bent groove (not illustrated) may be formed at a bent portion between the front panel body 212 and the first front panel side 214, and a second bent groove 213*a* may be formed at a bent portion between the front panel body 212 and the second front panel side 216.

Additionally, a third bent groove (not illustrated) may be formed at a bent portion between the first front panel side 214 and the first front panel end 215, and a fourth bent groove 213*b* may be formed at a bent portion between the second front panel side 216 and the second front panel end 217.

Each of the bent grooves may be extended vertically in a lengthwise direction of the front panel 210. For example, each bent groove may be disposed inside the bent portions. In case the first and second bent grooves 213*a* are not formed, an angle between the front panel body 212 and the front panel side may not be a right angle. Further, in case the first and second bent grooves 213*a* are not formed, the bent portion between the front panel body 212 and the front panel side may not be flat, and during a bending process, may protrude or may be deformed in any other direction. The third and fourth bent grooves 213*b* may perform the same function as the first and second bent grooves 213*a*.

A panel upper opening 203 and a panel lower opening 204 may be respectively formed at an upper side of the front panel 210 that is manufactured as described above. In one embodiment, a single metallic plate may be bent to manufacture the front panel 210. Accordingly, the panel upper opening 203 and the panel lower opening 204 may have the same surface area and shape.

A thickness of the panel module 1100 may be the same as or smaller than the gap between the front panel body 212 and the front panel end 215, 217. The panel module 1100 may be inserted through the panel upper opening 203 or the panel lower opening 204. The panel module 1100 may be fixed by a coupling member (not illustrated) that passes through the front panel end 215, 217.

The camera module 1900 may be inserted into the panel upper opening 203 and may be disposed at an upper side of the panel module 1100. The camera module 1900 may close the panel upper opening 203.

The camera module 1900 may be disposed at the upper side of the front discharge port 201 and may be disposed at a back surface of the front panel 210. The camera module 1900 may be hidden by the front panel 210. The camera module 1900 may be exposed to the upper side of the front panel 210 only when the camera module 1900 operates, and may be hidden behind the front panel 210 when the camera module 1900 does not operate.

The front panel end 215, 217 may surround lateral surfaces and a back surface of the camera module 1900, and the coupling member (not illustrated) may pass through the front panel end 215, 217 and then may be coupled to the camera module 1900.

In one embodiment, a width of the panel upper opening 203 in the left-right direction and a width of the camera module 1900 in the left-right direction may be the same. Further, in one embodiment, the width of the panel upper opening 203 in the left-right direction and a width of the panel module 1100 in the left-right direction may be the same.

In one embodiment, a thickness of the panel upper opening 203 in the front-rear direction and a thickness of the camera module 1900 in the front-rear direction may be the same. Further, in one embodiment, the thickness of the panel upper opening 203 in the front-rear direction and the thickness of the panel module 1100 in the front-rear direction may be the same.

Accordingly, the camera module 1900 and the panel module 1100 may be disposed between the front panel body 212 and the front panel end 215, 217 and may be supported by the front panel body and the front panel end 215, 217.

FIG. 5 is a perspective view illustrating the humidification assembly and the water tank in FIG. 5 assembled to a lower cabinet. FIG. 6 is a rear perspective view illustrating a first exemplary humidification assembly. FIG. 7 is a front view illustrating an inside of the lower cabinet in FIG. 3. FIG. 8 is a cross-sectional view illustrating the humidification assembly and the water tank in FIG. 7. FIG. 9 is a perspective view of FIG. 8. FIG. 10 is a cross-sectional view illustrating a partially cut humidification fan in FIG. 6. FIG. 11 is a front view illustrating a pair of diffusers in FIG. 6. FIG. 12 is a rear view illustrating a pair of diffusers in FIG. 6. FIG. 13 is a view illustrating an example where the diffuser in FIG. 6 is installed. FIG. 14 is an enlarged view illustrating the diffuser in FIG. 13. FIG. 15 is an enlarged view illustrating a structure around the diffuser outlet in FIG. 14. FIG. 16 is a view illustrating an example of an air stream in a first exemplary diffuser. FIG. 17 is a cross-sectional view illustrating an upper side of a diffuser outlet of the diffuser housing in FIG. 11. FIG. 18 is a cross-sectional view illustrating a lower side of a diffuser outlet of the diffuser housing in FIG. 11.

<<<Configuration of Humidification Assembly>>>

The humidification assembly 2000 may supply moisture into a discharge flow channel of a fan assembly 300, 400, and the supplied moisture may be discharged to an indoor space. The humidification assembly 2000 may optionally operate according to an operation signal of a controller.

In one embodiment, moisture supplied by the humidification assembly 2000 may be directly supplied to lateral discharge ports 301, 302. The moisture supplied by the humidification assembly 2000 may be mist or steam. In one embodiment, the humidification assembly 2000 may convert water of a water tank 2100 into steam to supply the steam to the discharge flow channel.

In one embodiment, the humidification assembly 2000 may be disposed at a lower side of cabinet assembly 100, and specifically, may be disposed in a lower cabinet 120.

The humidification assembly 2000 may be installed at a base 130 and may be surrounded by the lower cabinet 120. A drain pan 140 may be disposed at an upper side of the humidification assembly 2000, and steam generated in the humidification assembly 2000 may directly flow to the lateral discharge ports 301, 302 through a steam guide 2400. That is, a space, in which the humidification assembly 2000 is disposed, and a space in an upper cabinet 110 are divided.

The humidification assembly 2000 may include a water tank 2100 disposed at the cabinet assembly 100 and configured to store water, a steam generator 2300 disposed at the cabinet assembly 100, supplied with water stored in the water tank 2100, and configured to convert water stored therein into steam and to generate humidified air, a humidification fan 2500 disposed at the cabinet assembly 100, coupled to the steam generator 2300 and configured to supply air, passing through a filter assembly 600, to the steam generator 2300, a steam guide 2400 disposed at the cabinet assembly 100 and configured to guide humidified air, generated in the steam generator 2300, to the lateral discharge ports 301, 302 of the cabinet assembly 100 through an independent flow channel, a water supply assembly 2200 disposed at the cabinet assembly 100, detachably holding the water tank 2100 and configured to supply water of the water tank 2100 to the steam generator 2300, a tilt assembly disposed at the cabinet assembly 100 or the water supply assembly 2200, configured to optionally tilt the water tank 2100 forwards according to an electric signal, and configured to return the water tank tilted forwards to an initial position, and a drain assembly 2700 connected to the water supply assembly 2200 and the steam generator 2300 and configured to drain water of the water supply assembly 2200 and the steam generator 2300 outwards.

FIG. 19 is a plan view illustrating an exemplary drain assembly. FIG. 20 is a front cross-sectional view illustrating the drain assembly in FIG. 19. FIG. 21 is a right-side view illustrating the drain assembly in FIG. 19.

<<Configuration of Steam Generator>>

The steam generator 2300 may be supplied with water from a water supply assembly 2200 to generate steam. As the steam generator 2300 heats water to generate steam, sterilized steam may be provided.

The steam generator 2300 may include a steam housing 2310, a steam heater 2320 disposed in the steam housing 2310 and configured to generate heat using supplied power, a water pipe 2314 which may be disposed in the steam housing 2310, which communicates with an inside of the steam housing 2310 and where water is suctioned or discharged, a steam discharge part 2316 disposed in the steam housing 2310, connected to a steam guide 2400 and configured to supply steam generated therein to the steam guide 2400, and an air suction part 2318 disposed in the steam housing 2310, connected to a humidification fan 2500 and supplied with filtered air in a cabinet assembly 100 from the humidification fan 2500.

The steam generator 2300 may further include a first water level sensor 2360 configured to sense a lowest water level (WL) in the steam housing 2310, a second water level sensor 2370 configured to sense a highest water level (WH) in the steam housing 2310, and a thermistor 2380 configured to prevent overheating in the steam housing 2310.

The steam housing 2310 may be a structure sealed from the outside. The water pipe 2314, the steam discharge part 2316, and the air suction part 2318 may communicate with the outside. The steam housing 2310 may be installed at a base 130.

As the steam housing 2310 may store water heated by the steam heater 2320, the steam housing 2310 may be made of a heat resistant material. In one embodiment, the steam housing 2310 may be made of SPS. The steam housing 2310 may include an upper steam housing 2340 and a lower steam housing 2350.

The upper steam housing 2340 may have an open lower side and may be concave from the lower side to an upper side. The lower steam housing 2350 may have an open upper side and may be concave from the lower side to the lower side.

In one embodiment, the water pipe 2314 may be disposed in the lower steam housing 2350, and the steam discharge part 2316 and the air suction part 2318 may be disposed in the upper steam housing 2340.

The water pipe 2314 may be disposed lower than a chamber housing pipe 2214 of the water supply assembly 2200. Water in the chamber housing pipe 2214 may flow to the water pipe 2314 using its self-weight because of a difference between heights at which the water pipe 2314 and the chamber housing pipe 2214 are disposed.

In one embodiment, the first water level sensor 2360, the second water level sensor 2370, and a thermistor 2380 may be disposed in the upper steam housing 2340. To this end, a first water level sensor installation part 2342 where the first water level sensor 2360 is installed, a second water level sensor installation part 2344 where the second water level sensor 2370 is installed, and a thermistor installation part 2346 where the thermistor 2380 is installed may be formed, in the upper steam housing 2340.

The air suction part 2318 and the steam discharge part 2316 formed in the upper steam housing 2340 may have different heights. There is a difference (SH) between the heights of the steam discharge part 2316 and the air suction part 2318. The steam discharge part 2316 may be disposed higher than the air suction part 2318 by the difference (SH) in their heights.

Accordingly, steam in the upper steam housing 2340 may be readily collected to the steam discharge part 2316. When the steam discharge part 2316 is disposed higher than the air suction part 2318, steam having low density may be collected to a lower side of the steam discharge part 2316.

In one embodiment, as the first water level sensor 2360 senses a low water level of the steam generator 2300, the first water level sensor 2360 may be disposed around the air suction part 2318. As the second water level sensor 2370 senses a high water level of the steam generator 2300, the second water level sensor 2370 may be disposed around the steam discharge part 2316.

The difference in heights of the first water level sensor 2360 and the second water level sensor 2370 may result in a minimum length of an electrode of the first water level sensor 2360 and the second water level sensor 2370.

The first water level sensor 2360 may include a 1-1 water level sensing part 2361 and a 1-2 water level sensing part 2362. Lower ends of the 1-1 water level sensing part 2361 and the 1-2 water level sensing part 2362 may be disposed at the same height. In one embodiment, the 1-1 water level sensing part 2361 and the 1-2 water level sensing part 2362 are electrodes. When the 1-1 water level sensing part 2361 and the 1-2 water level sensing part 2362 touches water, a controller may sense that the 1-1 water level sensing part 2361 and the 1-2 water level sensing part 2362 touches the water.

In one embodiment, the lower ends of the 1-1 water level sensing part 2361 and the 1-2 water level sensing part 2362 may denote a lowest water level (WL) for operating the steam generator 2300. When a water level is below the lower ends 2361*a*, 2362*a* of the 1-1 water level sensing part 2361 and the 1-2 water level sensing part 2362, damage may be done to a steam heater 2320. Accordingly, when a water level is below the lower ends 2361*a*, 2362*a* of the 1-1 water level sensing part 2361 and the 1-2 water level sensing part 2362, power supplied to the steam heater 2320 may be cut off.

In one embodiment, an electrode may be used to sense that the second water level sensor 2370 touches water. The lower end 2370*a* of the second water level sensor 2370 may sense a highest water level (WH) of the steam generator 2300. When a water level of the steam generator 2300 is above the lower end 2370*a* of the second water level sensor 2370, water may boil and run off due to operation of the steam heater 2320. When the water level reaches the lower end 2370*a* of the second water level sensor 2370, the steam heater 2320 may stop operating.

The highest water level (WH) is determined considering a tilt of an indoor unit. That is, when the indoor unit tilts to one side, a water level of any one side of the steam housing 2310 may be high. In one embodiment, when the indoor unit tilts to any one side at an angle of 3 degrees and the steam generator 2300 operates at a maximum level, a height at which water does not run off the steam housing 2310 may be set to the highest water level (WH).

When the water level reaches the highest one (WH), the steam heater 2320 may stop operating and a drain assembly 2700 may operate, to drain water in the steam housing 2310.

In one embodiment, a normal water-feed level of the steam generator 2300 has to be lower than the lower end 2370*a* of the second water level sensor 2370, and has to be higher than the lower ends 2361*a*, 2362*a* of the 1-1 water level sensing part 2361 and the 1-2 water level sensing part 2362.

A lower end 2380*a* of the thermistor 2380 may be disposed within the normal water-feed level. The thermistor 2380 may sense that a temperature in the steam generator 2300 rises to a set value or above, and may stop operation of the steam heater 2320.

A larger surface area of the air suction part 2318 may be advantageous. In one embodiment, the air suction part 2318 may be wider than the steam discharge part 2316.

The water pipe 2314 may communicate with an inside of the steam housing 2310. Water in the water supply assembly 2200 may be supplied through the water pipe 2314. Additionally, water discharged from the steam housing 2310 through the water pipe 2314 may flow to the drain assembly 2700.

The steam generator 2300 according to one embodiment is characterized in that a single water pipe 2314 is used for supply and drainage of water. In general, a device for generating steam is provided with a pipe for receiving water along with a pipe for draining water.

The water pipe 2314 may be disposed horizontally. The water pipe 2314 may allow an inside of the lower steam housing 2350 to communicate with an outside of the lower steam housing 2350. The water pipe 2314 may protrude from the lower steam housing 2350 towards the water supply assembly 2300. An outer end of the water pipe 2314 may protrude further laterally than a lateral surface of the lower steam housing 2350.

The water pipe 2314 may connect with the chamber housing pipe 2214 and may be disposed in a left-right direction. In one embodiment, the water pipe 2314 may have a pipe shape an inside of which is hollow.

The water pipe 2314 may be disposed at the rear in the front-rear direction of the steam housing 2310. For example, the water pipe 2314 may be disposed near the drain assembly. The water pipe 2314 may effectively prevent an increase in temperatures of the drain assembly 2700.

The steam heater 2320 may be disposed at the lower steam housing 2350. A steam heater installation part 2352, where the steam heater 2320 is installed, may be disposed at a back surface of the lower steam housing 2350. In one embodiment, the steam heater installation part 2352 may include an open surface passing through the lower steam housing 2350. The steam heater 2320 may pass through the steam heater installation part 2352, and a heater part may be disposed in the lower steam housing 2350.

The steam heater 2320 may include a first heater part 2321 and a second heater part 2322 that are disposed in parallel, a heater mount 2354 to which the first heater part 2321 and the second heater part 2322 are coupled, which is coupled to the steam heater installation part 2352 and which supplies power respectively to the first heater part 2321 and the second heater part 2322, and a fuse (not illustrated) which cuts off power supplied to the first heater part 2321 and the second heater part 2322.

In one embodiment, a sheath heater may be used as the first heater part 2321 and the second heater part 2322.

The first heater part 2321 and the second heater part 2322 may operate independently. For example, power may be supplied only to the first heater part 2321 to generate heat, or power may be supplied only to the second heater part 2322 to generate heat, or power may be supply to both the first heater part 2321 and the second heater part 2322 to generate heat.

The first heater part 2321 and the second heater part 2322 may all have a "U" shape.

A curved portion of each of the first heater part 2321 and the second heater part 2322 may be disposed at the steam discharge part side 2316. The first heater part 2321 and the second heater part 2322 may be disposed on the same flat surface. Upper ends 2321*a*, 2322*a* of the first heater part 2321 and the second heater part 2322 may be disposed at a height the same as or lower than a lowest water level (WL).

In one embodiment, considering an inclination of an indoor unit, the upper ends 2321*a*, 2322*a* of the first heater part 2321 and the second heater part 2322 may be disposed lower than the lowest water level (WL).

The base 130 of the indoor unit has to be installed in parallel with the ground. However, due to an installation error, the base 130 may tilt in at least one of the front, rear, leftward, and rightward directions. Even when the indoor unit tilts to any one side, the upper ends 2321*a*, 2322*a* of the first heater part 2321 and the second heater part 2322 may not be exposed to the water surface, for example.

To this end, a safe water level (WS) may be formed between the upper surface 2321*a* of the first heater part 2321 and the lowest water level (WL). The safe water level (WS) may be formed between the upper surface 2322*a* of the second heater part 2322 and the lowest water level (WL).

Accordingly, the upper surface 2321*a* of the first heater part 2321 and the upper surface 2322*a* of the second heater part 2322 may be disposed at a position lower than the lowest water level (WL) by the safe water level (WS). In one embodiment, the safe water level (WS) may be set to 6 mm.

Heat generation capacity of the first heater part 2321 and the second heater part 2322 may differ. The first heater part 2321 may have a shorter length than the second heater part 2322. The first heater part 2321 may be disposed inside the second heater part 2322.

In one embodiment, capacity of the first heater part 2321 may be 440 W, and capacity of the second heater part 2322 may be 560 W. When the first heater part 2321 and the second heater part 2322 operate together, the first heater part 2321 and the second heater part 2322 may provide a maximum output of 1 kW.

The first heater part 2321 may operate at the time of humidification operation. When a humidification assembly 2000 is steam-sterilized, the first heater part 2321 and the second heater part 2322 may operate at the same time When the steam generator 2300 operates normally, a temperature in the steam housing 2310 may be limited to 105° C. or so. When the steam generator 2300 is heated, stored water boils and produces bubbles. The second water level sensor 2370 may sense the bubbles and may prevent the steam generator 2300 from overheating. When the steam generator 2300 overheats, the second water level sensor 2370 may operate at 140° C. or so.

When the second water level sensor 2370 does not sense the overheating, the thermistor 2380 may sense that the steam generator 2300 overheats. The thermistor 2380 may sense a range of temperatures between 150 and 180° C. or so. In one embodiment, the thermistor 2380 may sense a temperature of 167° C. or higher.

When the temperature (in one embodiment, 250° C.) in the steam housing 2310 rises even after power is controlled by the thermistor 2380, the fuse may cut off the power of the steam heater 2320.

The heater mount 2354 may pass through the steam heater installation part 2352 and may be coupled to the lower steam housing 2350. The heater mount 2354 may seal the steam heater installation part side 2352. An airtight gasket (not illustrated) may be disposed between the heater mount 2354 and the steam heater installation part 2352. The water pipe 2314 may be disposed near the heater mount 2354.

Water in a supply chamber 2211 may be suctioned to the water pipe 2314 using its self-weight. To this end, the water pipe 2314 may be disposed lower than the chamber housing pipe 2214. The water pipe 2314 may be disposed at a height the same as or lower than an outer end 2214*b* of the chamber housing pipe 2214.

The water pipe 2314 may be connected to a lowermost side of the lower steam housing 2350. Accordingly, water may be prevented from being collected in the steam housing 2310 when the water stored in the steam housing 2310 is drained. A groove or a slope for allowing water to flow to the water pipe 2314 may be formed on a bottom surface in the lower steam housing 2350.

In one embodiment, an additional valve is not disposed at the water pipe 2314.

As the water pipe 2314 communicates with the chamber housing pipe 2214, a water level of the supply chamber 2211 and a water level of the steam housing 2310 may be configured to be the same.

For example, when a sufficient amount of water is supplied into the steam housing 2310, the water level of the supply chamber 2211 and the water level of the steam housing 2310 may be the same, and a supply floater 2220 of the water supply assembly 2200 may rise depending on a rising water level and may close a middle hole 2258 to which water is supplied.

In one embodiment, the chamber housing pipe 2214 may be disposed within a height of the steam heater 2320. The outer end 2214*b* of the chamber housing pipe 2214 may be disposed lower than the highest water level (WH) of the steam generator 2300.

The highest water level (WH) of the steam generator 2300 may be disposed lower than a valve hole 2111. The middle hole 2258 may be disposed at a height the same as or higher than the highest water level (WH) of the steam generator 2300. In one embodiment, the middle hole 2258 may be spaced a distance (H) apart from the upper end 2321*a*, 2322*a* of the steam heater 2320.

In one embodiment, as a floater valve stopper 2278 disposed at the supply floater 2220 protrudes further upwards than a floater body 2222, a height, at which the floater body 2222 rises to a maximum level, may be the same as or lower than the highest water level (WH).

When the supply floater 2220 rises to the maximum height, the middle hole 2258 may be closed, and water supplied to the steam generator 2300 may be cut off.

The steam discharge part 2316 may communicate with an inside of the upper steam housing 2340. The steam discharge part 2316 may pass through the upper steam housing 2340 in an up-down direction. The steam discharge part 2316 may protrude upwards from an upper surface of the upper steam housing 2340 for a connection with the steam guide 2400.

The air suction part 2318 may be disposed in the steam housing 2310, and specifically, may be disposed in the upper steam housing 2340. The air suction part 2318 may communicate with an inside of the upper steam housing 2340, and air supplied by the humidification fan 2500 may be suctioned into the air suction part 2318.

The air suction part 2318 may protrude upwards from the upper surface of the upper steam housing 2340 for a connection with the humidification fan 2500.

In one embodiment, the air suction part 2318 may be disposed at a rear of the steam discharge part 2316. The air suction part 2318 may be disposed closer to the humidification fan 2500 than the steam discharge part 2316.

The air suction part 2318 may connect with the humidification fan 2500 and may receive filtered air from the humidification fan 2500. The air suction part 2318 may receive air that passes through a filter assembly 600 and that is filtered. The filtered air supplied to the air suction part 2318 may be suctioned to the steam housing 2310 and may be discharged through the steam discharge part 2316 along with steam in the steam housing 2310.

When ordinary air, instead of filtered air, is suctioned into the steam housing 2310, fungi and the like are highly likely to breed in the steam housing 2310.

In one embodiment, air supplied into the steam housing 2310 is limited to filtered air. Accordingly, when the steam generator 2300 does not operate, contamination in the steam housing 2310, caused by germs or fungi and the like, may be minimized.

For the steam generator 2300 according to one embodiment, an air flow of the humidification fan 2500 may be supplied into the steam generator 2300 to push steam out of the steam housing 2310, thereby maximizing flow pressure of the steam.

In another embodiment, a structure, where the humidification fan suctions steam outside the steam housing, may not help steam in the steam housing to be discharged smoothly.

When steam generated in the steam generator 2300 does not flow to lateral discharge ports 301, 302 rapidly, condensation may be formed while steam moves.

According to one embodiment, as the humidification fan 2500 supplies air at an air suction side of the steam generator 2300, formation of condensation while the steam moves may be minimized Additionally, in one embodiment, as air of the humidification fan 2500 pushes steam in the steam housing 2310 out of the steam housing 2310, a sufficient flow velocity of air may be ensured.

According to one embodiment, even when condensation is formed while steam flows, a sufficient flow velocity of air allowing steam to flow may be ensured. Accordingly, condensate may be naturally evaporated by the flow velocity of air.

<Configuration of Drain Assembly>

The drain assembly 2700 may be disposed at a base 130, and may include a drain pump 2710 configured to drain water in a water supply assembly 2200 and a steam generator 2300, a drain hose 2720 connected to the drain pump 2710 and configured to guide water pumped by the drain pump 2710 out of an indoor unit, and a water connection pipe 2730 configured to connect a chamber housing pipe 2214 of the water supply assembly 2200, a water pipe 2314 of the steam generator 2300 and the drain pump 2710 to allow water to flow.

A configuration of the drain pump 2710 is known to one having ordinary skill in the art as an ordinary device. Accordingly, description of operation of the device is omitted. The drain pump 2710 may include a drain inlet 2714 connected to the water connection pipe 2730, and a drain outlet 2712 connected to the drain hose 2720.

The drain inlet 2714 may be disposed horizontally, and in one embodiment, may protrude towards the steam generator 2300. The drain outlet 2712 may protrude upwards.

In one embodiment, as water in the water supply assembly 2200, the steam generator 2300, and the drain pump 2710 may be moved by its self-weight, the drain pump 2710 may be disposed to satisfy the requirement. Accordingly, the drain pump 2710 may be disposed lower than the chamber housing pipe 2214 and the water pipe 2314, for example.

As water in the water supply assembly 2200 and the steam generator 2300 may also be moved using its self-weight, the water pipe 2314 may be disposed lower than the chamber housing pipe 2214, for example.

On the basis of the above arrangement, the chamber housing pipe 2214 may be disposed at a highest position, and the drain pump 2710 may be disposed at a lowest position, and the water pipe 2314 may be disposed at a height between the chamber housing pipe 2214 and the drain pump 2710.

The water supply assembly 2200, the steam generator 2300 and the drain pump 2710 may all be disposed at the base 130 of a cabinet assembly 100. To make a difference in heights, as described above, the base 130 may form a difference in heights.

In one embodiment, a drain pump installation part 133, which is concave downwards, may be formed at the base 130.

The base 130 may include a base top wall 131 which is flatly formed, and a drain pump installation part 133 which is concave downwards from the base top wall 131.

The base top wall 131 may be disposed higher than the drain pump installation part 133.

The water connection pipe 2730 may include a first connection pipe 2731 connected to the chamber housing pipe 2214, a second connection pipe 2732 connected to the water pipe 2314, a third connection pipe 2733 connected to the drain inlet 2714, and a three-way pipe 2735 connected to the first connection pipe 2731, the second connection pipe 2732 and the third connection pipe 2733.

The three-way pipe 2735 may be a T-shaped pipe or a Y-shaped pipe, and in one embodiment, the T-shaped pipe may be used to minimize an installation space.

One end of the first connection pipe 2731 may be coupled to the chamber housing pipe 2214, and the other end may be coupled to the three-way pipe 2735. In another embodiment, the first connection pipe 2731 may be provided with a valve, and the installed valve may regulate a flow of the first connection pipe 2731.

One end of the second connection pipe 2732 may be coupled to the water pipe 2314, and the other end may be coupled to the three-way pipe 2735. A mesh filer (not illustrated) may be installed in the second connection pipe 2732. The mesh filter may filter scale that is produced due to operation of the steam generator, and may block the scale from flowing into the drain pump 2710.

One end of the third connection pipe 2733 may be coupled to the drain inlet 2714 of the drain pump 2710, and the other end may be coupled to the three-way pipe 2735.

A material of the first connection pipe 2731, the second connection pipe 2732, and the third connection pipe 2733 may not be limited, but in one embodiment, may include a synthetic resin to ensure ease of assembly.

As high-temperature water may flow into the second connection pipe 2732, a heat resistant material (in one embodiment, EDPM) may be used for the second connection pipe 2732 to cover a range of temperatures of the steam generator 2300. The second connection pipe 2732, for example, may be made of a material that is not deformed at a temperature (250° C.) prior to operation of a heater fuse.

For example, the entire water connection pipe 2730 may be made of a material that is not deformed at the temperature (250° C.) prior to operation of the heater fuse.

When the steam generator 2300 operates, a temperature of water in the steam generator 2300 may rise to 100° C. or higher even in a normal state. When a pipe for water supply and a pipe for water drainage are respectively provided, a temperature of the pipe for water supply, connected to the water tank, may rise slowly. However, as a small amount of water is stored in the pipe connected to the drain pump 2710, a temperature of the pipe may rise to a temperature similar to that in the steam generator 2300.

When a temperature of water in the pipe connected to the drain pump rises, the drain pump may be damaged.

In one embodiment, to prevent this from happening, water in the steam generator 2300 and water in the water supply assembly 2200 may be mixed in the three-way pipe 2735. The mixed water may help to suppress an increase in the temperature of the third connection pipe 2733.

Although a temperature of water in the second connection pipe 2732 rises to 100° C. or higher, water in the first connection pipe 2731 has a room temperature. Accordingly, high-temperature water and room-temperature water may be mixed in the three-way pipe 2735, thereby suppressing an increase in temperature of the water.

As the water in the first connection pipe 2731 may be supplied by the water supply assembly 2200, an increase in temperature may be suppressed by convection current.

For example, even when the drain pump 2710 operates in a state where water is collected in the steam housing 2310 after the steam generator 2300 operates, the high-temperature water drained from the second connection pipe 2732 and the room-temperature water drained from the first connection pipe 2731 may be mixed in the three-way pipe 2735, and a temperature of the mixed water may drop to at least 70° C. or lower.

In one embodiment, when water is drained through the water connection pipe 2730, a temperature of water flowing to the drain pump 2710 may be between 30° C. to 50° C.

In one embodiment, when the drain pump 2710 operates, water stored in the water tank 2100 and the water supply assembly 2200 as well as water stored in the steam housing 2310 may all be drained.

Water in a humidification assembly 2000 may be used for humidifying air in an indoor space. Accordingly, as time passes, germs may breed. When the humidification assembly 2000 is not used for a predetermined period of time (24 hours), water in the steam housing 2310 as well as water in the water tank 2100 and the water supply assembly 2200 may all be drained, and the humidification assembly 2000 may be dried out entirely.

When the drain pump 2710 operates, water in the third connection pipe 2733 may be drained. As one end of the third connection pipe 2733 coupled to the drain inlet 2714 may be disposed at a lowest height, water in the water tank 2100 and the water supply assembly 2200 may flow to the third connection pipe 2733 through the first connection pipe 2713 and the three-way pipe 2735, on the basis of kinetic energy of the water.

Likewise, water in the steam housing 2310 may flow to the third connection pipe 2733 through the second connection pipe 2732 and the three-way pipe 2735, on the basis of kinetic energy of the water.

With the above-described structure, the water connection pipe 2730 may suppress an increase in temperature of the steam generator 2300 and may readily implement drainage of the entire humidification assembly 2000.

<<Configuration of Steam Guide>>

The steam guide 2400 may supply steam of a steam generator 2300 to a discharge flow channel. The discharge flow channel may include a flow channel of air allowed to flow by a long-distance fan assembly 400, and a flow channel of air allowed to flow by a short-distance fan assembly 300.

In one embodiment, the discharge flow channel may be defined as being disposed at a cabinet assembly 100, and a period during which air passing through a filter assembly 600 is discharged out of the cabinet assembly 100.

In one embodiment, the steam guide 2400 may guide steam, generated in the steam generator 2300, to a lateral discharge port 301, 302. The steam guide 2400 may provide an additional flow channel separate from air in the cabinet assembly 100. The steam guide 2400 may have a pipe shape or a duct shape.

The steam guide 2400 may include a main steam guide 2450 coupled to a steam generator 2300 and supplied with humidified air of the steam generator 2300, a first branch guide 2410 coupled to the main steam guide 2450 and configured to guide some of the humidified air, supplied through the main steam guide 2450, to a first lateral discharge port 301, a second branch guide 2420 coupled to the main steam guide 2450 and configured to guide the remaining humidified air, supplied through the main steam guide 2450, to a second lateral discharge port 302, a first diffuser 2430 assembled to the first branch guide 2410, disposed at the first lateral discharge port 301 and configured to discharge the humidified air, supplied through the first branch guide 2410, to the first lateral discharge port 301, and a second diffuser 2440 assembled to the second branch guide 2420, disposed at the second lateral discharge port 302 and configured to discharge the humidified air, supplied through the second branch guide 2420, to the second lateral discharge port 302.

In another embodiment, the first branch guide 2410 and the second branch guide 2420 may be directly coupled to the steam generator 2300. In this case, a steam discharge part, to which the first branch guide 2410 and the second branch guide 2420 are respectively coupled, may be disposed at the steam generator 2300.

In yet another embodiment, a single branch guide may be provided and may be coupled to a single diffuser. In this case, the single diffuser may be disposed at any one of the first lateral discharge port or the second lateral discharge port.

In one embodiment, the diffuser may be disposed at the lateral discharge port but may also be installed at the front discharge port. That is, the position of the diffuser may not be limited to the lateral discharge port.

In one embodiment, the main steam guide 2450 may have a duct shape. The main steam guide 2450 may guide air from a lower side to an upper side. The main steam guide 2450 may supply air (air where steam and filtered air are mixed), supplied by the steam generator 2300, to the first branch guide 2410 and the second branch guide 2420.

The air (air where steam and filtered air are mixed) supplied by the steam generator 2300 may be branched from the main steam guide 2450 into the first branch guide 2410 and the second branch guide 2420.

A lower end of the main steam guide 2450 may be coupled to a steam discharge part 2316 of the steam housing 2310. An upper end of the main steam guide 2450 may be coupled to the first branch guide 2410 and the second branch guide 2420.

The main steam guide 2450 may have an open lower side. The main steam guide 2450 may be provided with a first guide coupling part 2451 to which the first branch guide 2410 is assembled, and a second guide coupling part 2452 to which the second branch guide 2420 is assembled, at an upper side thereof.

The first guide coupling part 2451 and the second guide coupling part 2452 may penetrate in an up-down direction. In one embodiment, the first guide coupling part 2451 and the second guide coupling part 2452 may have a pipe shape.

The first branch guide 2410 may be formed into a pipe shape corresponding to a flat cross section of the first guide coupling part 2451. The second branch guide 2420 may be formed into a pipe shape corresponding to a flat cross section of the second guide coupling part 2451.

In one embodiment, when seen from a front of the cabinet assembly 100, the main steam guide 2450 tilts to one side (the left). Accordingly, the first branch guide 2410 and the second branch guide 2420 may have different lengths.

Preferably, air may be supplied equivalently to the first branch guide 2410 and the second branch guide 2420. In one embodiment, the first branch guide 2410 and the second branch guide 2420 may have different pipe diameters such that a flow rate of the first branch guide 2410 is equivalent to a flow rate of the second branch guide 2420.

For example, a short-length steam guide may have a small pipe diameter, and a long-length steam guide may have a large pipe diameter, to ensure an equivalent flow rate.

The first diffuser 2430 and the second diffuser 2440 may be symmetrical in a left-right direction.

The first diffuser 2430 may be assembled to the first branch guide 2410, and may be disposed at the first lateral discharge port 301. The first diffuser 2430 may discharge air, supplied along with steam through the first branch guide 2410, to the first lateral discharge port 301.

The steam generator 2300 may heat water to generate steam. Accordingly, the steam has a high temperature. A temperature of humidified air discharged from the first diffuser 2430 and the second diffuser 2440 may vary depending on a temperature in an indoor space, but may be between 50° C. and 70° C. The humidified air discharged from the first diffuser 2430 and the second diffuser 2440 may cause burns to a user.

Accordingly, when the humidification assembly operates, the short-distance fan assembly 300 has to be operated, and air discharged from a side grille 151, 152 and the humidified air have to be mixed to lower the temperature of the humidified air.

The humidified air discharged from the diffuser 2430, 2440 may be mixed with air discharged from the lateral discharge port 301, 302.

The first diffuser 2430 may discharge filtered air including steam, carried by air discharged from the first lateral discharge port 301. Flow velocity of air discharged from the first diffuser 2430 and flow velocity of air discharged through the first lateral discharge port 301 may be similar. A flow rate of air discharged from the first lateral discharge port 301 may be higher than a flow rate of the humidified air, but their flow velocity may be similar, for example. This is because the flow velocity of any one may act as resistance against the flow velocity of the other in case any one has a higher flow velocity than the other.

The air discharged from the first lateral discharge port 301 may diffuse steam discharged from the first diffuser 2430 farther away. The second diffuser 2440 may operate like the first diffuser.

The second diffuser 2440 may be assembled to the second branch guide 2420 and may be disposed at the second lateral discharge port 302. The second diffuser 2440 may discharge air, supplied along with steam through the second branch guide 2420, to the second lateral discharge port 302.

The first diffuser 2430 and the second diffuser 2440 may have the same structure. The first diffuser 2430 is described hereunder as an example.

The first diffuser 2430 may discharge air, supplied along with steam from a lower side, to the lateral discharge port.

The diffuser (in one embodiment, the first diffuser and the second diffuser) may include a diffuser housing 2460, which has a space therein and one side (in one embodiment, a lower side) of which is open, a diffuse outlet 2431, 2441 formed to pass through the diffuser housing 2460, a diffuser coupling part 2432, 2442 disposed outside the diffuser housing 2460 and coupled and fixed to a cabinet assembly 100, a diffuser inlet 2433, 2443 disposed in the diffuser housing 2460 and assembled to a steam guide 2420, 2430, an upper diffuser barrier 2434 disposed in the diffuser housing 2460, disposed at an upper side of a diffuser outlet 2431, 2441 and configured to protrude downwards, and a lower diffuser barrier 2435 disposed in the diffuser housing 2460, disposed at a lower side of the diffuser outlet 2431 and configured to protrude upwards.

When diffuser outlets of the first diffuser 2430 and the second diffuser 2440 need to be distinguished for convenience of description, the diffuser outlets may be referred to as a first diffuser outlet 2431 and a second diffuser outlet 2441. Likewise, when diffuser inlets of the first diffuser 2430 and the second diffuser 2440 need to be distinguished, the diffuser inlets may be referred to as a first diffuser inlet 2433 and a second diffuser inlet 2443.

The diffuser outlet 2431 may have a slit shape. The diffuser outlet 2431 may be extended in the up-down direction. A plurality of diffuser outlets 2431 may be disposed in a lengthwise direction of the diffuser housing 2460. The diffuser outlet 2431 may be disposed towards the left or the right.

The diffuser outlet 2431 may be disposed near the lateral discharge port 301, 302 of the cabinet assembly 100.

The first diffuser outlet 2431 may be disposed towards the left of the cabinet assembly 100, and the second diffuser outlet 2441 may be disposed towards the right of the cabinet assembly 100.

In one embodiment, the diffuser outlet 2431 may be disposed further forwards than the lateral discharge port 301, 302 and may allow the humidified air to flow farther away by a flow of air discharged from the lateral discharge port 301, 302.

The diffuser housing 2460 may be provided with a diffuser space 2461 therein. The diffuser space 2461 may communicate with the diffuser inlet 2433 and the diffuser outlet 2431.

The diffuser space 2461 may be extended in the up-down direction. From a flat cross section perspective, an inside of the diffuser space 2461 may be wide while an outside of the diffuser space is narrow.

The diffuser outlet 2431 may be disposed outside the diffuser space 2461. The diffuser inlet 2433 may be disposed at a lower side of the diffuser space 2461. In one embodiment, the diffuser inlet 2433 may have a pipe shape.

The diffuser inlet 2433 may be inserted into the steam guide 2420. When the diffuser inlet 2433 is inserted into the steam guide 2420, condensate generated in the diffuser housing 2460 may be prevented from leaning outwards.

Condensate formed in the diffuser housing 2460 may flow downwards due to its self-weight, may move to the steam guide 2420 through the diffuser inlet 2433 and then may pass through the main steam guide 2450 to return to the steam generator 2300.

When a humidification fan 2500 operates, the condensate in the diffuser housing 2460 may be naturally evaporated by flowing air. When the humidification fan 2500 does not operate, the condensate formed in the diffuser housing 2460 may return to the steam generator 2300 and may be discharged outwards though a drain assembly 2700.

The diffuser housing 2460 may provide a structure that guides condensate formed in the diffuser housing 2460 downwards. To this end, a diffuser upper wall 2462 and a diffuser lower wall 2464 constituting the diffuser space 2461 may form an inclined surface.

The diffuser upper wall 2462 may be an inclined surface, an outer side of which is high and an inner side of which is low. The diffuser upper wall 2462 may form an upper side wall of the diffuser housing 2460. The diffuser space 2461 may be formed at a lower side of the diffuser upper wall 2462. The diffuser upper wall 2462 may form an inclination with respect to the left-right direction. Condensate formed on the diffuser upper wall 2462 may easily move downwards along the inclination of the diffuser upper wall 2462.

The diffuser lower wall 2464 may be an inclined surface, an outer side of which is high and an inner side of which is low. The diffuser lower wall 2464 may form a lower side wall of the diffuser housing 2460. The diffuser space 2461 may be formed at an upper side of the diffuser lower wall 2464. The diffuser lower wall 2464 may form an inclination with respect to the left-right direction. Condensate formed on the diffuser lower wall 2464 may easily move downwards along the inclination of the diffuser lower wall 2464.

The diffuser housing 2460 may provide a structure that prevents condensate formed in the diffuser housing 2460 from being discharged outwards.

The condensate formed in the diffuser housing 2460 may be scattered out of the diffuser 2430, 2440 by flow pressure of air supplied by the humidification fan 2500.

To prevent this from happening, the upper diffuser barrier 2434 and the lower diffuser barrier 2435 may be disposed in the diffuser housing 2460.

The upper diffuser barrier 2434 may be disposed at the diffuser upper wall 2462 and may protrude from the diffuser upper wall 2462 downwards.

The upper diffuser barrier 2434 may be disposed outside the diffuser upper wall 2462, for example. The upper diffuser barrier 2434 may be disposed at an outermost side of the diffuser upper wall 2462, may protrude downwards from an uppermost side of the diffuser upper wall 2462 and may extend from the diffuser upper wall 2462 in a front-rear direction.

The upper diffuser barrier 2434 may limit movement of condensate by blocking a part of the upper side of the diffuser outlet. The condensate, pushed and moved outwards along the diffuser upper wall 2462 by flow pressure of air, may be stopped by the upper diffuser barrier 2434 and may be prevented from being discharged outwards.

The lower diffuser barrier 2435 may be disposed at the diffuser lower wall 2462 and may protrude from the diffuser lower wall 2464 upwards.

The lower diffuser barrier 2435 may be disposed outside the diffuser lower wall 2464, for example. The lower diffuser barrier 2435 may be disposed at an outermost side of the diffuser lower wall 2464, may protrude from an uppermost side of the diffuser lower wall 2464 upwards and may extend from the diffuser lower wall 2464 in the front-rear direction.

The lower diffuser barrier 2435 may block a part of the lower side of the diffuser outlet to limit movement of condensate. The condensate pushed and moved outwards along the diffuser lower wall 2464 by flow pressure of air may be stopped by the lower diffuser barrier 2435 and may be prevented from being discharged outwards.

The diffuser housing 2460 may include a front diffuser housing 2463 forming a front surface of the diffuser space 2461 and disposed to face forwards, a rear diffuser housing 2465 forming a back surface of the diffuser space 2461 and disposed to face rearwards, and a protruding part 2466 protrudes forwards from an outer end 2463*a* of the front diffuser housing 2463.

The diffuser space 2461 may be formed between the front diffuser housing 2463 and the rear diffuser housing 2465.

An outer surface 2463*c* of the front diffuser housing 2463 may be disposed towards an upper cover 162. In one embodiment, the outer surface 2463*c* of the front diffuser housing 2463, and the upper cover 162 may form a contained angle of A2. In another embodiment, the outer surface 2463*c* of the front diffuser housing 2463 may closely contact a back surface of the upper cover 162, and the outer surface 2463*c* of the front diffuser housing 2463 and the upper cover 162 may form a contained angle of 0 degrees. An inner surface 2463*b* of the front diffuser housing 2463 may form the diffuser space 2461.

The rear diffuser housing 2465 may be disposed at a front of a motor cover 318. In one embodiment, an outer surface 2465*c* of the rear diffuser housing 2465 may closely contact a front surface of the motor cover 318. An inner surface 2465*b* of the rear diffuser housing 2465 may form the diffuser housing 2461.

An outer end of the motor cover 318 may extend to the side grille 151, 152. The outer end of the motor cover 318 may guide discharged air to the side grille 151, 152.

The diffuser outlet 2431 may be disposed between the outer end 2463*a* of the front diffuser housing 2463 and an outer end 2465*a* of the rear diffuser housing 2465.

The outer end 2463*a* of the front diffuser housing 2463 and the outer end 2465*a* of the rear diffuser housing 2465 may be spaced apart from each other in a front-rear direction to form the diffuser outlet 2431.

The outer end 2463*a* of the front diffuser housing 2463 and the outer end 2465*a* of the rear diffuser housing 2465 may form a distance of D1 in the front-rear direction to form the diffuser outlet 2431.

In one embodiment, the outer end 2463*a* of the front diffuser housing 2463 may protrude further outwards than the outer end 2465*a* of the rear diffuser housing 2465. The outer end 2463*a* of the front diffuser housing 2463 and the outer end 2465*a* of the rear diffuser housing 2465 may form a distance of D2 in the left-right direction.

A distance of D3 may be formed from the outer end 2463*a* to an end 2466*a* at a front of the protruding part 2466.

A distance of D4 may be formed from the end 2466*a* at the front of the protruding part 2466 to a back surface 217*a* of a front panel end. As a door assembly 200 is a structure that slides in the left-right direction with respect to the cabinet assembly 100, the distance of D4 may not be set to 0. When the distance of D4 is 0, friction and noise may be caused by sliding movements of the door assembly 200. In fact, assembly tolerance or manufacturing tolerance of the door assembly 200 and the cabinet assembly 100 is needed. Accordingly, in case the distance of D4 is 1 mm, it is difficult to manufacture the indoor unit. From a technical point of view, the distance of D4 may be 2 mm or greater, for example.

A distance of D5 may be formed from the outer end 2463*a* to an outer surface 216*a* of a second front panel side 216.

The outer end 2463*a* of the front diffuser housing 2463 may be disposed within a width of the door assembly 100 in the left-right direction. Accordingly, formation of condensation on a surface of the door assembly 200 may be minimized.

The outer end 2463*a* of the front diffuser housing 2463 may not protrude outside the door assembly 200, for example. When the outer end 2463*a* protrudes outside the door assembly 200, force of air discharged from the side grille and allowing humidified air to flow forwards may increase. Accordingly, condensation may be formed at the front panel side.

The outer end 2463*a* of the front diffuser housing 2463 may be disposed on the same line as the lateral side grille 151, 152 with respect to the front-rear direction, or may be disposed further inwards than the side grille 151, 152.

Specifically, the outer end 2463*a* of the front diffuser housing 2463 may be disposed further outwards than an outer end 155*a* of a vane 155 disposed at the side grille 151, 152 in a lateral direction. Additionally, the front panel side may be disposed further outwards than the outer end 2463*a* of the front diffuser housing 2463 in the lateral direction.

The outer end 2465*a* of the rear diffuser housing 2465 may be disposed further inwards than the outer end 155*a* of the vane 155 or the outer end 2463*a* of the front diffuser housing 2463 in the lateral direction. In one embodiment, the outer end 2465*a* of the rear diffuser housing 2465 may be disposed within a length of the vane 155 in the left-right direction.

A vane gap (BG) may be formed between a plurality of vanes 155. Among the plurality of vanes 155, a vane disposed at a foremost position is referred to as a first vane 156.

The outer end 2465*a* of the rear diffuser housing 2465 may be disposed between an outer end 156*a* of the first vane 156 and the outer end 2463*a* of the front diffuser housing 2463.

In one embodiment, a gap between the outer end 156*a* of the first vane 156 and the outer end 2463*a* of the front diffuser housing 2463 may be the same as the vane gap (BG).

The diffuser outlet 2431, 2441 may be disposed between the outer end 156*a* of the first vane 156 and the outer end 2463*a* of the front diffuser housing 2463.

The outer end 2465*a* of the rear diffuser housing 2465 may be disposed further forwards than the outer end 156*a* of the first vane 156, and the outer end 2463*a* of the front diffuser housing 2463 may be disposed further forwards than the outer end 2465*a* of the rear diffuser housing 2465.

The protruding part 2466 may be disposed to surround an outer edge 162*a* of the upper cover 162. When seen from a front surface, the upper cover 162 may be disposed between a protruding part (not illustrated) of the first diffuser 2430 and the protruding part 2466 of the second diffuser 2440.

The outer end 2463*a* of the front diffuser housing 2463 may be disposed within the width of the door assembly 100 in the left-right direction. That is, the outer end 2463*a* of the front diffuser housing 2463 may not protrude outside a left edge of the door assembly 100 or a right edge 216*a* of the door assembly 100. The distance of D5 may be 1 mm or greater, for example.

For the distance of D5, a (+) distance may denote a direction from the left edge or the right edge 216*a* towards an inside of a front panel 210, and a (−) distance may denote a direction of an outside of the left edge or the right edge 216*a*.

When a surface of the left edge or the right edge 216*a* is disposed on the same line as the left edge or the right edge 216*a* of the front panel 210 (D5=0), condensation may be formed on a surface of the left edge or the right edge 216*a*.

When the distance of D5 is greater than 1 mm, formation of condensation may be effectively reduced. As the distance of D5 increases, a distance between the outer end 2463*a* of the front diffuser housing 2463 and the left edge or the right edge 216*a* of the front panel 210 may increase.

Additionally, a total of the distances of D3 and D4 may be an important factor for minimizing formation of condensation on surfaces of a first front panel side 214 and the second front panel side 216 of the front panel 210.

In one embodiment, a total (DL) of the distances of D3 and D4 may be 5 mm or greater.

When the distance of D3 is 3 mm, the distance of D4 has to be 2 mm or greater, and when the distance of D4 is 2 mm, the distance of D3 has to be 3 mm or greater.

When the total (DL) is 5 mm or greater, formation of condensation may be suppressed.

As the total (DL) becomes greater, a length of a front of the side grille 151, 152 may become longer. In one embodiment, the total (DL) may be from 5 mm or greater to 10 mm or less, for example.

In one embodiment, considering design tolerance and manufacturing tolerance, the distance of D3 may be 6 mm to 7 mm, and considering assembly tolerance, the distance of D4 may be 2 mm to 3 mm, and the total (DL) may be set to 8 mm to 10 mm.

The front diffuser housing 2463 may closely contact the upper cover 162 that covers a front surface of an upper cabinet 110. The front diffuser housing 2463 may be disposed at a rear of the upper cover 162, and may closely contact the back surface of the upper cover 162.

The outer end 2463*a* of the front diffuser housing 2463 may be formed to surround an edge 162*a* of a lateral surface of the upper cover 162. As the outer end 2463*a* of the front diffuser housing 2463 surrounds a lateral portion of the upper cover 162, the lateral surface of the upper cover 162 may be prevented from being exposed outwards.

The protruding part 2466 of the front diffuser housing 2463 may form a step along with the front diffuser housing 2463 and may protrude forwards.

Accordingly, the protruding part 2466 of the front diffuser housing 2463 may be exposed outwards. In one embodiment, the protruding part 2466 of the front diffuser housing 2463 is referred to as a diffuser housing decoration part.

The diffuser housing decoration part may be disposed at an edge of a back surface of the door assembly 200 and may not protrude further laterally than an edge of a lateral surface of the door assembly 200.

As the diffuser housing decoration part protrudes further laterally than the outer end 2465*a* of the rear diffuser housing 2465, linearity of humidified air discharged from the diffuser 2430 may improve.

The outer end 2465*a* of the rear diffuser housing 2465 may be disposed further inwards than the lateral side grille 151, 152. With respect to the front-rear direction, the outer end 2465*a* of the rear diffuser housing 2465 may be disposed between the lateral side grille 151, 152 and the front diffuser housing 2463.

The rear diffuser housing 2465 may be disposed in a direction of an inclination of the lateral side grille 151, 152 and may minimize resistance against air discharged through the lateral discharge port 301, 302.

The front diffuser housing 2463 may be disposed in the left-right direction, for example. When the front diffuser housing 2463 may be disposed in the left-right direction, linearity of air including steam towards the lateral direction may improve.

The upper cover 162 and a front panel body 212 may be disposed in parallel.

From a flat cross section perspective, with respect to a front surface 200*a* of the front panel body 212, a contained angle between the front surface 200*a* and the vane 155 of the side grille 151, 152 is defined as A1. The contained angle of A1 may be disposed to face forwards, and may be formed between 40 degrees and 50 degrees. In one embodiment, the contained angle of A1 may be 45 degrees.

From a flat cross section perspective, with respect to the front surface 200*a* of the front panel body 212, a contained angle between the front surface 200*a* and the front diffuser housing 2463 is defined as A2.

The contained angle of A2 may be formed from 0 or greater degrees to 40 or less degrees.

As a difference between the contained angles of A1 and A2 becomes greater, formation of condensation on a surface of the front panel side may be suppressed more effectively. The contained angle of A2 may be 0 degrees, for example. In one embodiment, the contained angle of A2 may be 5 degrees.

From a flat cross section perspective, with respect to the front surface 200*a* of the front panel body 212, a contained angle between the front surface 200*a* and the rear diffuser housing 2465 is defined as A3.

The contained angle of A3 may be smaller than an angle of the vane 155, for example.

Considering the contained angle of A2, A3 may be greater than A2 and may be smaller than A1.

When the contained angle of A3 is larger than the inclination angle (A1) of the vane 155, resistance may occur against air towards the side grille.

A contained angle of B1 may be formed between a direction (Sh) faced by an outer circumferential end of a shroud 314, and the front surface 200*a* of the front panel body 212.

A contained angle of B2 may be formed between a direction (A) faced by an outer circumferential end of a hub 312, and the front surface 200*a* of the front panel body 212.

The contained angle of B1 of the shroud 314 may be the same as the contained angle of A1 of the vane 155, for example. The contained angle of B2 of the hub 312 may be the same as the contained angle of A1 of the vane 155, for example.

When the direction (Sh) of the shroud 314, the direction (A) of the hub 312 and the direction (A1) of the vane 155 are the same or similar, pneumatic resistance of air may be minimized.

In one embodiment, the direction (A) of the hub 312 and the direction (A1) of the vane 155 may be formed to be the same, and the direction (Sh) of the shroud 314 may be gentler than the contained angle of A1.

In one embodiment, all the plurality of vanes 155 of the side grille may be disposed between the direction (Sh) faced by the outer circumferential end of the shroud 314 and the direction (A) faced by the outer circumferential end of the hub 312.

That is, the vanes 155 may be disposed further rearwards than the direction (Sh) faced by the outer circumferential end of the shroud 314, and may be disposed further forwards than the direction (A) faced by the outer circumferential end of the hub 312.

Additionally, the diffuser outlet 2431, 2441 may be disposed further rearwards than the direction (A) faced by the outer circumferential end of the hub 312. The protruding part 2466 may be disposed further rearwards than the direction (A) faced by the outer circumferential end of the hub 312.

From a flat cross section perspective, for the diffuser space 2461 in the diffuser housing 2460, an inside may be wide and an outside may be narrow. From a flat cross section perspective, the diffuser space 2461 may be formed into a wedge shape an outside of which is pointy.

The diffuser outlet 2431 may be disposed at the pointy portion of the diffuser space 2461. The diffuser outlet 2431 may be disposed further forwards than the lateral discharge port 301, 302. The diffuser outlet 2431 may be disposed further rearwards than the door assembly 200 and may be disposed further forwards than the side grille 151, 152.

The lateral discharge port 301, 302 may discharge air towards a right of a front and a left of the front, and humidified air may be discharged in a forward direction of the lateral discharge port 301, 302. When the humidified air is discharged in the forward direction of the lateral discharge port 301, 302, the humidified air may flow father away.

When the humidification assembly 2000 according to one embodiment provides a humidification function, a distance reached by moisture does not rely only on an output of the humidification fan 2500. In case making moisture to flow farther away relies on the output of the humidification fan 2500, capacity of the humidification fan 2500 has to increase or the humidification fan 250 has to operate at high speeds.

In one embodiment, when the humidification assembly 2000 operates, moisture carried by air of a short-distance fan assembly 300 may flow farther away. In this case, although a humidification fan 2500 having low output capacity is used, humidified air may be provided to a far corner in an indoor space.

The diffuser outlet 2431 may be disposed at a front of the lateral discharge port 301, 302 rather than a rear of the lateral discharge port 301, 302 such that humidified air flows farther away.

A stream (HA) of humidified air discharged from the diffuser outlet 2431 and a stream (DA) of discharged air discharged from the vane 152 may cross. In order for the stream (HA) of the humidified air and the stream (DA) of the discharged air to cross, a direction of an inclination of the front diffuser housing 2463 and a direction of an inclination of the vane 152 may cross.

<<Configuration of Humidification Fan>>

The humidification fan 2500 may suction filtered air passing through a filter assembly 600 and may supply the filtered air to a steam generator 2300, and may allow the filtered air along with steam generated in the steam generator 2300 to flow to a steam guide 2400.

The humidification fan 2500 may generate an air flow that discharges steam and filtered air (in one embodiment, humidified air) from a diffuser 2430, 2440.

The humidification fan 2500 may include a humidification fan housing 2530 configured to suction filtered air passing through a filter assembly 600 and to guide the filtered air suctioned to a steam generator 2300, a clean suction duct 2540, a lower side of which is connected to the humidification fan housing 2530 and an upper side of which is disposed at a front of the filter assembly 600 to supply the filtered air passing through the filter assembly 600 to the humidification fan housing 2530, a humidification impeller 2510 disposed in the humidification fan housing 2530 and allowing the filtered air of the humidification fan housing 2530 to flow to the steam generator 2300, and a humidification motor 2520 disposed at the humidification fan housing 2530 and configured to rotate the humidification impeller 2510.

The clean suction duct 2540 may supply filtered air passing through the filter assembly 600 to the humidification fan housing 2530.

The filter assembly 600 may be disposed at an upper cabinet 110, and the humidification fan 2500 may be disposed at a lower cabinet 120. Accordingly, there is a difference between the heights at which the filter assembly 600 and the humidification fan 2500 are disposed. That is, the filter assembly 600 may be disposed at an upper portion of the humidification fan 2500.

The filtered air passing through the filter assembly 600 may flow to a short-distance fan assembly 300, and may not flow to the lower cabinet 120 or hardly flow to the lower cabinet 120. The lower cabinet 120 has no portion from which air is discharged. Accordingly, as long as air is not supplied to the lower cabinet 120 artificially, the filtered air may not flow or circulate into the lower cabinet 120.

Additionally, as a drain pan 140, which supports a heat exchange assembly and collects condensate, is disposed at a lower side of the upper cabinet 110, the filtered air in the upper cabinet 110 may hardly flow to the lower cabinet 120.

An upper end of the clean suction duct 2540 may be disposed in the upper cabinet 110, and a lower end may be disposed in the lower cabinet 120. That is, the clean suction duct 2540 may provide a flow channel for allowing the filtered air in the upper cabinet 110 to flow into the lower cabinet 120.

The clean suction duct 2540 may include a first clean duct part 2542 which may be disposed in the upper cabinet 110, and into which filtered air is suctioned, and a second clean duct part 2544 which may be disposed in the lower cabinet 120 and which is coupled to the humidification fan housing 2530.

The first clean duct part 2542 and the second clean duct part 2544 may be integrally manufactured.

The first clean duct part 2542 may be disposed towards the heat exchange assembly, and the second clean duct part 2544 may be disposed towards the humidification fan housing 2530.

In one embodiment, the first clean duct part 2542 may be disposed horizontally, and the second clean duct part 2544 may be disposed perpendicularly.

The first clean duct part 2542 may be disposed at a front of the heat exchange assembly and may be disposed towards the filter assembly 600. In one embodiment, the first clean duct part 2542 may closely contact a front surface of the heat exchange assembly. The first clean duct part 2542 may be disposed at a front of a lower portion of the heat exchange assembly. For the first clean duct part 2542, a first clean duct open surface 2541, which is open towards the heat exchange assembly or the filter assembly 600, may be formed.

The second clean duct part 2544 may guide filtered air, supplied through the first clean duct part 2542, to the humidification fan housing 2530. A lower end of the second clean duct part 2544 may be assembled to the humidification fan housing 2530.

The second clean duct part 2544 may be disposed in an up-down direction and may be disposed across a drain pan 140 in the up-down direction. In one embodiment, the second clean duct part 2544 may be disposed at a front of the drain pan 140.

For the second clean duct part 2544, a second clean duct open surface 2543, which communicates with a first suction open surface 2552 of a below-described first humidification fan housing 2550, may be formed.

The humidification fan housing 2530 may include a first humidification fan housing 2550 which is coupled to the clean suction duct 2540, where filtered air is suctioned and which is provided with a first suction space 2551 therein, a second humidification fan housing 2560 coupled to the first humidification fan housing 2550 to receive filtered air from the first humidification fan housing 2550, provided with a second suction space 2561 therein, provided with the humidification impeller 2510 therein and configured to guide the filtered air to the steam generator 2300 by operation of the humidification impeller 2510, a first suction open surface 2552 formed in the first humidification fan housing 2550, communicating with the first suction space 2551 and being open towards one side (in one embodiment, an upper side), a second suction open surface 2562 formed in the second humidification fan housing 2560, communicating with the second suction space 2561 and being open towards the other side (in one embodiment, a lower side), a first suction space discharge part 2553 passing through the first humidification fan housing 2550 and the second humidification fan housing 2560 and allowing the first suction space 2551 to communicate with the second suction space 2561, and a motor installation part 2565 which is disposed in the second humidification fan housing 2560 and where the humidification motor 2520 is installed.

The first humidification fan housing 2550 may be provided with the first suction open surface 2552 towards the upper side. The clean suction duct 2540 may connect to the suction open surface 2552. The second humidification fan housing 2560 may be provided with the second suction open surface 2562 towards the lower side.

In one embodiment, a direction in which the first suction open surface 2552 is open may be opposite to a direction in which the second suction open surface 2562 is open.

A lower surface 2554 of the first humidification fan housing 2550 may be rounded, and may be disposed further downwards than the first suction space discharge part 2553. An upper surface 2564 of the second humidification fan housing 2560 may be rounded, and may be disposed further upwards than the first suction space discharge part 2553.

A motor shaft (not illustrated) of the humidification motor 2520 may pass through the second humidification fan housing 2560 and may be assembled to the humidification impeller 2510.

The motor installation part 2565 may protrude from the second humidification fan housing 2560 rearwards, and the humidification motor 2520 may be inserted into and installed in the motor installation part 2565.

The first humidification fan housing 2550 where the first suction space 2551 is formed, and the second humidification fan housing 2560 where the second suction space 2561 is formed may be separately manufactured and then may be assembled.

In one embodiment, three parts may be assembled to manufacture the humidification fan housing 2530 as part of an effort to simplify an assembly structure and reduce manufacturing costs.

The humidification fan housing 2530 may include a first humidification fan housing part 2531 configured to surround a front of the first suction space 2551 and constituting a part of the first humidification fan housing 2550, a second humidification fan housing part 2532 configured to surround a rear of the first suction space 2551, configured to surround a front of the second suction space 2561, provided with the first suction space discharge part 2553 and constituting the rest of the first humidification fan housing 2550 and a part of the second humidification fan housing 2560, and a third housing part 2533 configured to surround a rear of the second suction space 2561, provided with the motor installation part 2565 and constituting the rest of the second humidification fan housing 2560.

As the second humidification fan housing part 2532 is shared by the first humidification fan housing 2550 and the second humidification fan housing 2560, the number of components may be reduced, thereby ensuring a decrease in manufacturing costs.

The second humidification fan housing part 2532 may be provided with the first suction space discharge part 2553. The first suction space discharge part 2553 may be formed to pass through the second humidification fan housing part 2532 in a front-rear direction.

The first suction space discharge part 2553 may protrude towards the humidification impeller side 2510 and may have a circular shape.

The second humidification fan housing part 2532 may form the first suction space discharge part 2553 and may be provided with an orifice part 2534 protruding towards the humidification impeller side 2510.

The second humidification fan housing part 2532 may be provided with the first suction space 2551 at a front thereof and provided with the second suction space 2561 at a rear thereof.

The humidification impeller 2510 may be a centrifugal fan that suctions air from its center and discharges air circumferentially. Air discharged from the humidification impeller 2510 may flow to the steam generator 2300 through the second humidification fan housing 2560.

A flow of filtered air based on operation of the humidification motor 2520 is described as follows.

When the humidification motor 2520 operates, the humidification impeller 2510 coupled to the humidification motor 2520 may rotate. As the humidification impeller 2510 rotates, an air flow may be generated in the humidification fan housing 2530, and filtered air may be suctioned through the clean suction duct 2540.

The filtered air suctioned through the clean suction duct 2540 may pass through the first suction space 2551 and the first suction space discharge part 2553 of the first humidification fan housing 2550, and may flow to the second humidification fan housing 2560. The air flowing to the second humidification fan housing 2560 may be pressurized by the humidification impeller 2510, may move downwards along the second humidification fan housing 2560, and then may flow into the steam generator 2300 through the second suction open surface 2562.

The filtered air, flowing into a steam housing 2310 through an air suction part 2318 of the steam generator 2300, may be discharged through a steam discharge part 2316 along with steam generated in the steam generator 2300.

Humidified air discharged from the steam discharge part 2316 may be branched from a main steam guide 2450 into a first branch guide 2410 and a second branch guide 2420.

The humidified air flowing to the first branch guide 2410 may be discharged to a first lateral discharge port 301 through a first diffuser 2440, and the humidified air flowing to the second branch guide 2420 may be discharged to a second lateral discharge port 302 through a second diffuser 2450.

The humidified air discharged from the first lateral discharge port 301 may be diffused towards a left side of a cabinet assembly 100 along with air movement generated through the short-distance fan assembly 300, and the humidified air discharged from the second lateral discharge port 302 may be diffused towards a right side of the cabinet assembly 100 along with air movement generated through the short-distance fan assembly 300.

FIG. 23 is a view illustrating an example of a flow as the time of a first exemplary humidification operation. FIG. 24 is a view illustrating an example of a flow at the time of a first exemplary steam-sterilization operation.

Referring to FIG. 23, when the indoor unit according to one embodiment performs a humidification operation, filtered air passing through the filter assembly 600 may be suctioned into the humidification fan 2500 through the clean suction duct 2540, and the filtered air, suctioned based on an operation of the humidification motor 2520, may flow to the steam generator 2300.

The air flowing from the humidification fan 2500 to the steam generator 2500 may flow from an upper side to a lower side, and may flow into the steam housing 2310 through the air suction part 2318. The filtered air flowing into the steam housing 2310 may be mixed with steam generated in the steam housing 2310. The filtered air may be mixed with the steam while moving in the steam housing 2310 horizontally, and based on the mixture of the steam and the filtered air, humidified air may be generated.

Of a first heater part 2321 and a second heater part 2322, power may be supplied only to the first heater part 2321, and the first heater part 2321 may only generate heat at the time of humidification operation.

In a structure where the humidification fan 2500 is disposed on a discharge side of the steam generator 2300 and the steam housing 2310 suctions air, steam of the steam generator 2300 may flow back to the filter assembly 600, and condensate may be generated in the filter assembly 600.

In one embodiment, the humidification fan 2500 may blow air to the steam generator 2300 to supply filtered air. Accordingly, steam generated in the steam generator 2300 may be prevented from flowing back to the filter assembly 600.

When the humidification fan 2500 does not operate, steam may flow backwards through the air suction part 2318. In one embodiment, as the humidification fan 2500 blows and supplies air towards the steam housing 2310, steam generated in the steam generator 2300 may be prevented from flowing backwards to an air suction side.

Humidified air in the steam housing 2310 may be discharged out of the steam housing 2310 through the steam discharge part 2316. The main steam guide 2450 may be disposed at an upper portion of the steam discharge part 2316, and the humidified air may flow upwards along the main steam guide 2450.

The humidified air flowing in the main steam guide 2450 has a temperature higher than a temperature of air in an indoor space. Accordingly, the humidified air may move upwards based on a density difference. The humidified air flowing in the main steam guide 2450 may naturally move from a lower side to an upper side on the basis of air pressure by the humidification fan 2500 and a density difference.

The humidified air in the main steam guide 2450 may branch from the main steam guide into the first branch guide 2410 and the second branch guide 2420, and then may be supplied to the first diffuser 2430 or the second diffuser 2440.

Depending on conditions of an indoor space, condensate may be generated in the first branch guide 2410, the second branch guide 2420, the first diffuser 2430, or the second diffuser 2440.

Condensate generated in the steam guide 2400 may move downwards due to its self-weight. The condensate, moving from the diffuser 2430, 2440 to the branch guide 2410, 2420 on the basis of its self-weight, may flow into an upper portion of the branch guide 2410, 2420 through the diffuser inlet 2433, 2443.

When the condensate moves to the branch guide 2410, 2420 through the diffuser inlet 2433, 2443, noise may be made due to interference between the condensate and air. The condensate moving downwards due to its self-weight and the humidified air flowing upwards may cause friction and due to the friction, noise may be made.

That is, when the condensate is separated on an inner surface of the diffuser inlet 2433, 2443, the humidified air flowing upwards, and the condensate moving downwards based on its self-weight may meet, and noise may be made.

When a small amount of condensate is generated, a user may not recognize the noise. However, when a large amount of condensate is generated, a user may recognize the noise. To solve the problem, a noise reduction structure capable of reducing noise of the condensate may be formed at a portion where the diffuser inlet 2433, 2443 and the branch guide 2410, 2420 are coupled.

In one embodiment, for the noise reduction structure, an inner diameter (P1) of the diffuser inlet 2433, 2443 may be smaller than an inner diameter (P2) of the branch guide 2410, 2420. Accordingly, a step (GP) may be formed between a lower end 2433*a* of the diffuser inlet 2433, 2443 and an inner surface of the branch guide 2410, 2420.

As the inner diameter (P1) of the diffuser inlet 2433, 2443 is smaller than the inner diameter (P2) of the branch guide 2410, 2420, the condensate flowing from an upper side may be moved to the inner surface 2410*a* of the branch guide by surface tension at the lower end 2433*a* of the diffuser inlet.

When air flows from the branch guide to the diffuser inlet, the inner diameter may be reduced from P2 to P1. Accordingly, air resistance may be formed around the lower end 2433*a* of the diffuser inlet, causing air stream to flow to the inner diameter (P1) of the diffuser inlet rather than the inner surface 2410*a* of the branch guide 2410, 2420.

That is, through the step (GP) where the inner diameter becomes small, the condensate may move downwards along the inner surface 2410*a* of the branch guide, and separation of the condensate on the inner surface of the diffuser inlet 2433, 2443 may be minimized by air movement pressure of the humidified air.

In another embodiment, the inner diameter (P1) of the diffuser inlet 2433, 2443 and the inner diameter (P2) of the branch guide 2410, 2420 may be the same, and the inner surface 2433*b* of the diffuser inlet and the inner surface 2410*a* of the branch guide may form a continuous surface.

Humidified air supplied to the first diffuser 2430 and the second diffuser 2440 may be discharged respectively from the first diffuser outlet 2431 and the second diffuser outlet 2441.

When a humidification assembly is steam-sterilized, the steam generator 2300 operates while the humidification fan 2500 does not operate. At the time of steam-sterilization operation, power may be supplied to all the first heater part 2321 and the second heater part 2322, and the first heater part 2321 may only generate heat.

When the first heater part 2321 and the second heater part 2322 operate, water stored in the steam generator 2300 may be heated rapidly, and a temperature of generated steam may increase rapidly. Accordingly, a small amount of water may be used to sterilize the steam guide 2400 entirely.

After the steam-sterilization operation, the water in the steam generator 2300, and water in the water tank 2100 may be drained together.

FIG. 25 is a front view illustrating an indoor unit including a second exemplary humidification assembly. FIG. 26 is a flat cross-sectional view of FIG. 25. FIG. 27 is a cross-sectional perspective view of the diffuser and the side grille in FIG. 26.

Disposition of a first diffuser 12430 and a second diffuser 12440 in this embodiment may differ from that in the above-described embodiments. Unlike the above-described embodiments, a short-distance fan assembly 300 may only be disposed in this embodiment.

The diffuser 12430, 12440 according to one embodiment may be disposed at a rear of a side grille 152, and each diffuser outlet 2431, 2441 may be disposed to face forwards.

In other embodiments, the diffuser 12430, 12440 may be formed into a wedge shape and may be disposed towards a vane 155 of the side grille 152 provided with a pointy diffuser outlet 2341, 2441 at a front thereof.

The diffuser 12430, 12440 may be disposed further rearwards than a lateral discharge port 301, 302. For the diffuser 12430, 12440, a diffuser inlet 2433, 2443 may be disposed at a rear, and a diffuser outlet 2341, 2441 may be disposed at a front.

In one embodiment, a stream of humidified air discharged from the diffuser 12430, 12440 may be across a stream of discharged air.

As the diffuser 12430, 12440 is disposed at a rear of the lateral discharge port 301, 302, interference with the discharged air may be minimized. As the diffuser 12430, 12440 is disposed at the rear of the lateral discharge port 301, 302, interference between the discharged air and a motor cover 318 may be minimized.

The remaining configurations of this embodiment are the same as those in the above-described embodiments. Accordingly, detailed description on the remaining configurations is omitted.

FIG. 28 is an exploded perspective view illustrating a third exemplary indoor unit.

For a humidification assembly according to one embodiment, an upper cabinet 110 and a lower cabinet 120 may be divided, and a partition for dividing a first inner space (S1) and a second inner space (S2) may be disposed between the upper cabinet 110 and the lower cabinet 120. The partition may be a drain pan 140.

A first suction port 101 may be disposed on a back surface of the upper cabinet 110, and a second suction port 102 may be disposed on a back surface of the lower cabinet 120. A first filter assembly 600 may be disposed at the first suction port 101, and a second filter assembly 602 may be disposed at the second suction port 102.

Air suctioned through the first suction port 101 may pass through a heat exchange assembly 500, and may exchange heat with the heat exchange assembly 500 to condition air in an indoor space.

Air suctioned through the second suction port 102 may be supplied to the humidification assembly 2000. Filtered air suctioned through the second suction port 102 may be supplied to the humidification assembly 2000 and may be used to supply humidified air, as in the first embodiment.

In one embodiment, filtered air, which exchanges heat with the heat exchange assembly, is supplied to the humidification assembly. In this embodiment, filtered air passing through the second filter assembly 602 may only be used to generate humidified air without heat exchange with the heat exchange assembly 500.

When the indoor unit operates for a long time, foreign substances may be attached onto a surface of the heat exchange assembly 500. In one embodiment, foreign substances separated from the heat exchange assembly 500 may be prevented from flowing into the humidification assembly 2000.

A steam guide 2400 may be disposed to pass through the partition (in one embodiment, the drain pan). Air in the first inner space (S1) and the second inner space (S2) may be blocked by the partition, and the partition may prevent conditioned air from flowing into the second inner space (S2).

The remaining configurations of this embodiment are the same as those in the above-described embodiments. Accordingly, detailed description on the remaining configurations is omitted.

Although the embodiments have been described with reference to a number of illustrative embodiments thereof, it should be understood that numerous other modifications and embodiments can be devised by those skilled in the art. In addition to variations and modifications in the component parts and/or arrangements, alternative uses will also be apparent to those skilled in the art. Thus, the embodiments are provided only as examples and are not limited.

The invention claimed is:

1. An indoor unit of an air conditioner, comprising:

a cabinet assembly including an inner space therein;

a discharge port defined on an outer surface of the cabinet, and communicating with the inner space;

a suction port defined on an outer surface of the cabinet, and communicating with the inner space;

a filter assembly that filters air flowing through the suction port;

a fan assembly disposed in the inner space to discharge, through the discharge port, intake air suctioned through the suction port, and filtered by the filter assembly;

a steam generator disposed in the inner space to convert water into steam to generate humidified air;

a humidification fan coupled to the steam generator to supply the intake air suctioned through the suction port, and filtered by the filter assembly to the steam generator; and a steam guide (i) connected to the steam generator, and (ii) configured to supply a humidification flow channel, to guide steam discharged from the steam generator to the discharge port, the humidification flow channel (i) defined from steam generator to the discharge port, and (ii) independent from the inner space from steam generator to the discharge port, wherein the humidification fan push the intake air into the steam generator to discharge the humidified air to the steam guide.

2. The indoor unit of claim 1, wherein the humidification fan further comprises:

a humidification fan housing coupled to the steam generator to guide the intake air to the steam generator;

a humidification impeller disposed in the humidification fan housing and allowing air in the humidification fan housing to flow to the steam generator; and a humidification motor to rotate the humidification impeller, and wherein the steam guide further comprises:

a main steam guide coupled to the steam generator and supplied with humidified air of the steam generator, wherein the humidification fan housing and main steam guide are coupled to an upper side of the steam generator, the intake air flows from an upper side to a lower side through the humidification fan housing and flows into the steam generator, and the humidified air flows from the lower side to the upper side through the main steam guide and is discharged out of the steam generator.

3. The indoor unit of claim 2, wherein the humidification fan housing is disposed at the suction port side, and the main steam guide is disposed at the discharge port side.

4. The indoor unit of claim 1, wherein the discharge port further comprises:

a first discharge port formed at the cabinet assembly; and a second discharge port formed at the cabinet assembly, and wherein the steam guide further comprises:

a main steam guide disposed in the cabinet assembly, coupled to the steam generator and supplied with the humidified air of the steam generator;

a first branch guide coupled to the main steam guide to guide a part of the humidified air, flowing through the main steam guide, to the first discharge port;

a second branch guide coupled to the main steam guide to guide the rest of the humidified air, supplied through main steam guide, to the second discharge port;

a first diffuser disposed at the first discharge port, assembled to the first branch guide and configured to discharge the humidified air, supplied through the first branch guide, to the first discharge port; and a second diffuser disposed at the second discharge port, assembled to the second branch guide and configured to discharge the humidified air, supplied through the second branch guide, to the second discharge port.

5. The indoor unit of claim 4, wherein the first discharge port is disposed on a left surface of the cabinet assembly, the second discharge port is disposed on a right surface of the cabinet assembly, and the suction port is disposed on a back surface of the cabinet assembly.

6. The indoor unit of claim 4, wherein the main steam guide is disposed at an upper side of the steam generator, and the first branch guide and the second branch guide are disposed at an upper side of the main steam guide, and wherein the first diffuser is disposed at an upper side of the first branch guide, and the second diffuser is disposed at an upper side of the second branch guide.

7. The indoor unit of claim 4, further comprising:

a first side grille disposed at the first discharge port to guide discharged air discharged by the fan assembly; and a second side grille disposed at the second discharge port to guide discharged air discharged by the fan assembly, wherein the first diffuser is disposed at a rear of the first side grille, and the second diffuser is disposed at a rear of the second side grille.

8. The indoor unit of claim 7, wherein the first diffuser comprises a first diffuser outlet through which the humidified air is discharged, and the second diffuser comprises a second diffuser outlet through which the humidified air is discharged, a direction of discharge of the humidified air discharged from the first diffuser outlet is across a direction of an inclination of a vane disposed at the first side grille, and a direction of discharge of the humidified air discharged from the second diffuser outlet is across a direction of an inclination of a vane disposed at the second side grille.

9. The indoor unit of claim 7, wherein the first diffuser outlet is disposed towards the first side grille, and the second diffuser outlet is disposed towards the second side grille.

10. The indoor unit of claim 4, further comprising:

a first side grille disposed at the first discharge port to guide discharged air discharged by the fan assembly; and a second side grille disposed at the second discharge port to guide discharged air discharged by the fan assembly, wherein the first diffuser is disposed at a front of the first side grille, and the second diffuser is disposed at a front of the second side grille.

11. The indoor unit of claim 10, wherein the first diffuser comprises a first diffuser outlet through which the humidified air is discharged, and the second diffuser comprises a second diffuser outlet through which the humidified air is discharged, a direction of discharge of the humidified air discharged from the first diffuser outlet is across a direction of an inclination of a vane disposed at the first side grille, and a direction of discharge of the humidified air discharged from the second diffuser outlet is across a direction of an inclination of a vane disposed at the second side grille.

12. The indoor unit of claim 10, wherein the first diffuser outlet is disposed towards a left of the cabinet assembly, and a vane disposed at the first side grille is disposed towards a left of a front of the cabinet assembly, and wherein the second diffuser outlet is disposed towards a right of the cabinet assembly, and a vane disposed at the second side grille is disposed towards a right of a front of the cabinet assembly.

13. The indoor unit of claim 4, wherein the first diffuser comprises a first diffuser outlet through which the humidified air is discharged, and the second diffuser comprises a second diffuser outlet through which the humidified air is discharged, wherein the first discharge port is extended and disposed in an up-down direction, and the second discharge port is extended and disposed in the up-down direction, and wherein the first diffuser outlet is extended and disposed in the up-down direction along a lengthwise direction of the first discharge port, and the second diffuser outlet is extended and disposed in the up-down direction along a lengthwise direction of the second discharge port.

14. The indoor unit of claim 4, wherein the first diffuser comprises a first diffuser inlet coupled to the first branch guide, and an inner diameter (P1) of the first diffuser inlet is smaller than an inner diameter (P2) of the first branch guide.

15. The indoor unit of claim 14, wherein a lower end of the first diffuser inlet is inserted into the first branch guide, and a step (GP) is formed between the lower end of the first diffuser inlet and an inner surface of the first branch guide.

* * * * *